US007966693B2

(12) United States Patent
Choi et al.

(10) Patent No.: US 7,966,693 B2
(45) Date of Patent: Jun. 28, 2011

(54) HINGE APPARATUS HAVING AUTOMATIC RETURN FUNCTION

(75) Inventors: Soon Woo Choi, Gyeonggi-do (KR); Chan Ho Hong, Gyeonggi-do (KR)

(73) Assignee: I-One Innotech Co., Ltd, Gyeonggi-Do (KR)

( * ) Notice: Subject to any disclaimer, the term of this patent is extended or adjusted under 35 U.S.C. 154(b) by 322 days.

(21) Appl. No.: 12/310,011

(22) PCT Filed: Aug. 3, 2007

(86) PCT No.: PCT/KR2007/003743

§ 371 (c)(1),
(2), (4) Date: Feb. 6, 2009

(87) PCT Pub. No.: WO2008/018720

PCT Pub. Date: Feb. 14, 2008

(65) Prior Publication Data

US 2009/0241289 A1 Oct. 1, 2009

(30) Foreign Application Priority Data

Aug. 8, 2006 (KR) ..... 10-2006-0074906

(51) Int. Cl.
*E05F 3/20* (2006.01)

(52) U.S. Cl. ..... 16/54; 16/50; 16/284

(58) Field of Classification Search ..... 16/50, 54, 16/280–285, 330, 303, 55, 68, 72, 76, 312
See application file for complete search history.

(56) References Cited

U.S. PATENT DOCUMENTS

| | | | | | |
|---|---|---|---|---|---|
| 2,118,950 | A * | 5/1938 | Stannard | 16/54 |
| 4,068,344 | A * | 1/1978 | Okabe | 16/54 |
| 4,117,567 | A * | 10/1978 | Shimizu | 16/50 |
| 4,155,144 | A * | 5/1979 | Koganei | 16/54 |
| 4,413,373 | A * | 11/1983 | Sasaki | 16/54 |
| 4,829,628 | A * | 5/1989 | Vuksic | 16/54 |
| 5,152,029 | A * | 10/1992 | Pai | 16/54 |
| 5,855,040 | A * | 1/1999 | Lin | 16/50 |
| 6,205,619 | B1 * | 3/2001 | Jang | 16/352 |
| 6,658,694 | B2 * | 12/2003 | Wang | 16/50 |
| 2004/0250377 | A1 * | 12/2004 | Park | 16/50 |

* cited by examiner

*Primary Examiner* — Chuck Y. Mah
(74) *Attorney, Agent, or Firm* — Rosenberg, Klein & Lee

(57) ABSTRACT

A hinge apparatus includes an upper body, a lower body, a shaft whose lower end portion is rotatably installed in the lower body, a piston whose outer circumference is slidably installed along the inner surface of the lower body, a rotational/linear motion converter which converts a rotational motion of the shaft into an axial linear motion of the piston, a damping unit provides a damping function selectively where the piston ascends according to return of the door, a torsion spring rotates the shaft in the door closing direction, and a clutch unit for stopping the elastic force due to reverse twisting of the spring or for restoring the elastic force of the spring.

24 Claims, 40 Drawing Sheets

【Figure 1A】
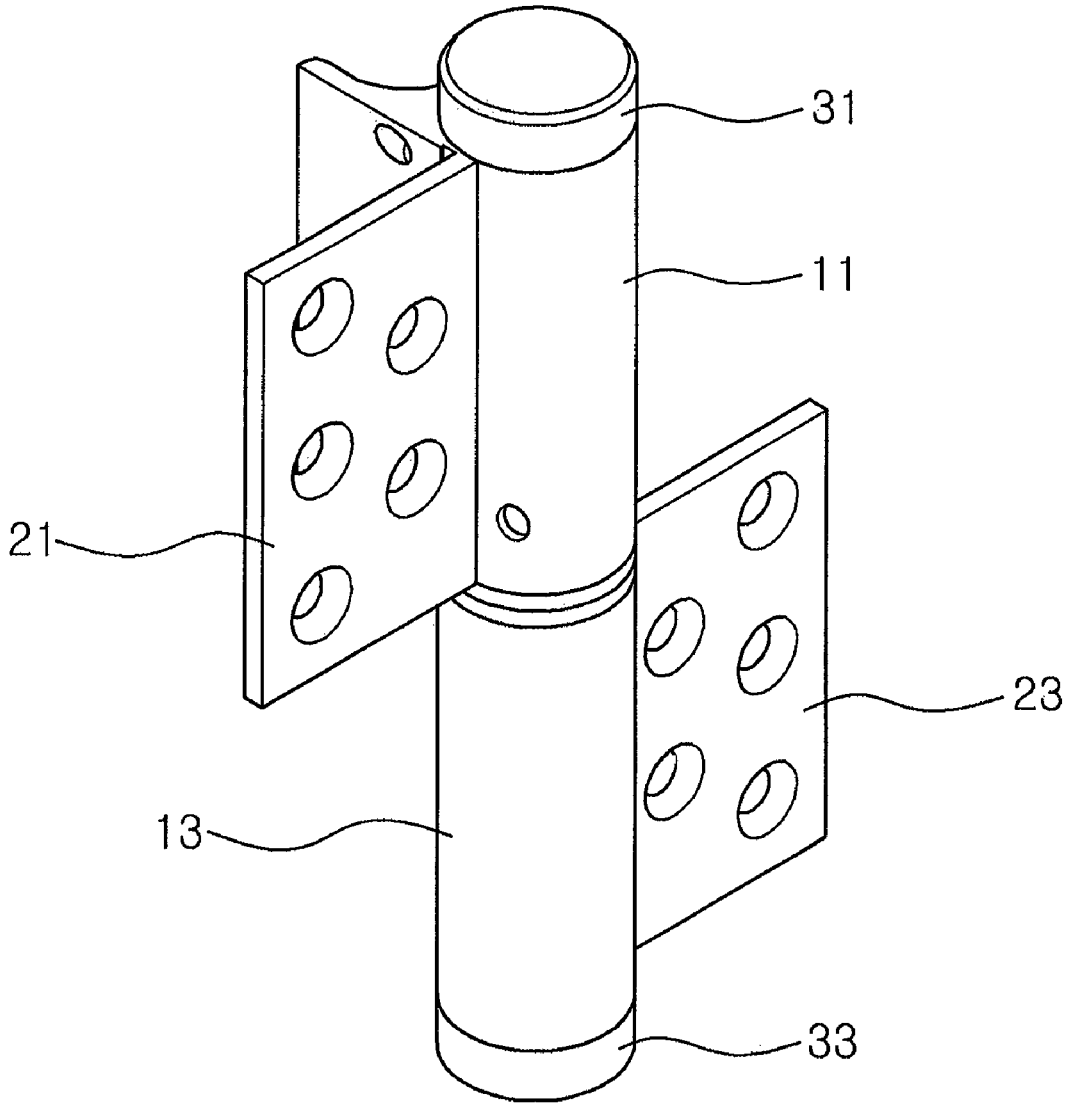

【Figure 1B】
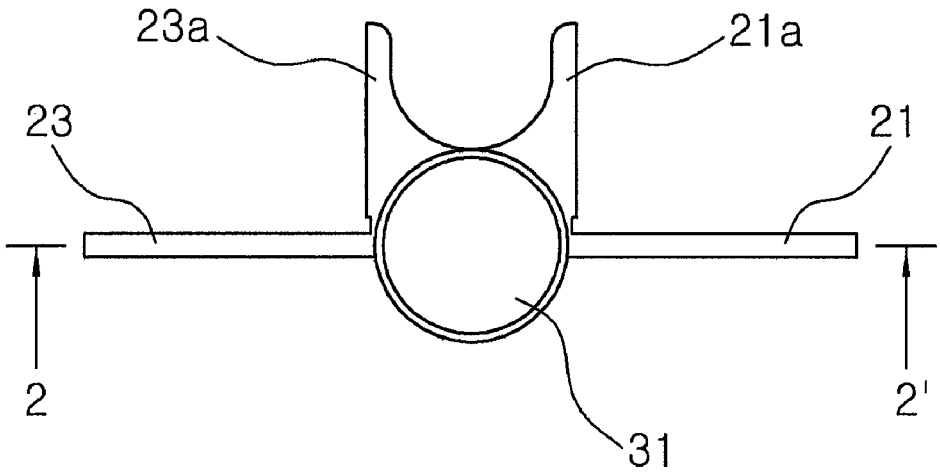
【Figure 1C】
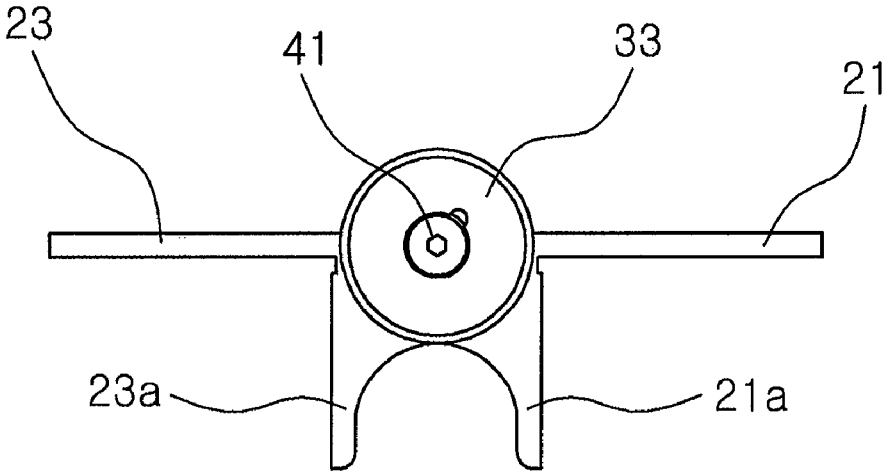

【Figure 2A】
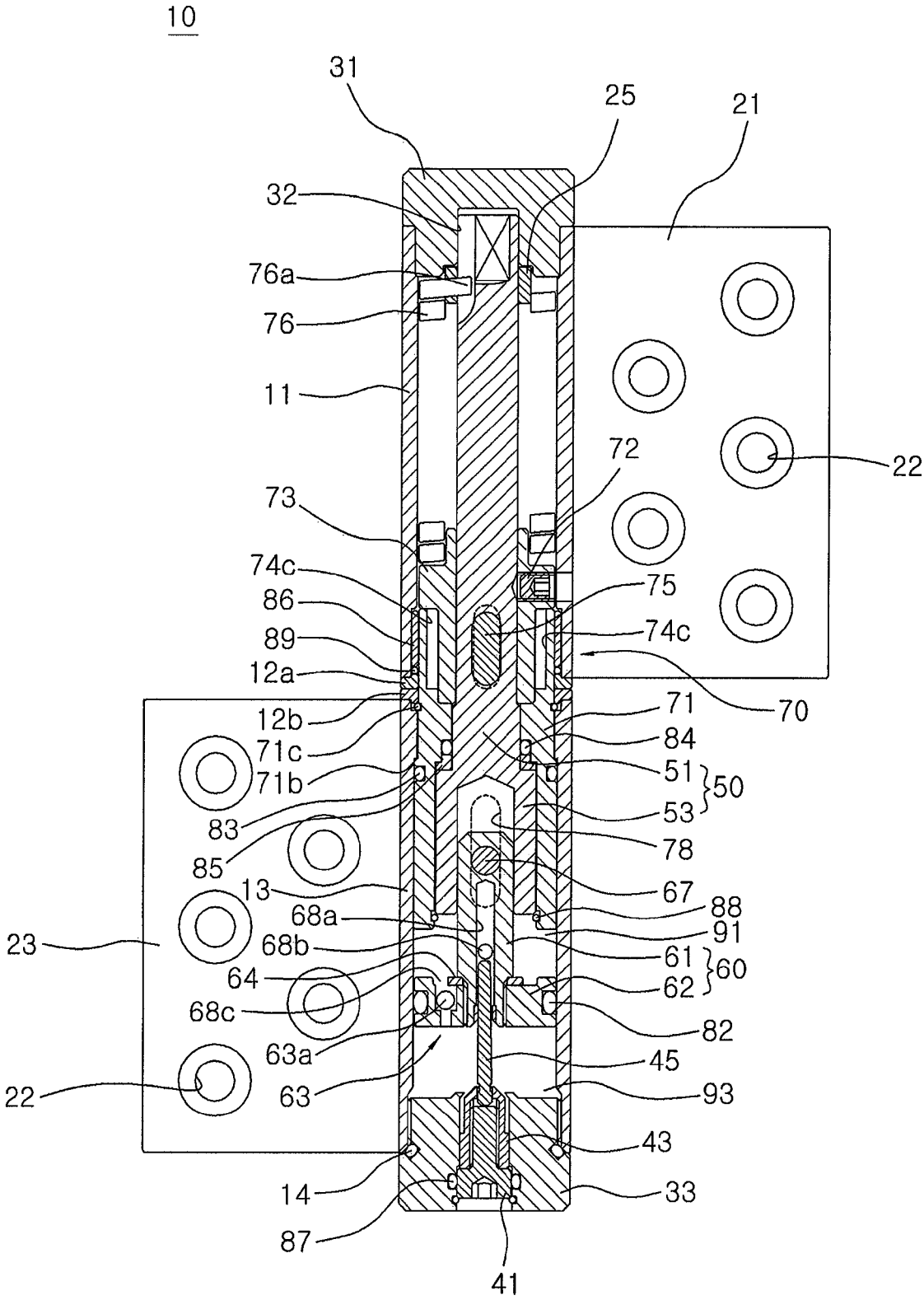

【Figure 2B】
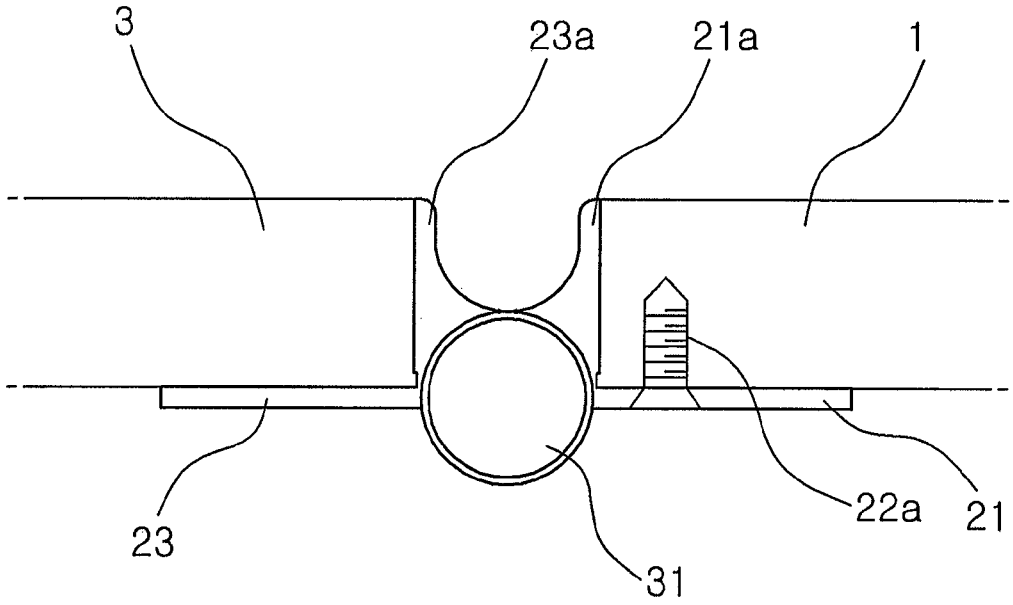
【Figure 3A】
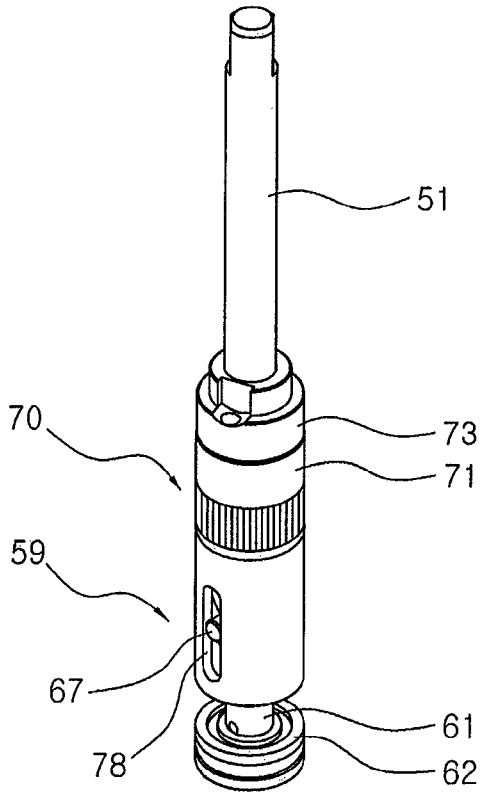

【Figure 3B】
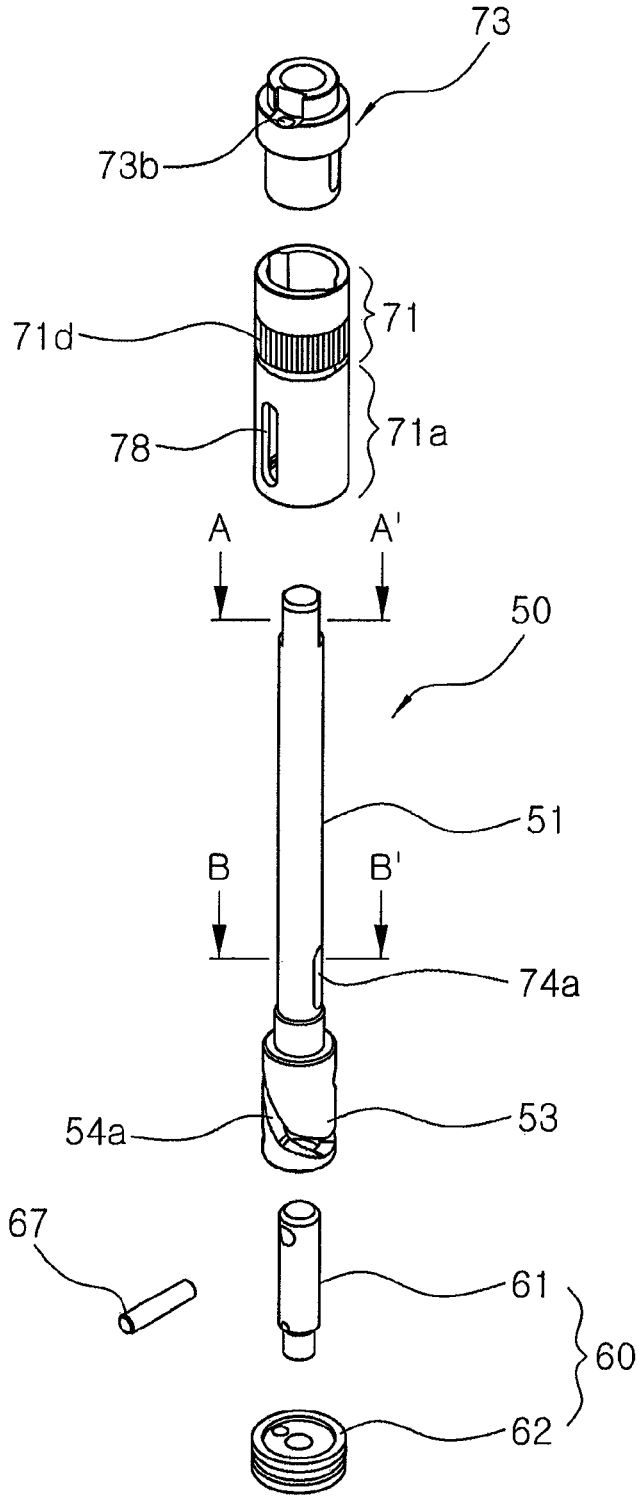

【Figure 3C】
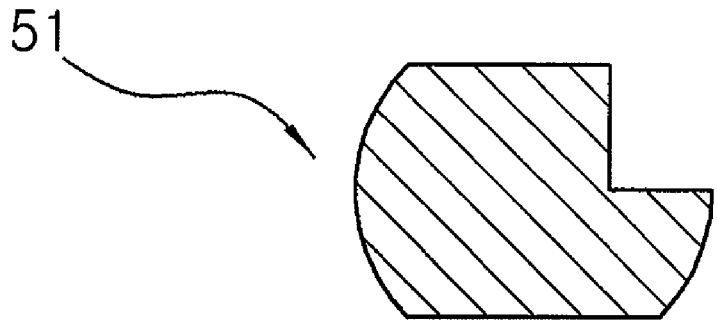
【Figure 3D】
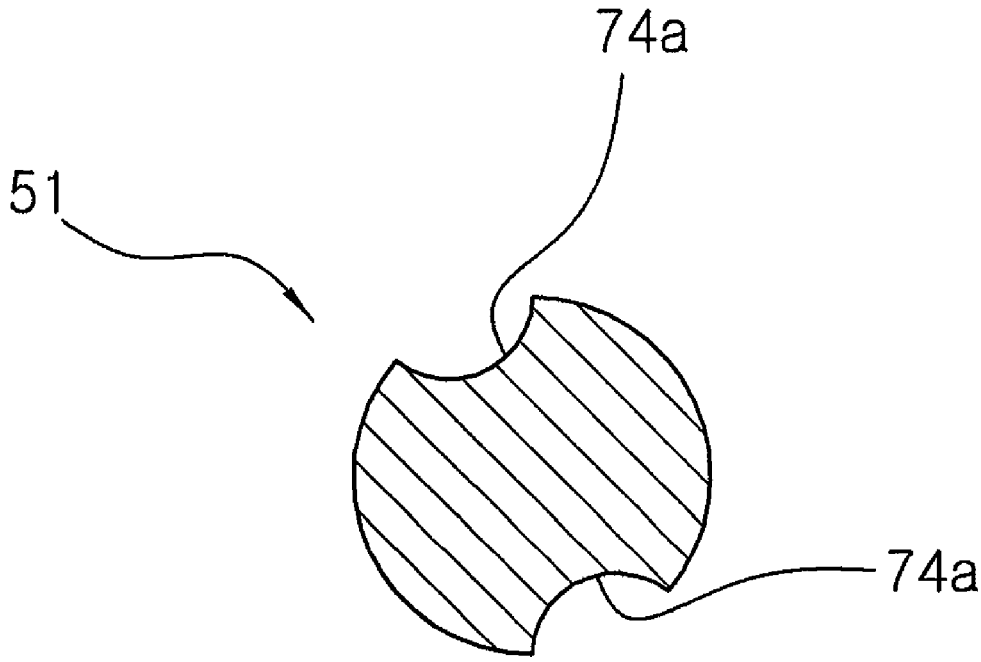

【Figure 4】
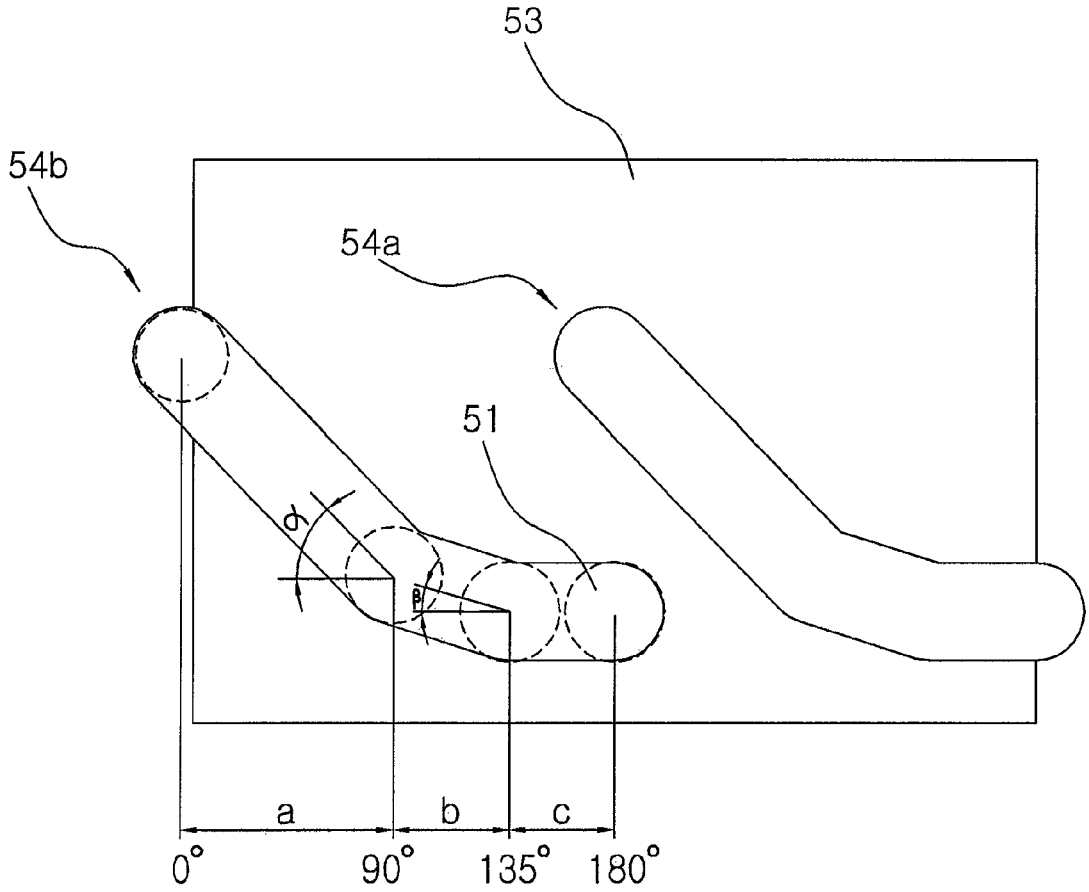

【Figure 5A】
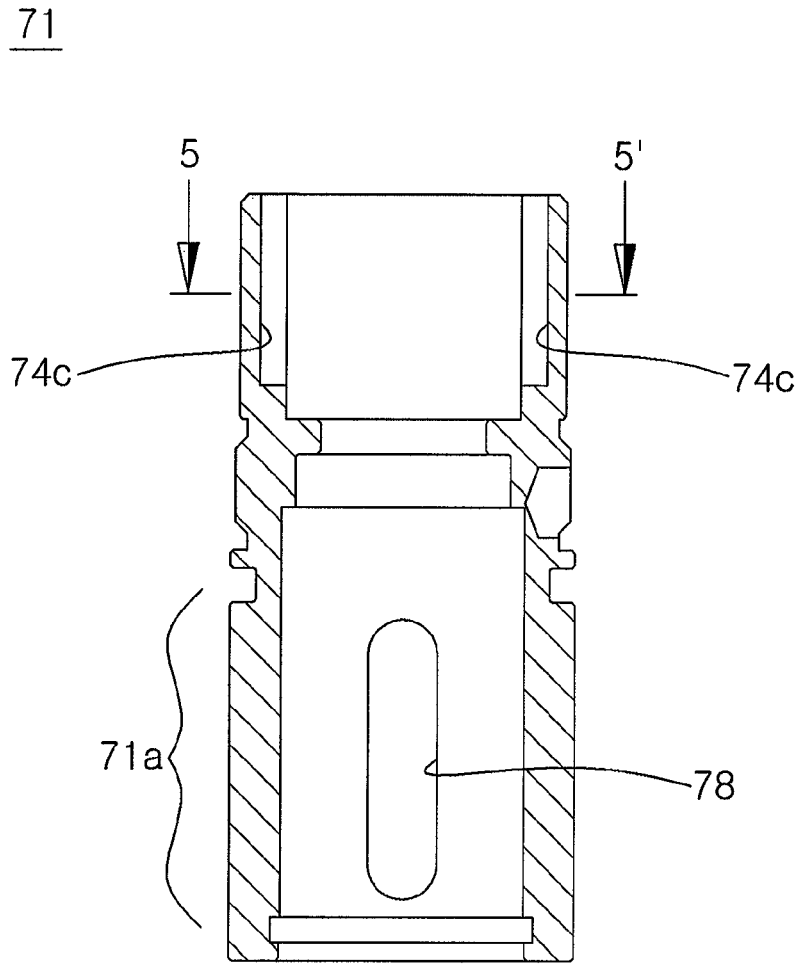
【Figure 5B】
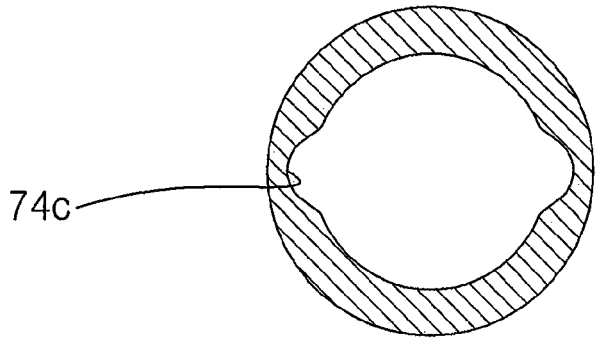

【Figure 5C】
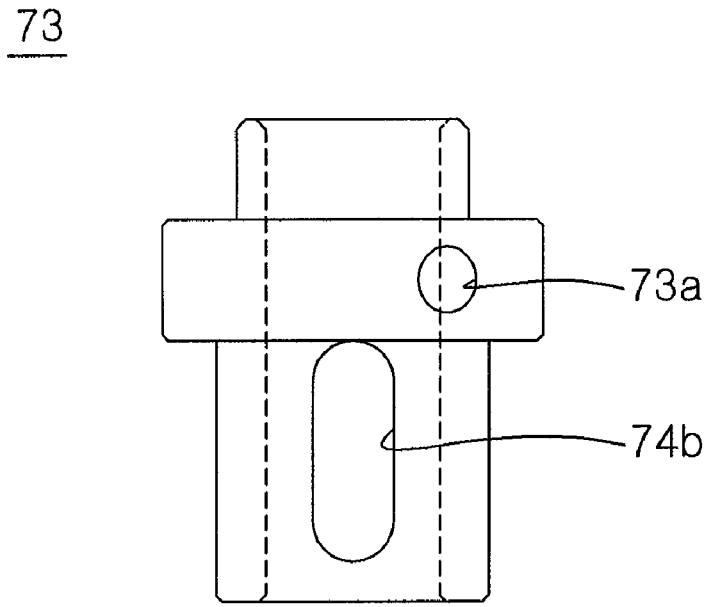
【Figure 6A】
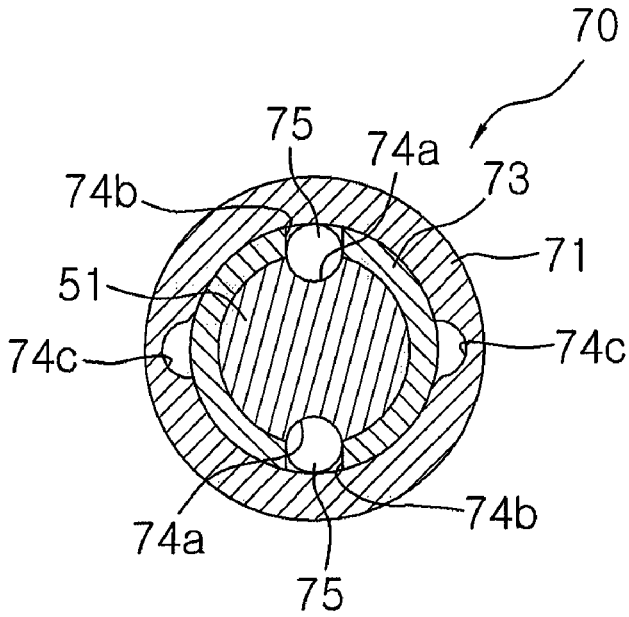

【Figure 6B】
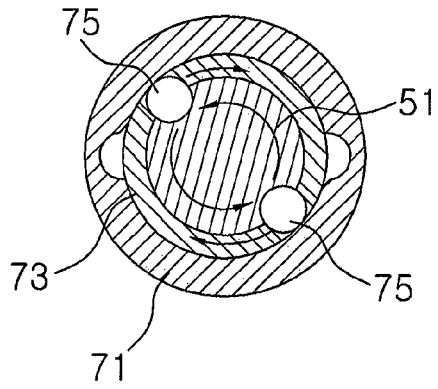
【Figure 6C】
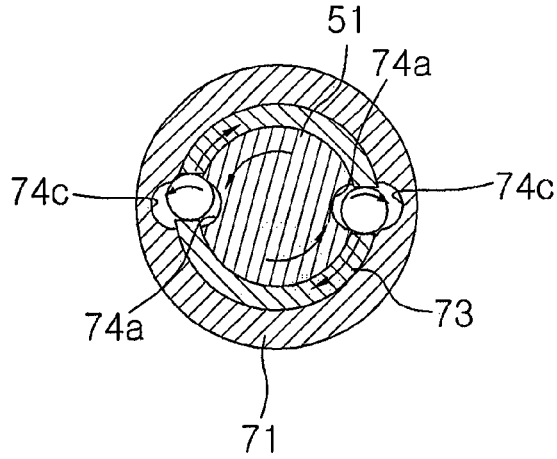
【Figure 6D】
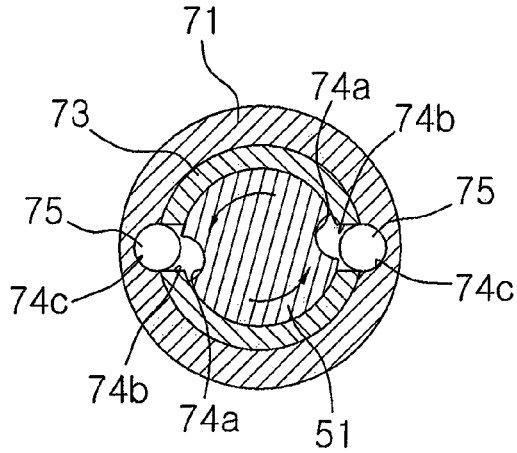

【Figure 7】
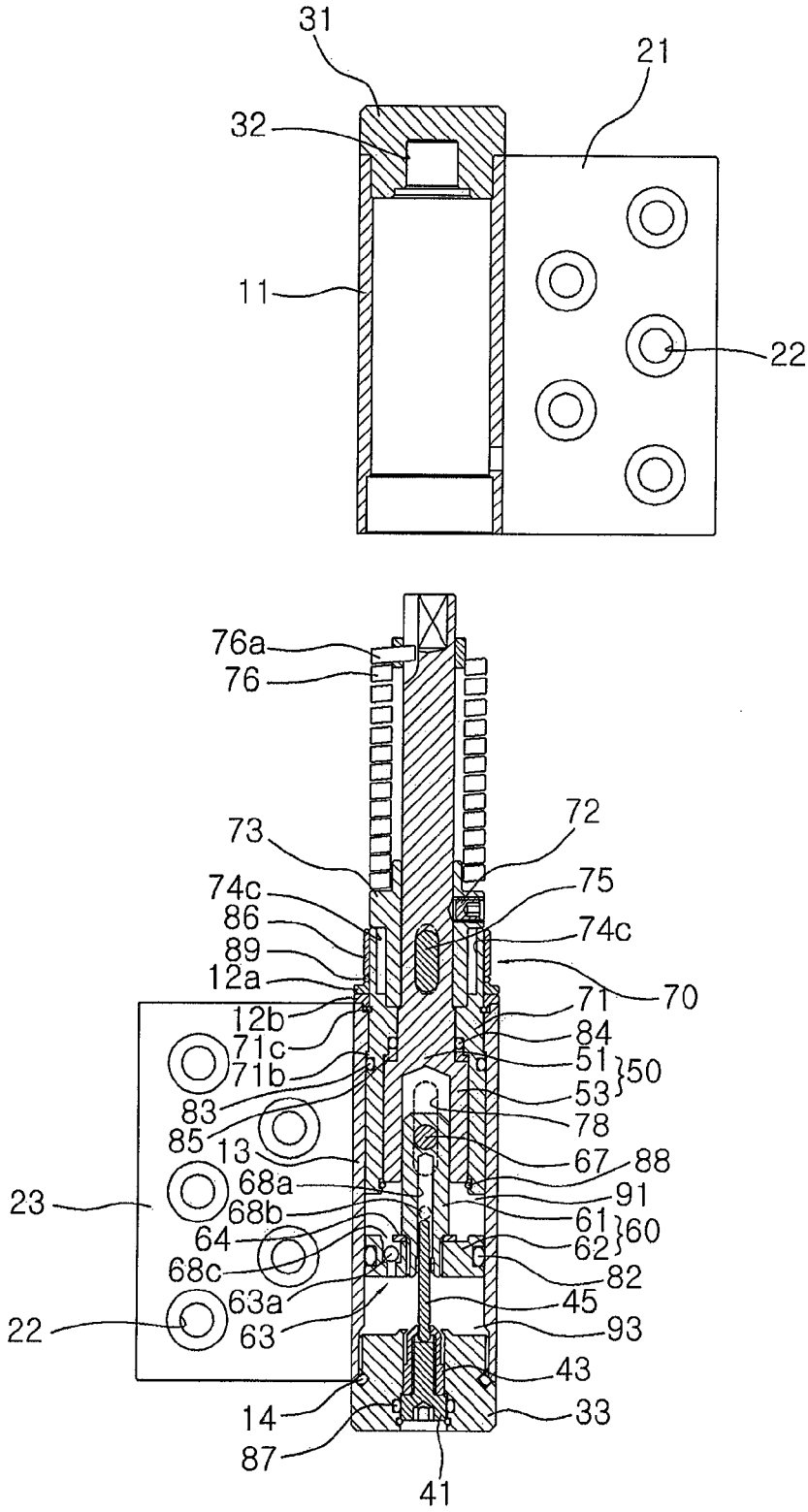

【Figure 8A】
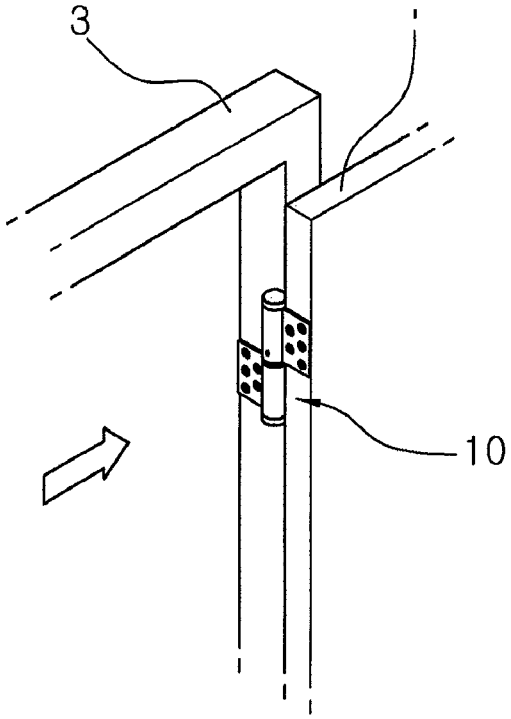
【Figure 8B】
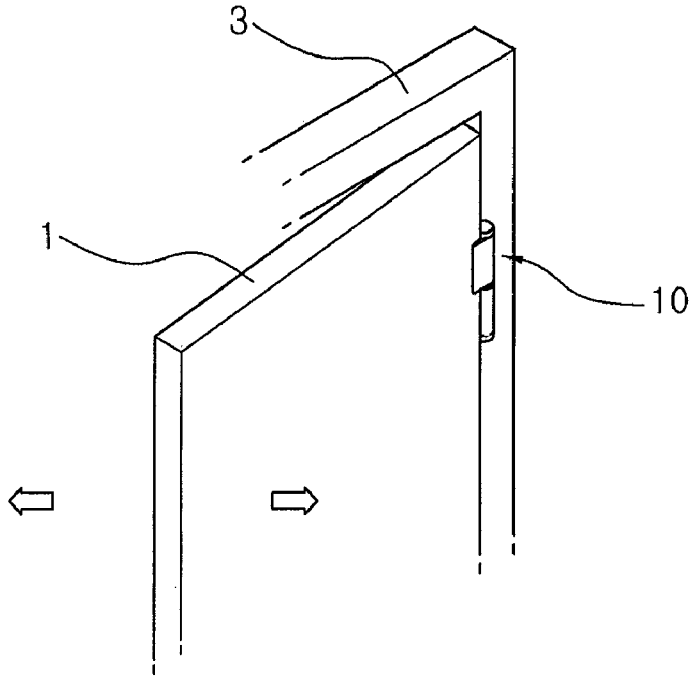

【Figure 8C】
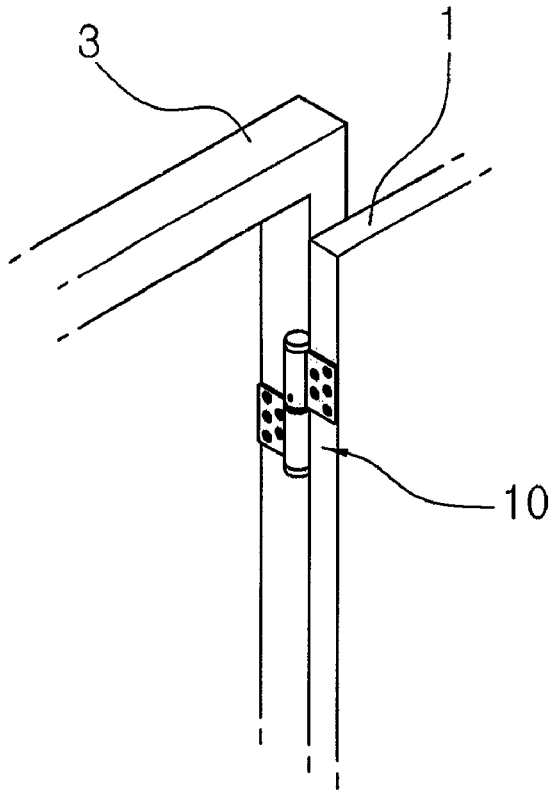
【Figure 8D】
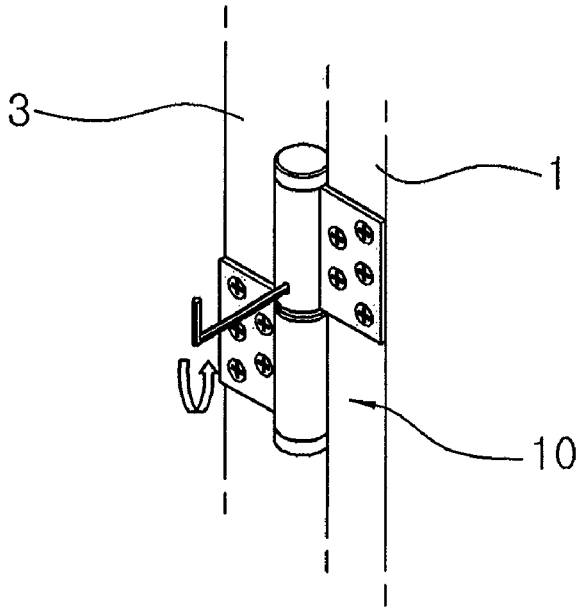

【Figure 8E】
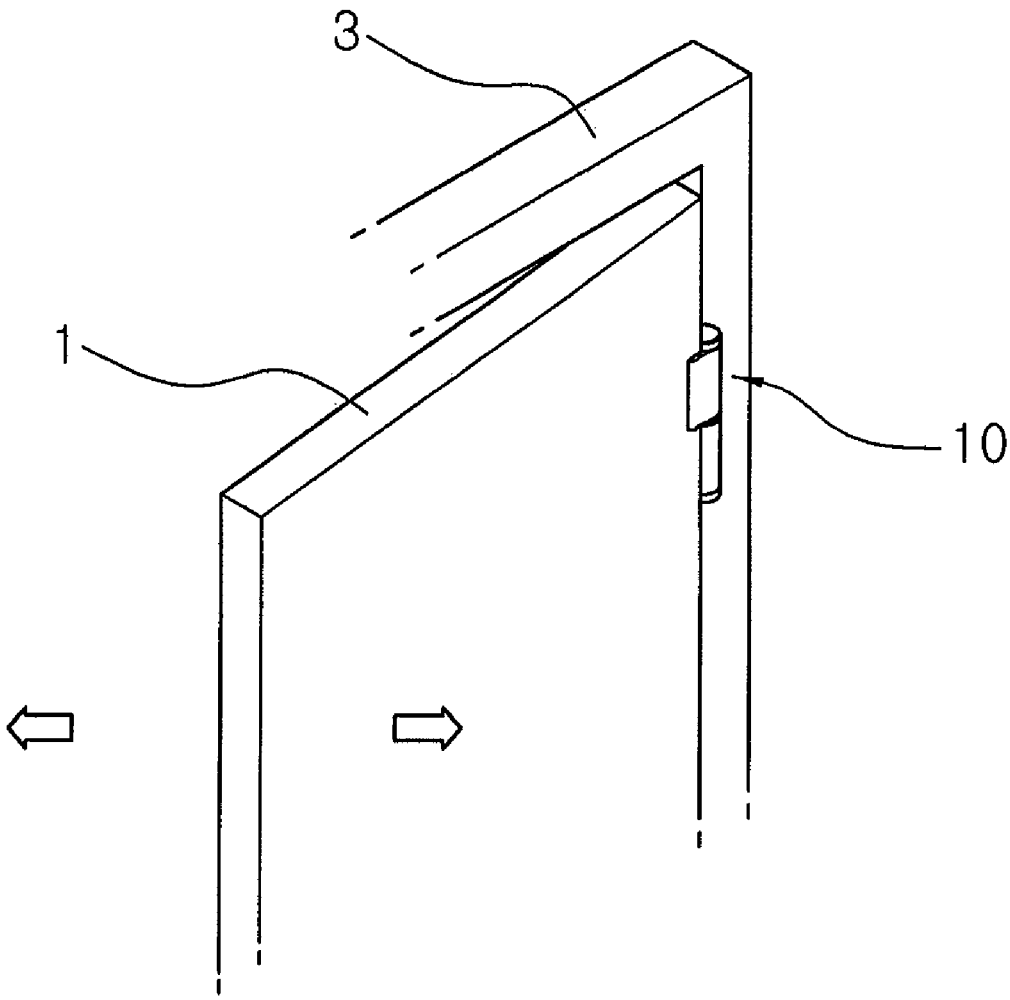

【Figure 9A】
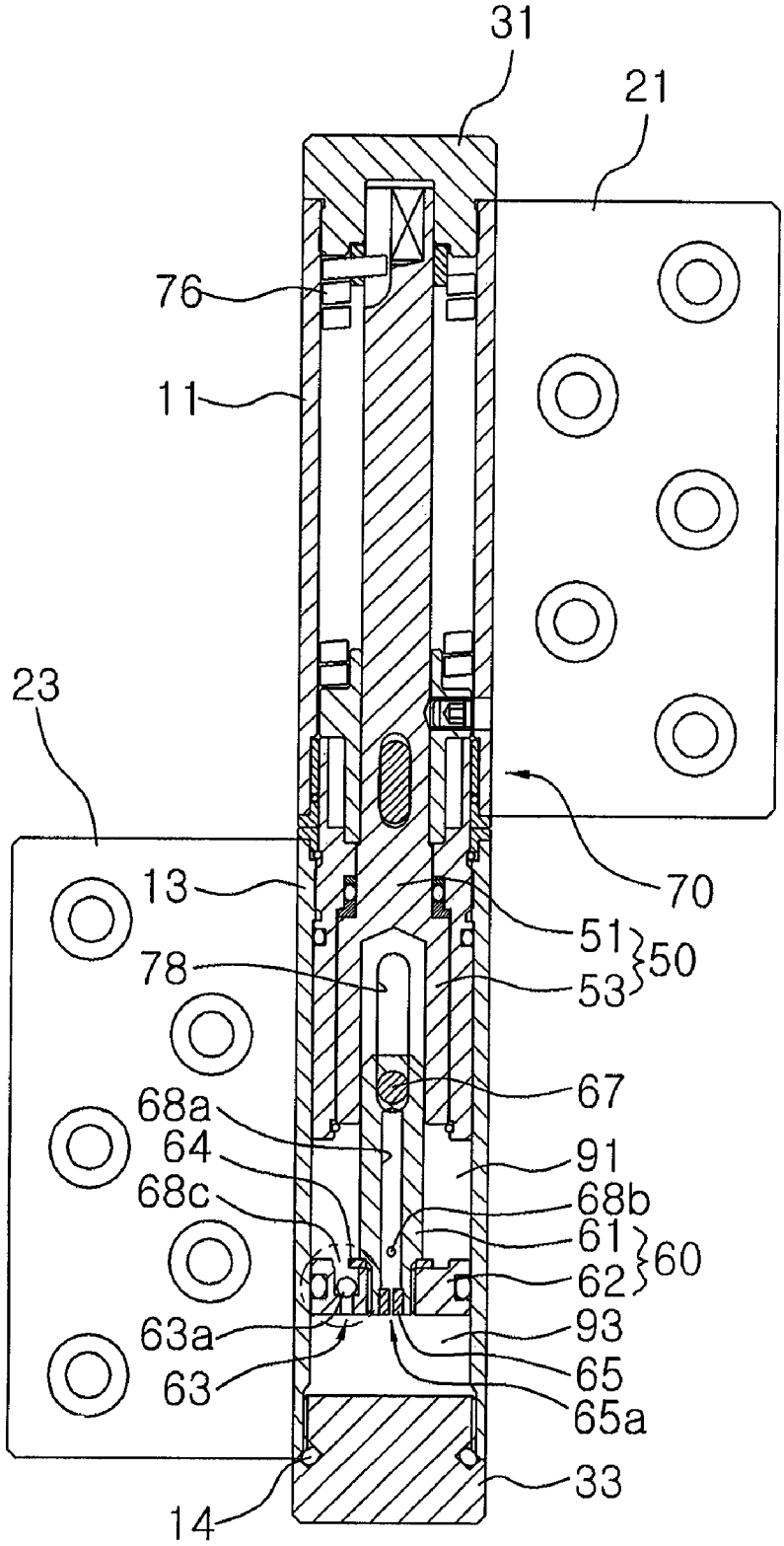

【Figure 9B】
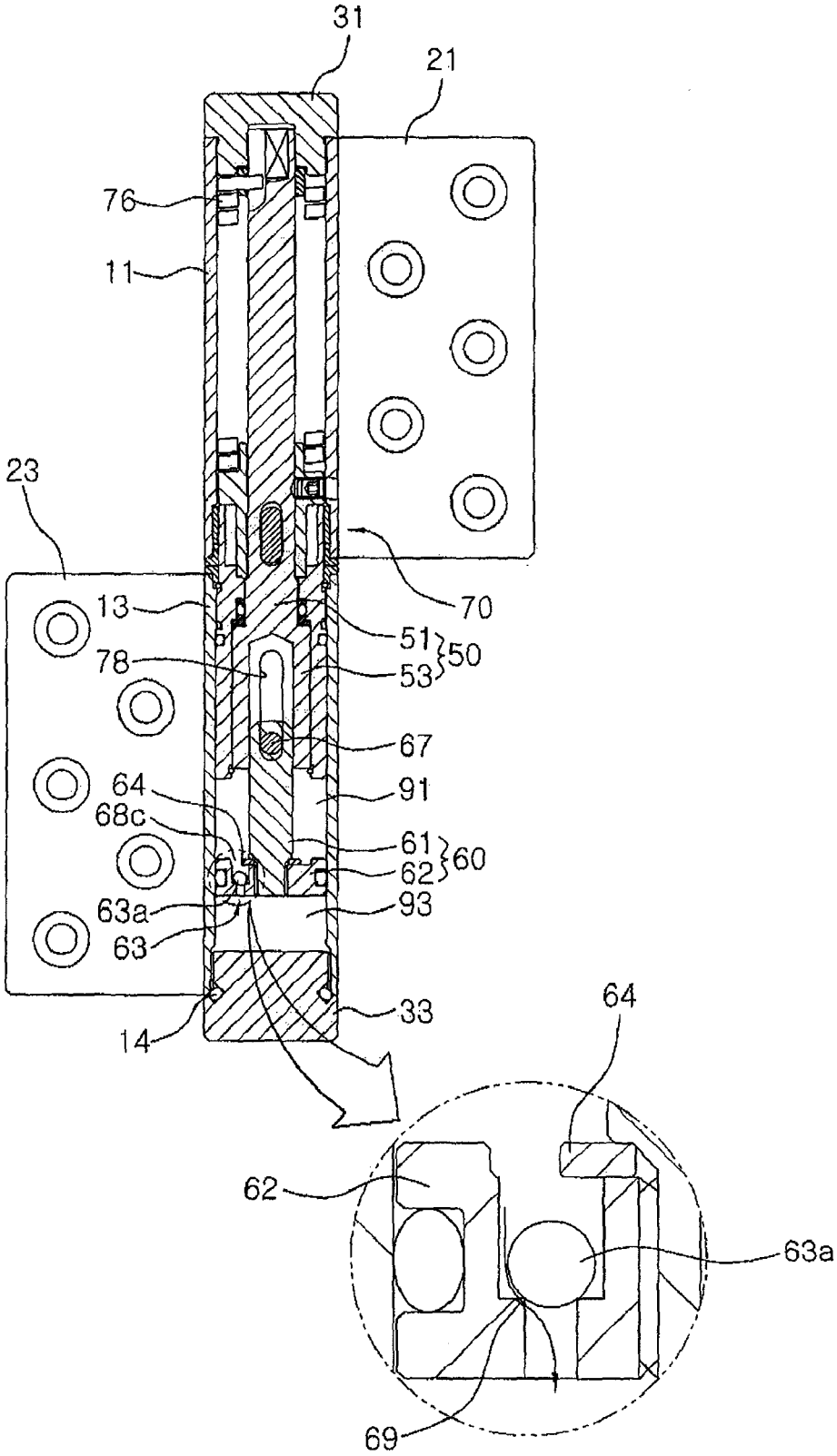

【Figure 10A】
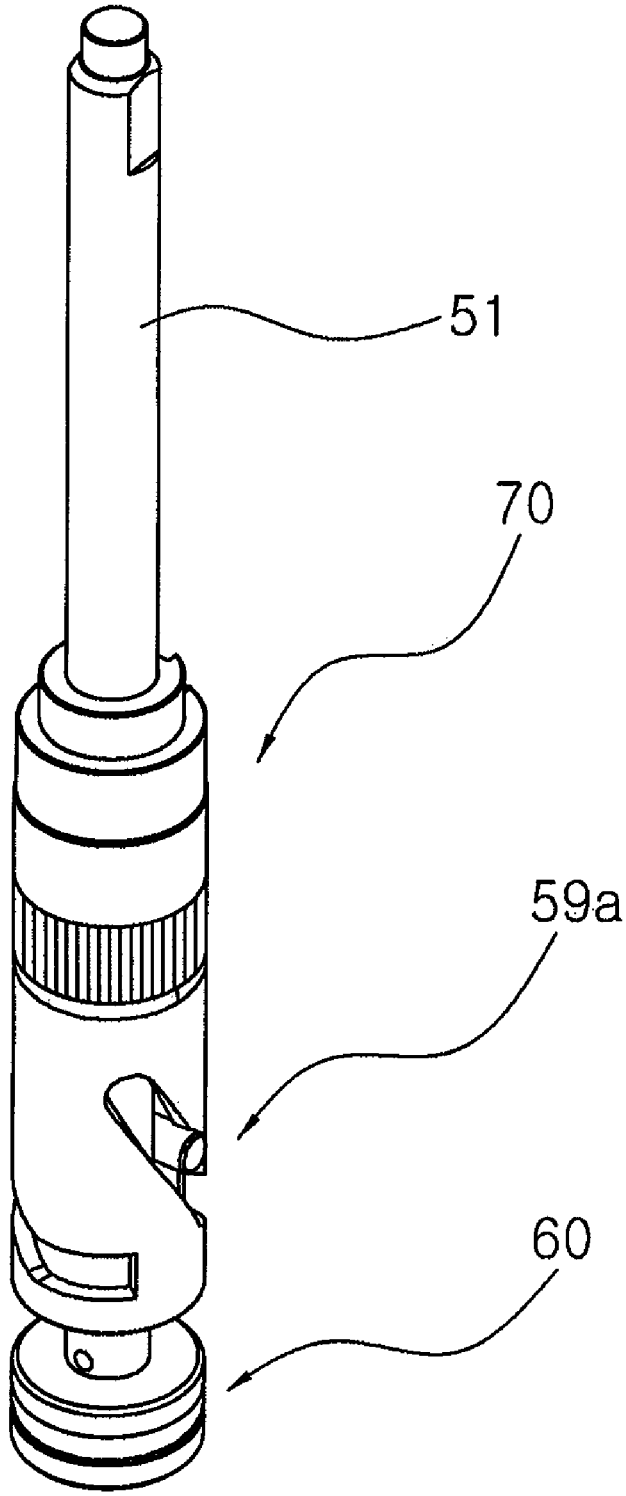

【Figure 10B】
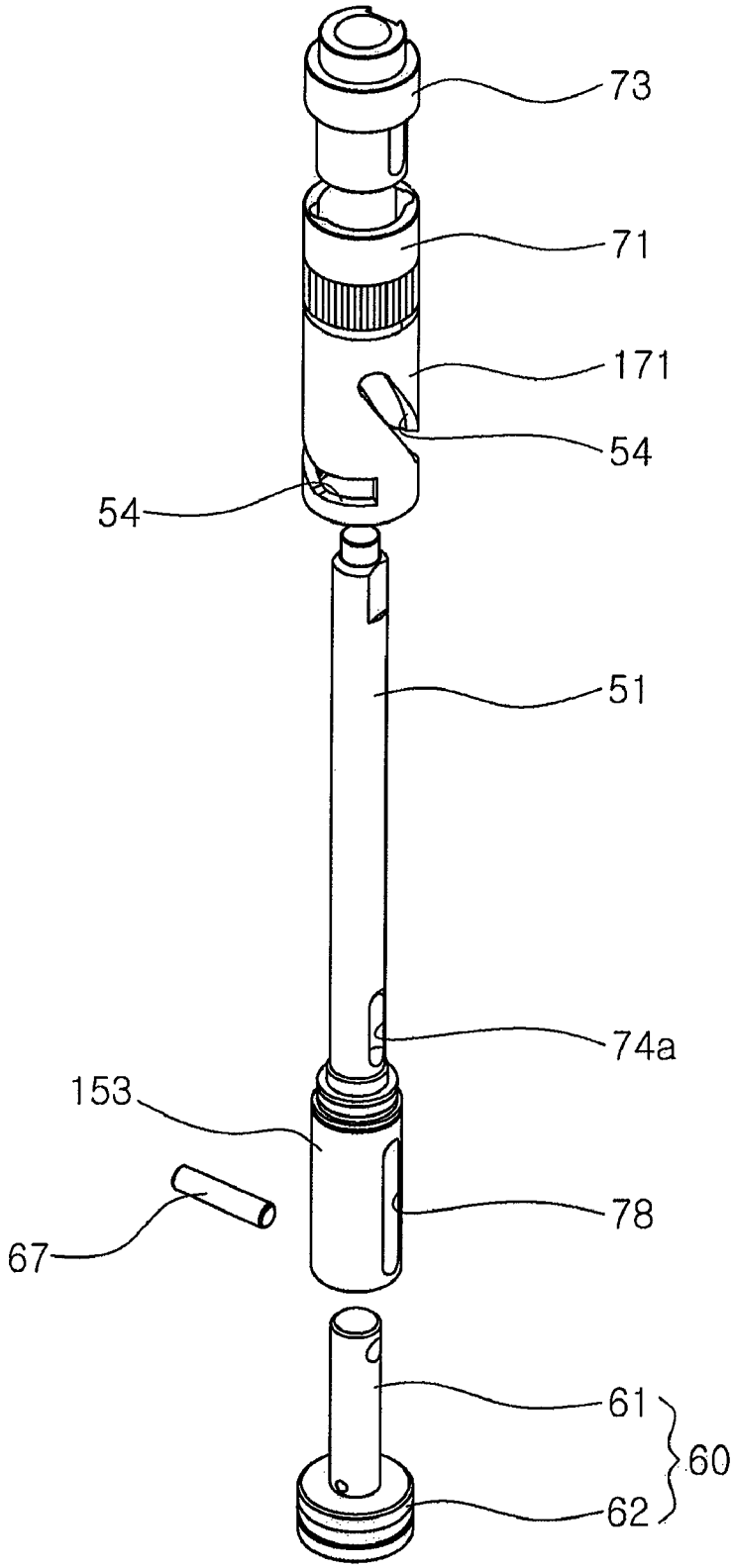

【Figure 10C】
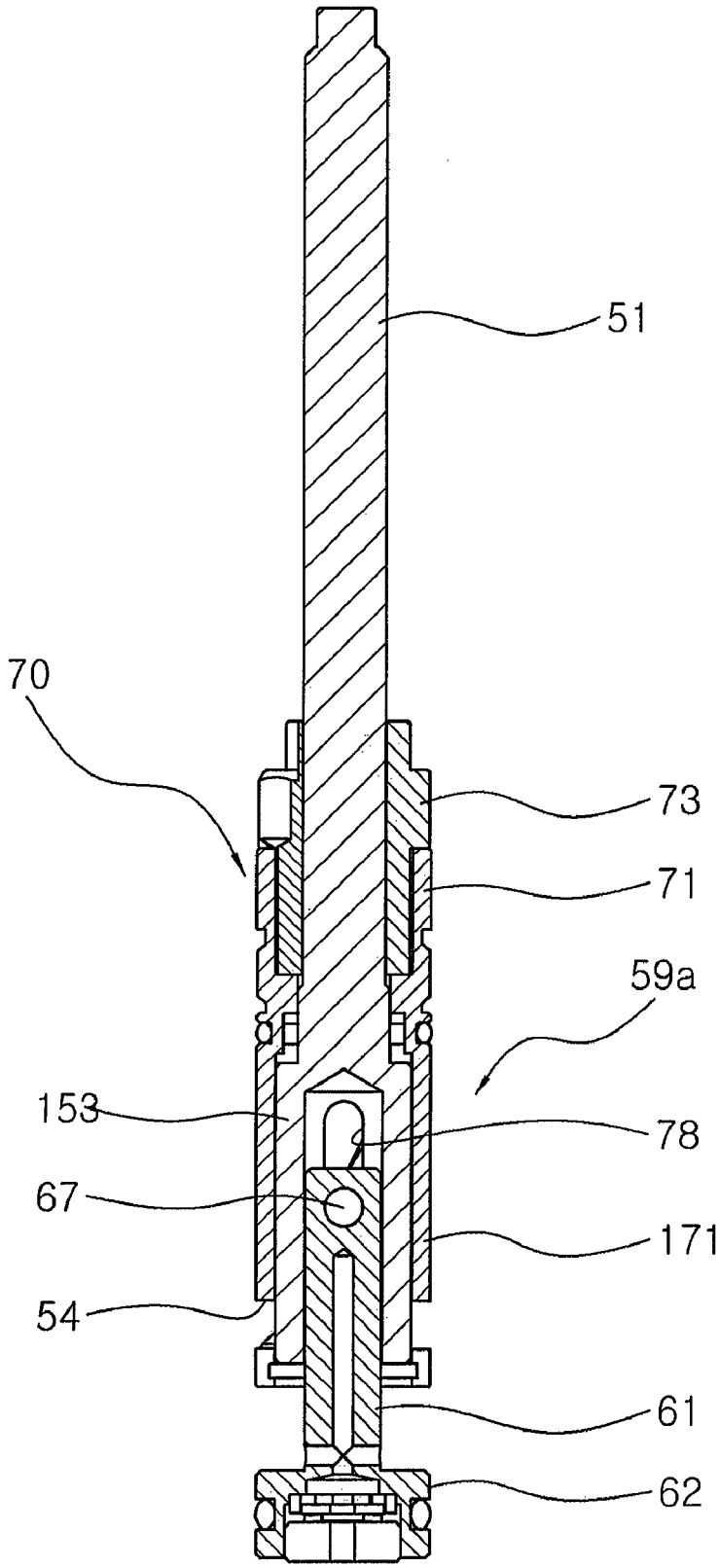

【Figure 11A】
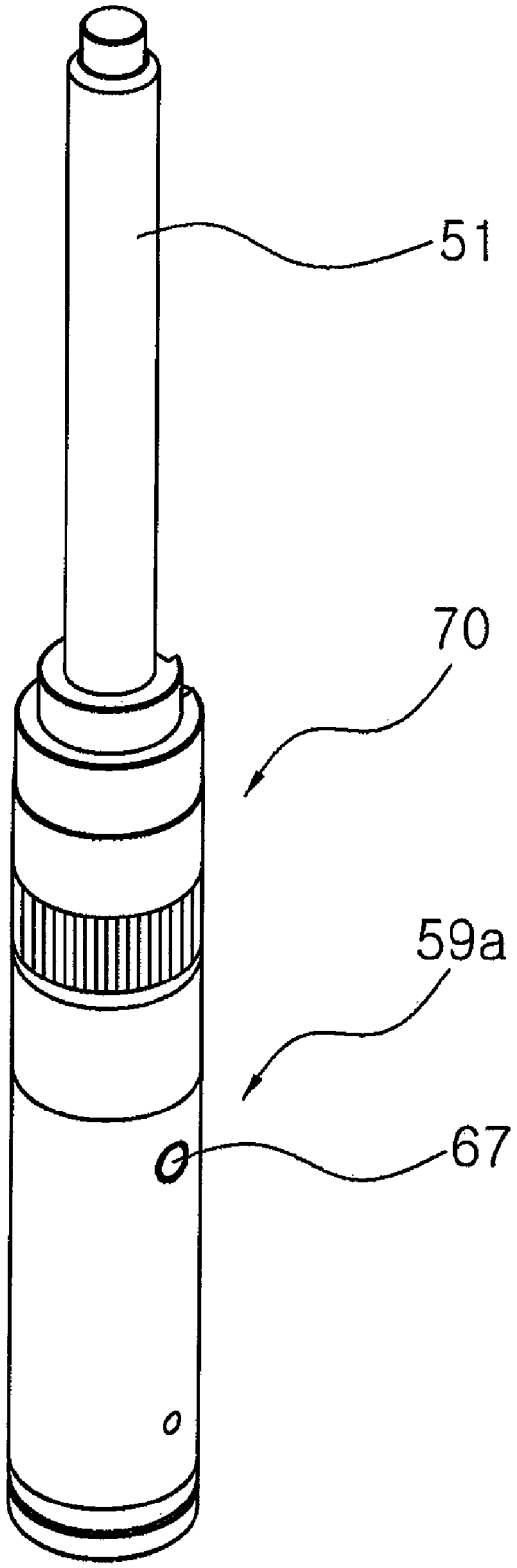

【Figure 11B】
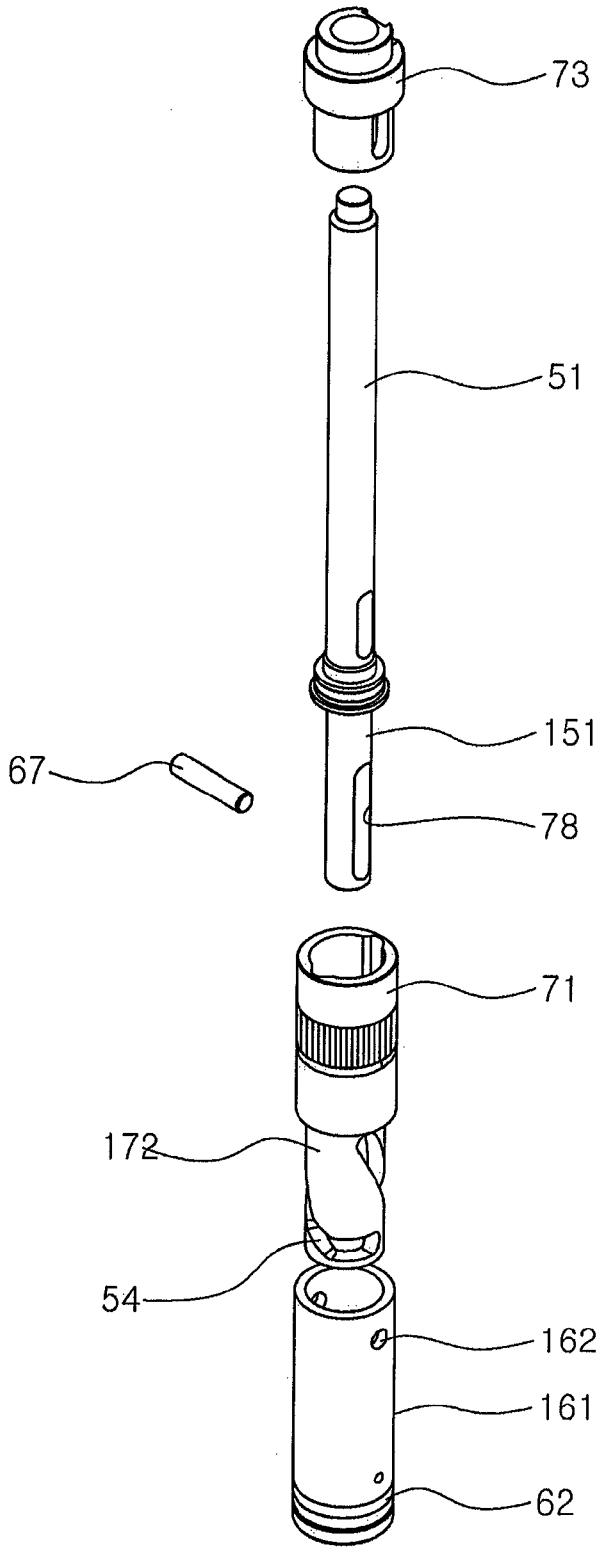

【Figure 11C】
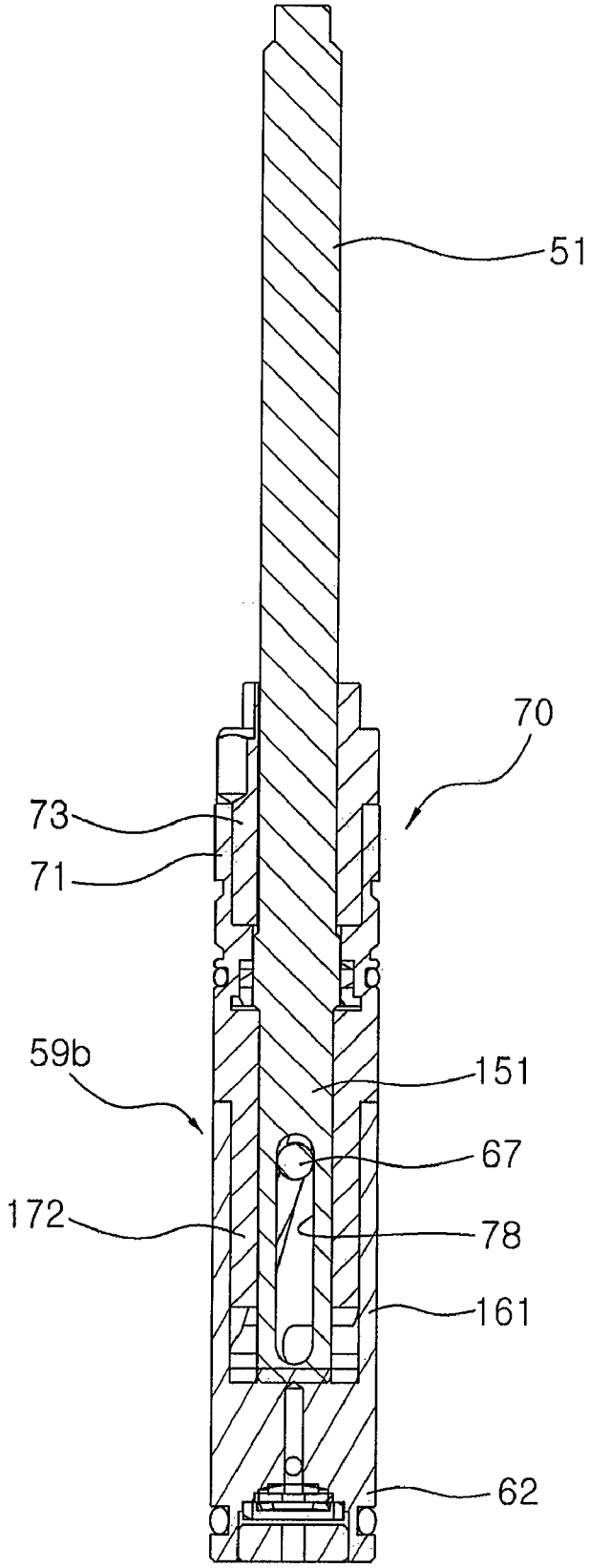

【Figure 11D】
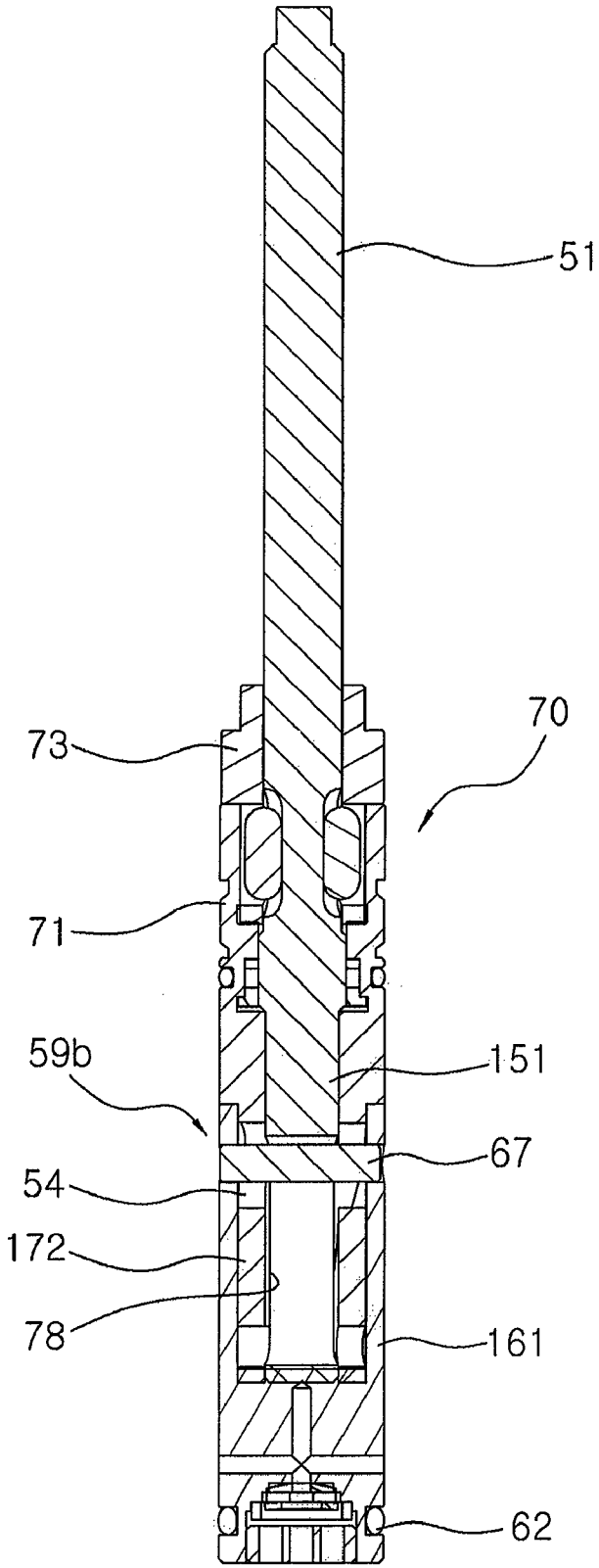

【Figure 12A】
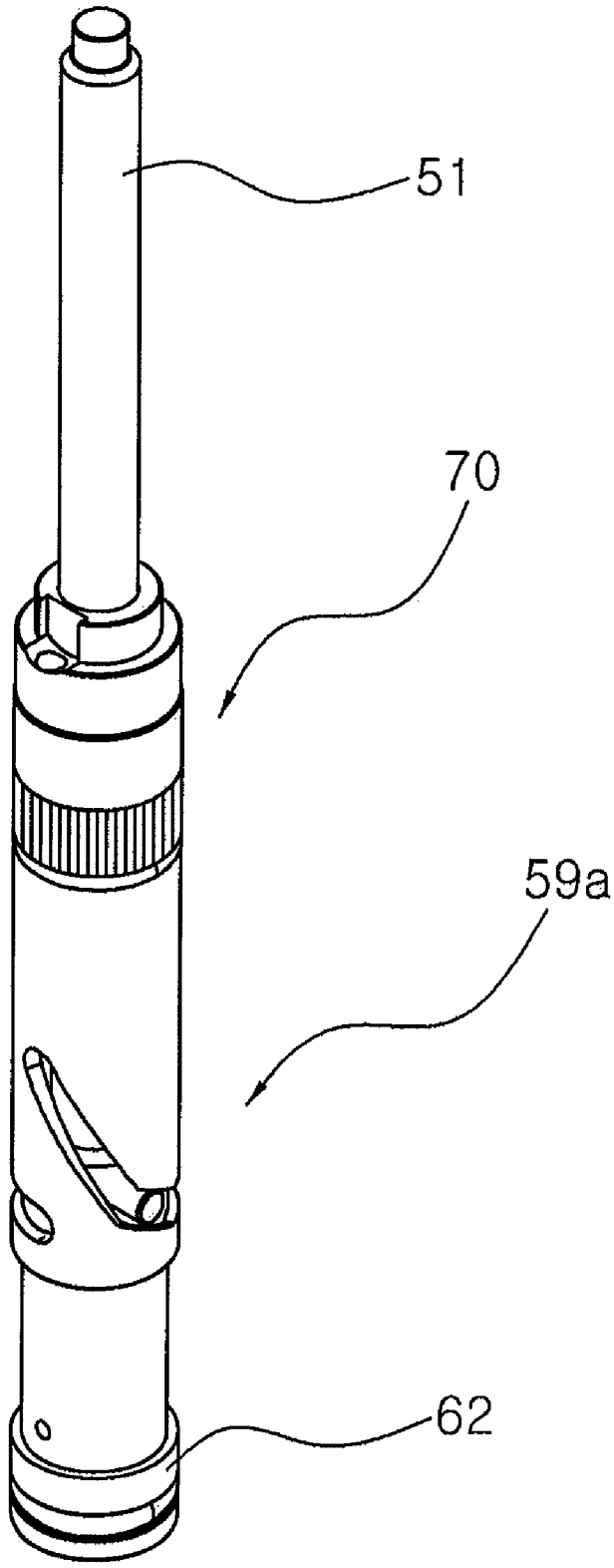

【Figure 12B】
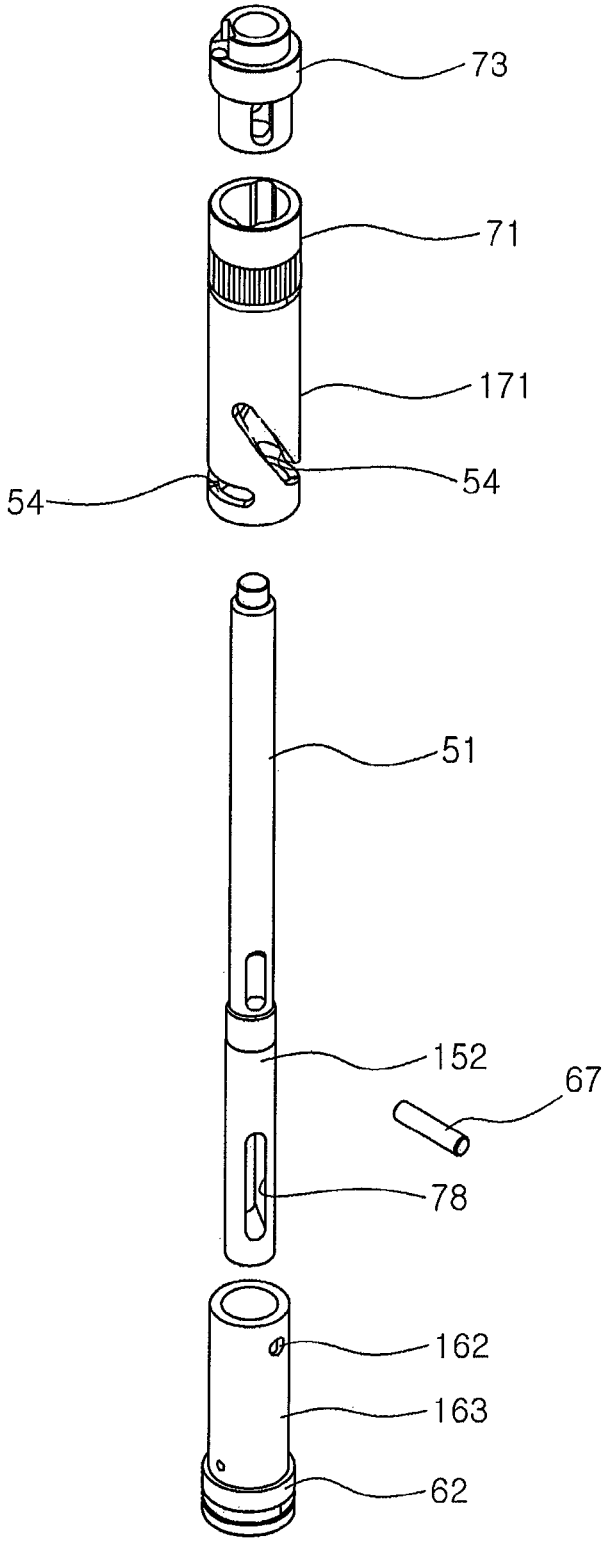

【Figure 12C】
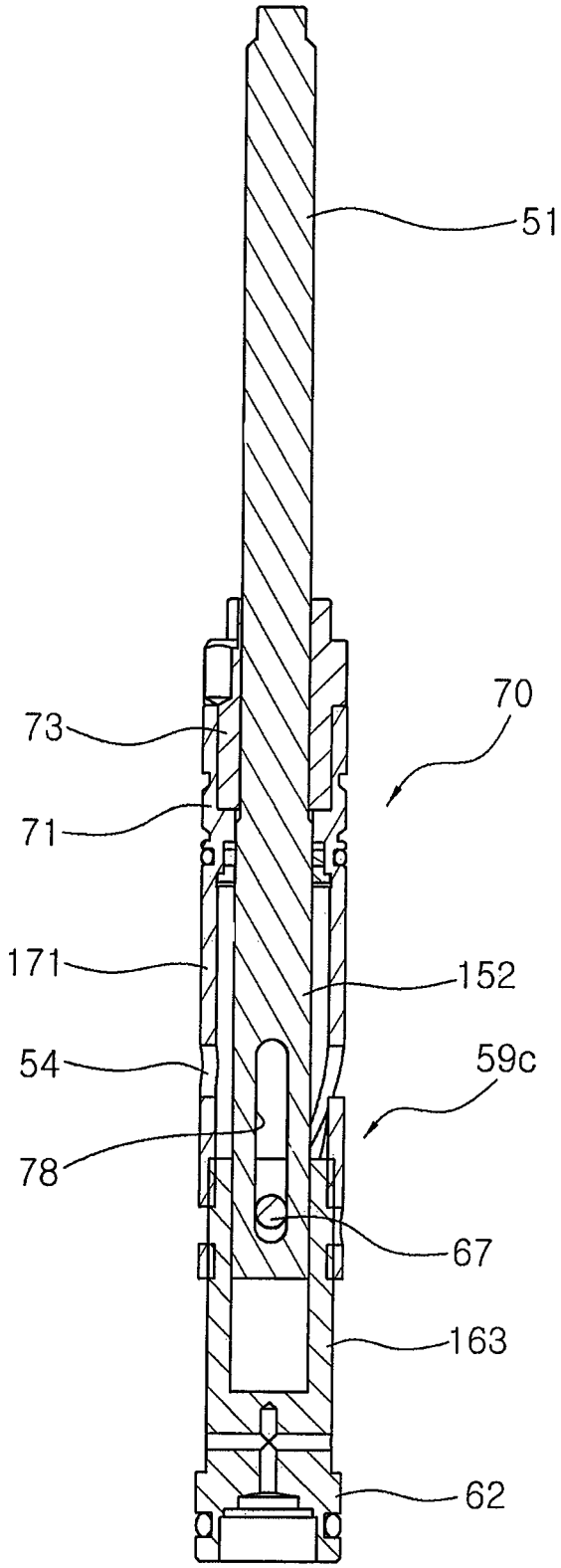

【Figure 12D】
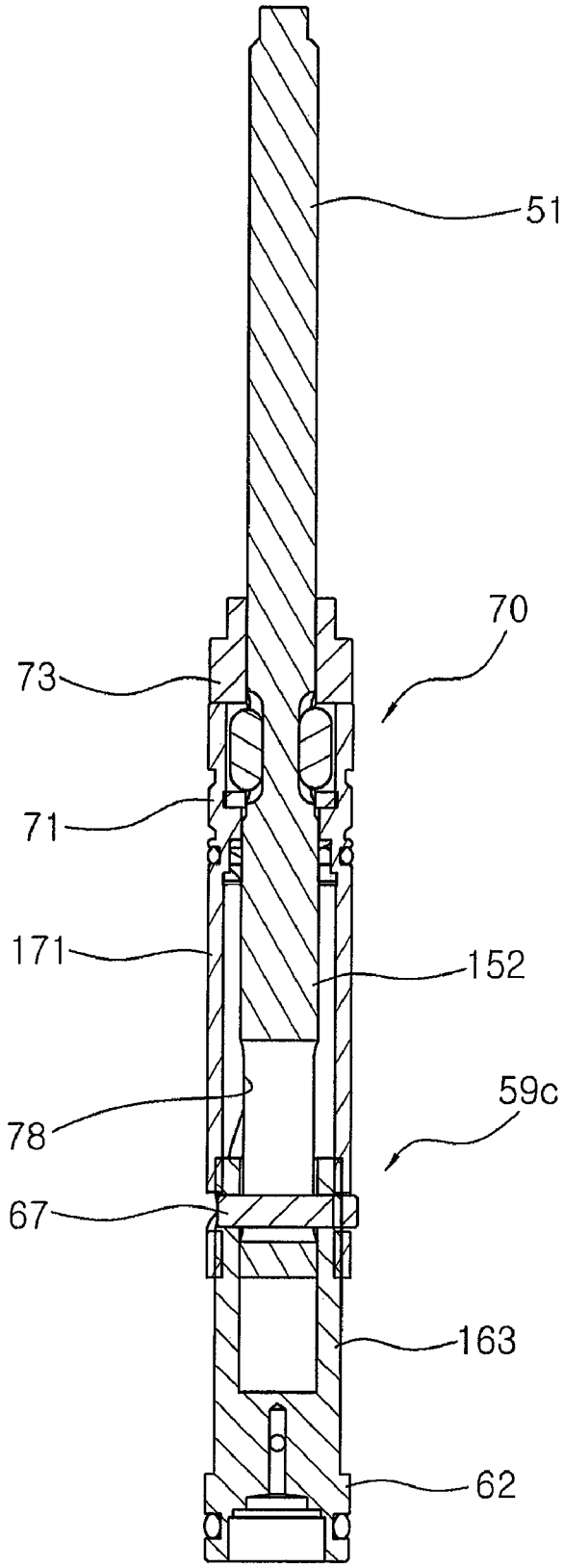

【Figure 13A】
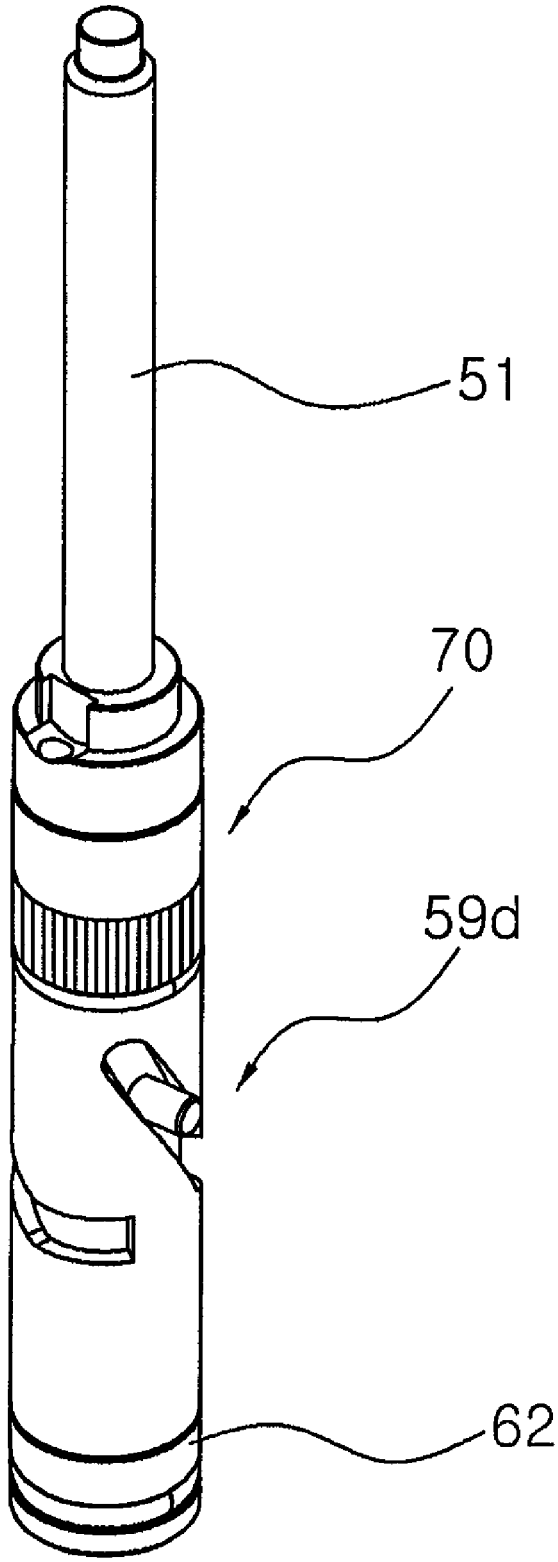

【Figure 13B】
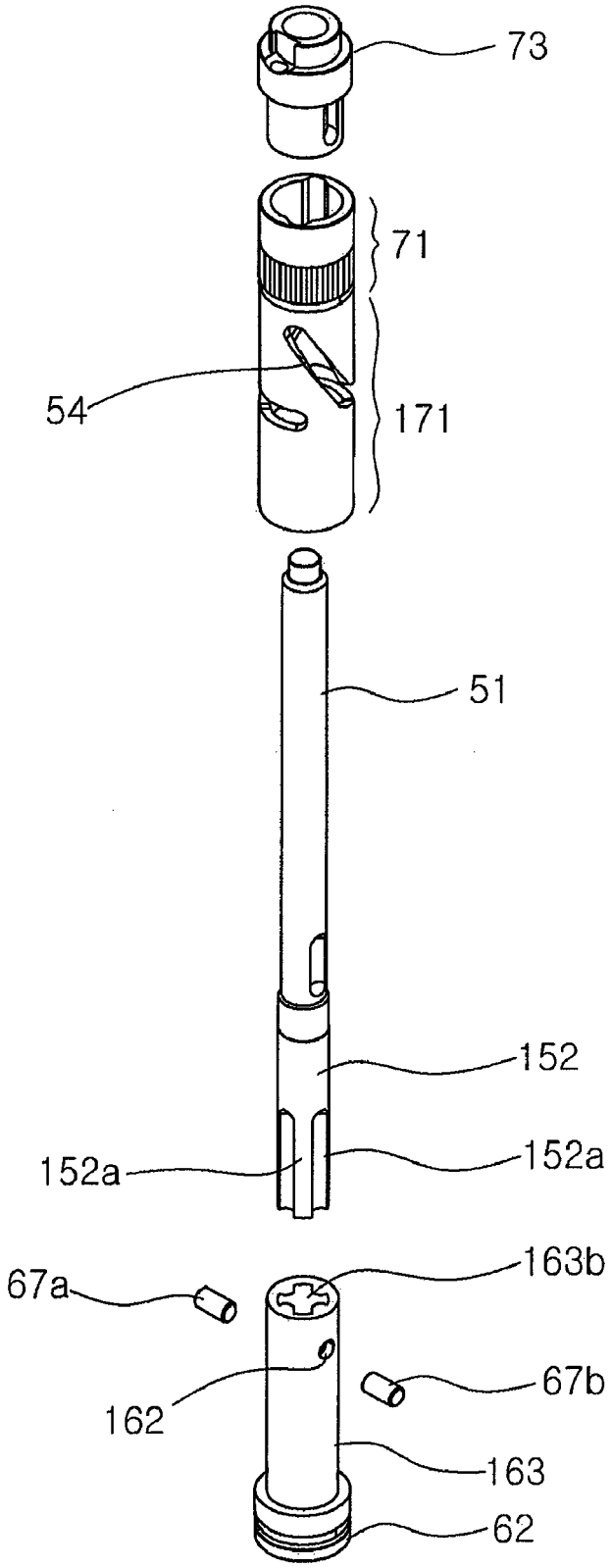

【Figure 13C】
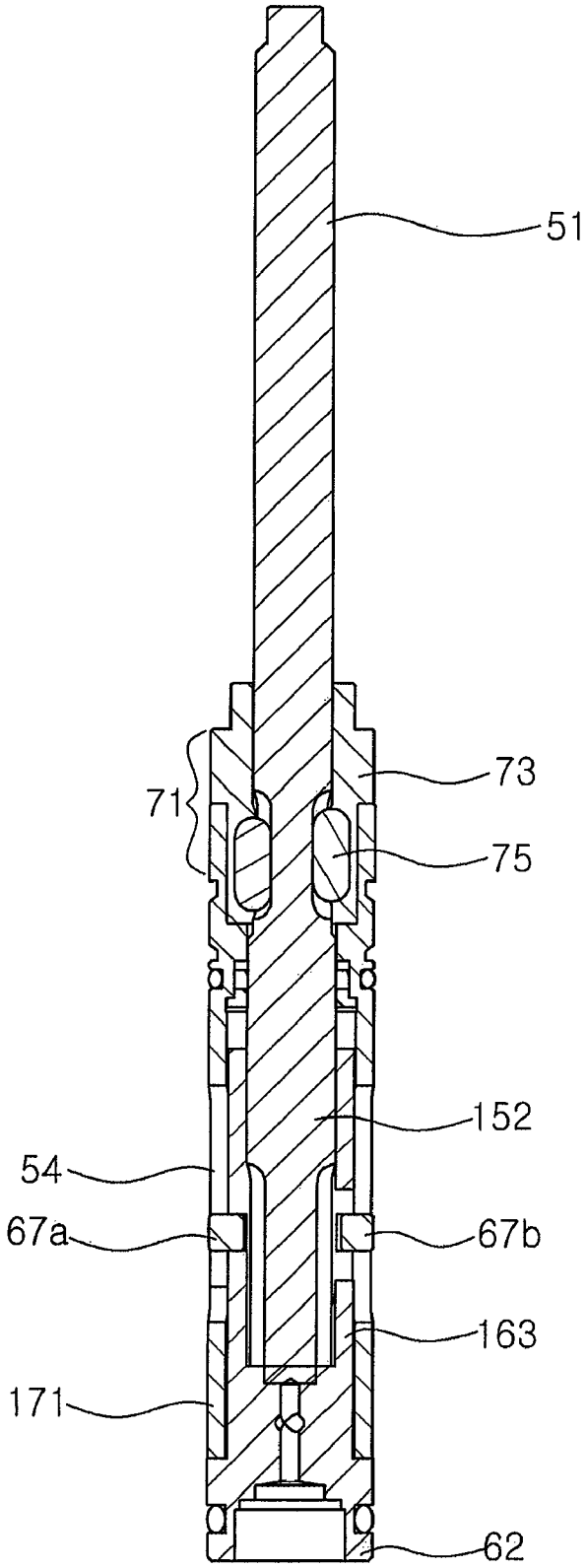

【Figure 14A】
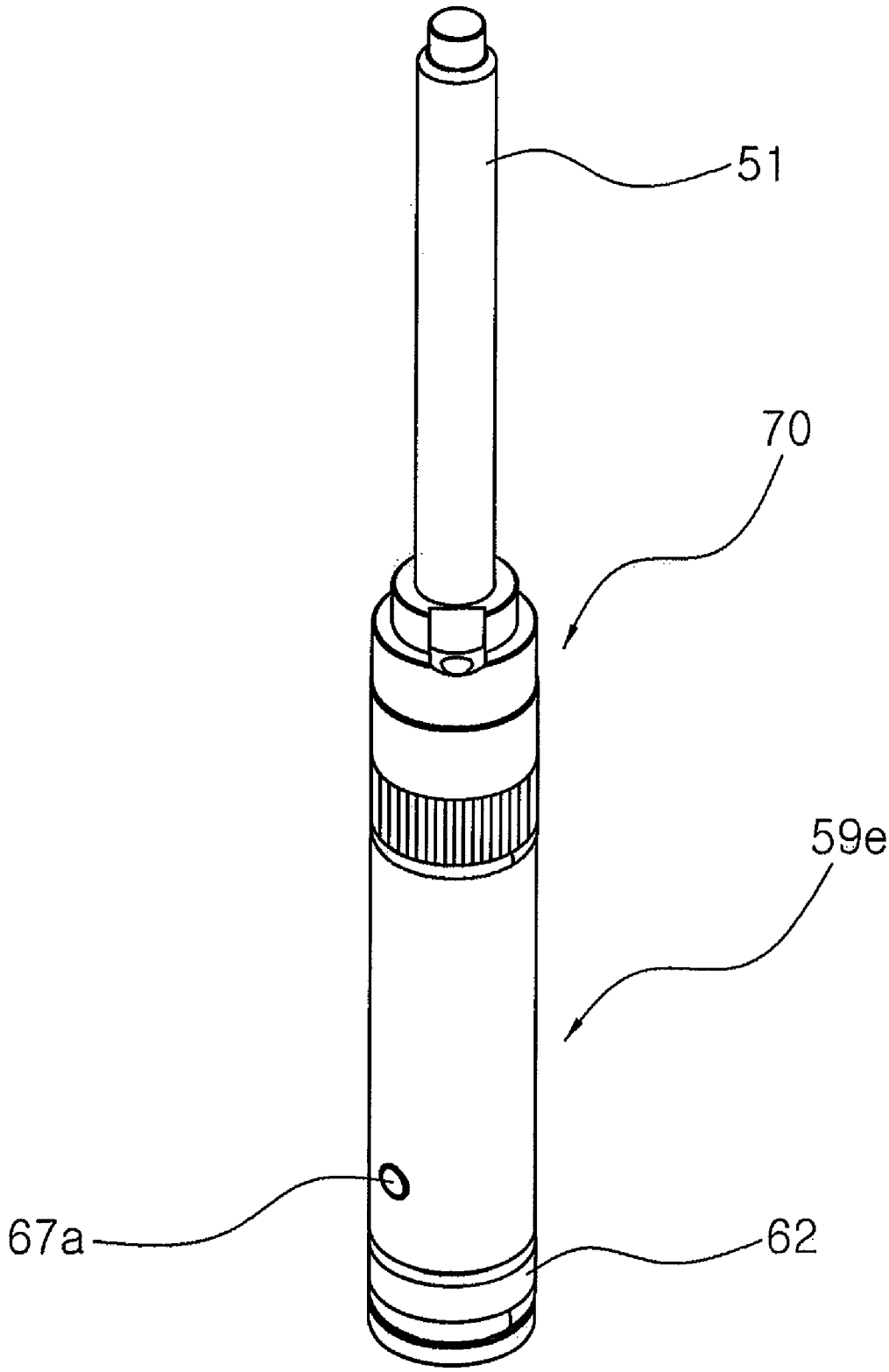

【Figure 14B】
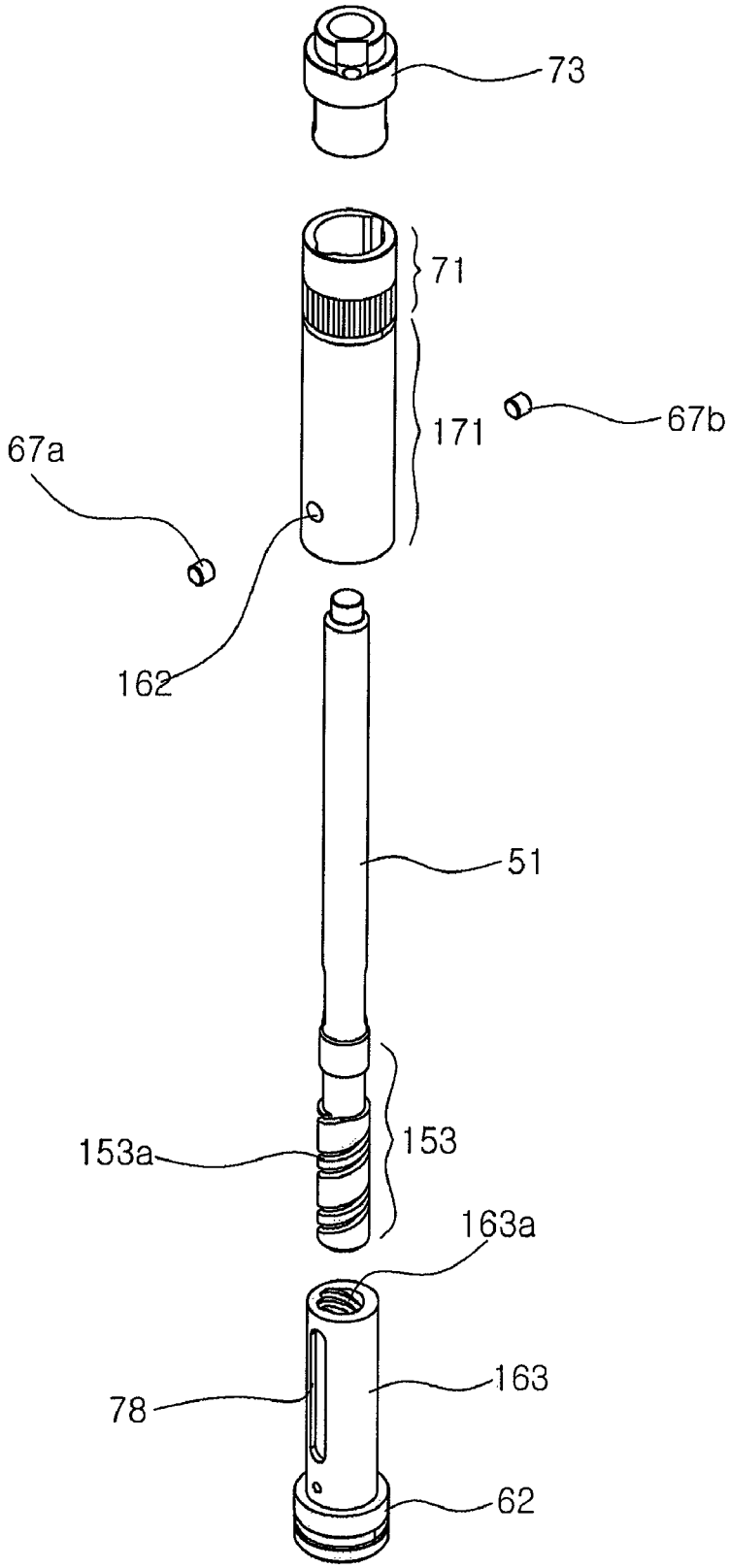

【Figure 14C】
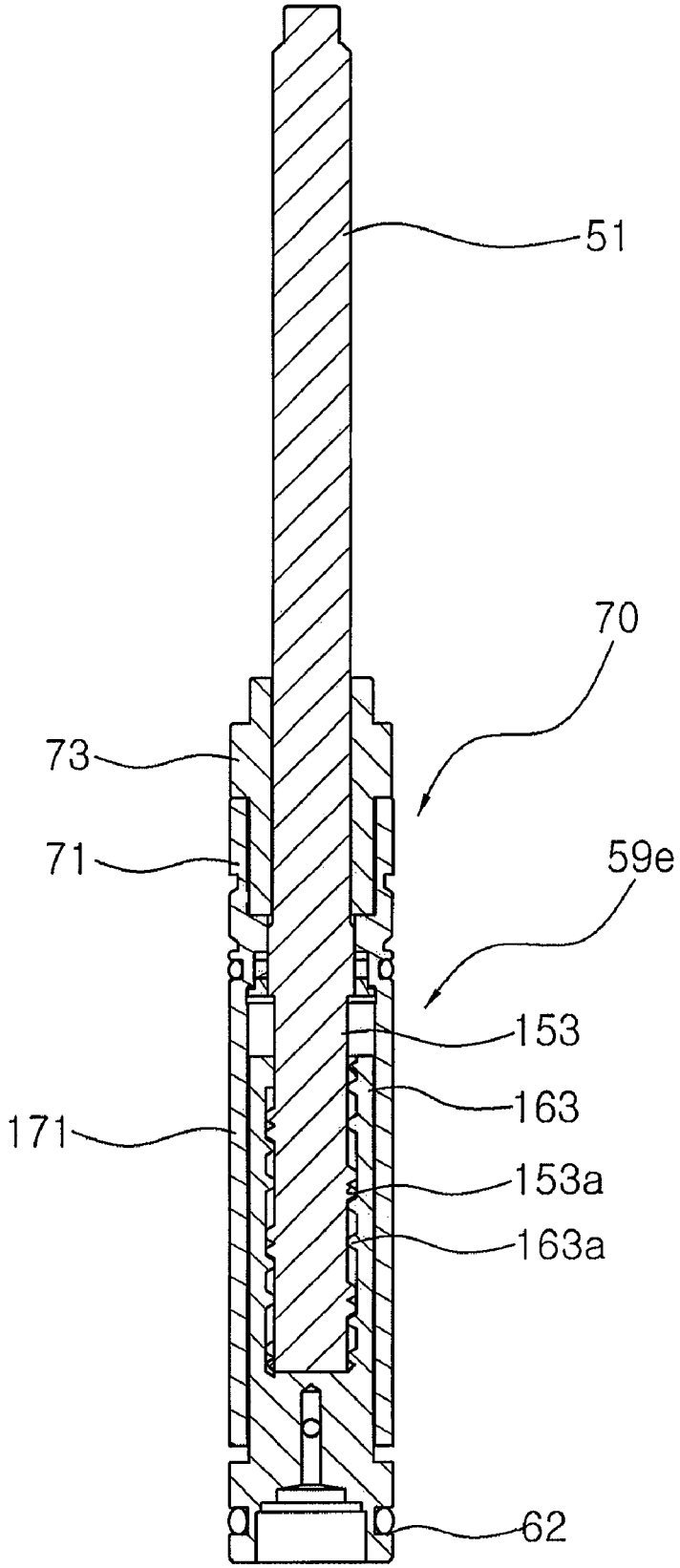

【Figure 14D】
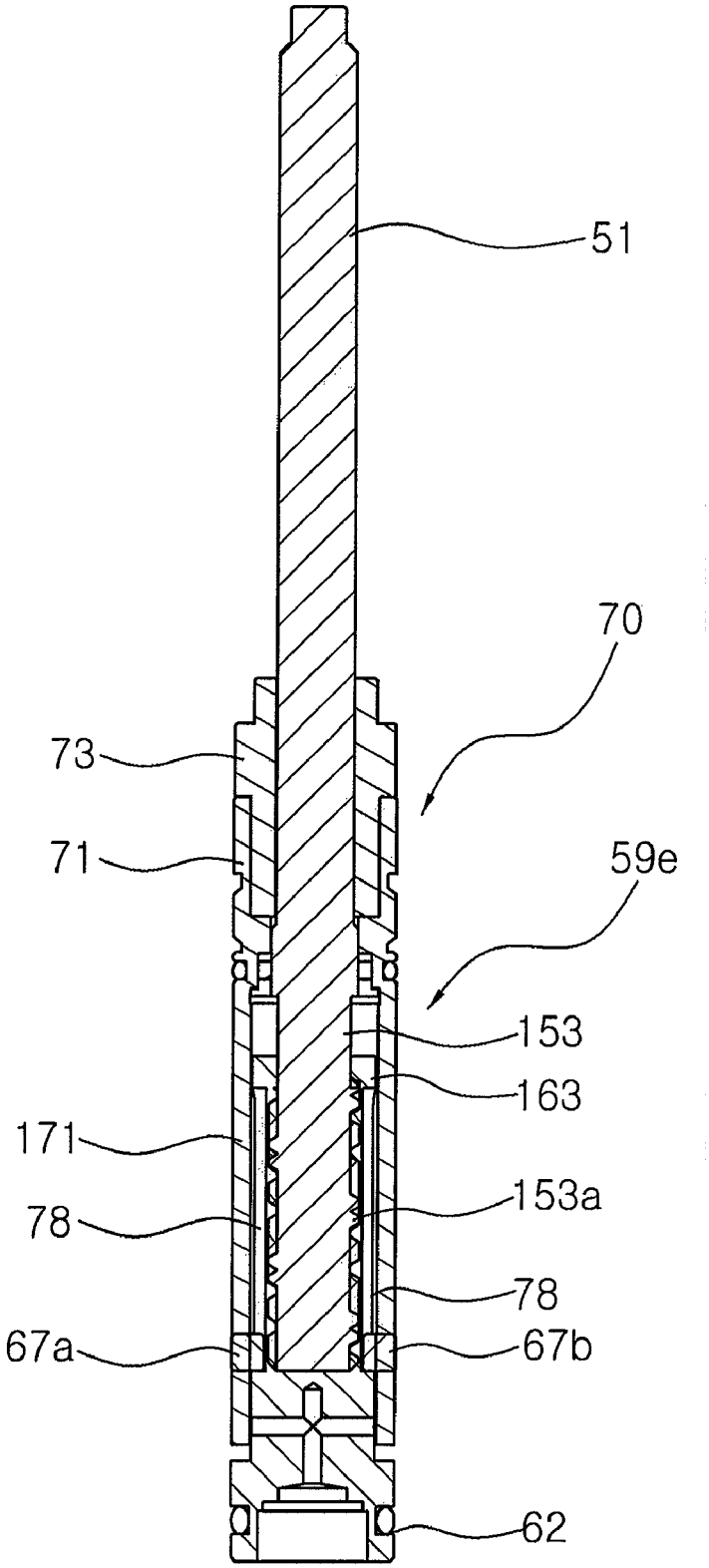

【Figure 15A】
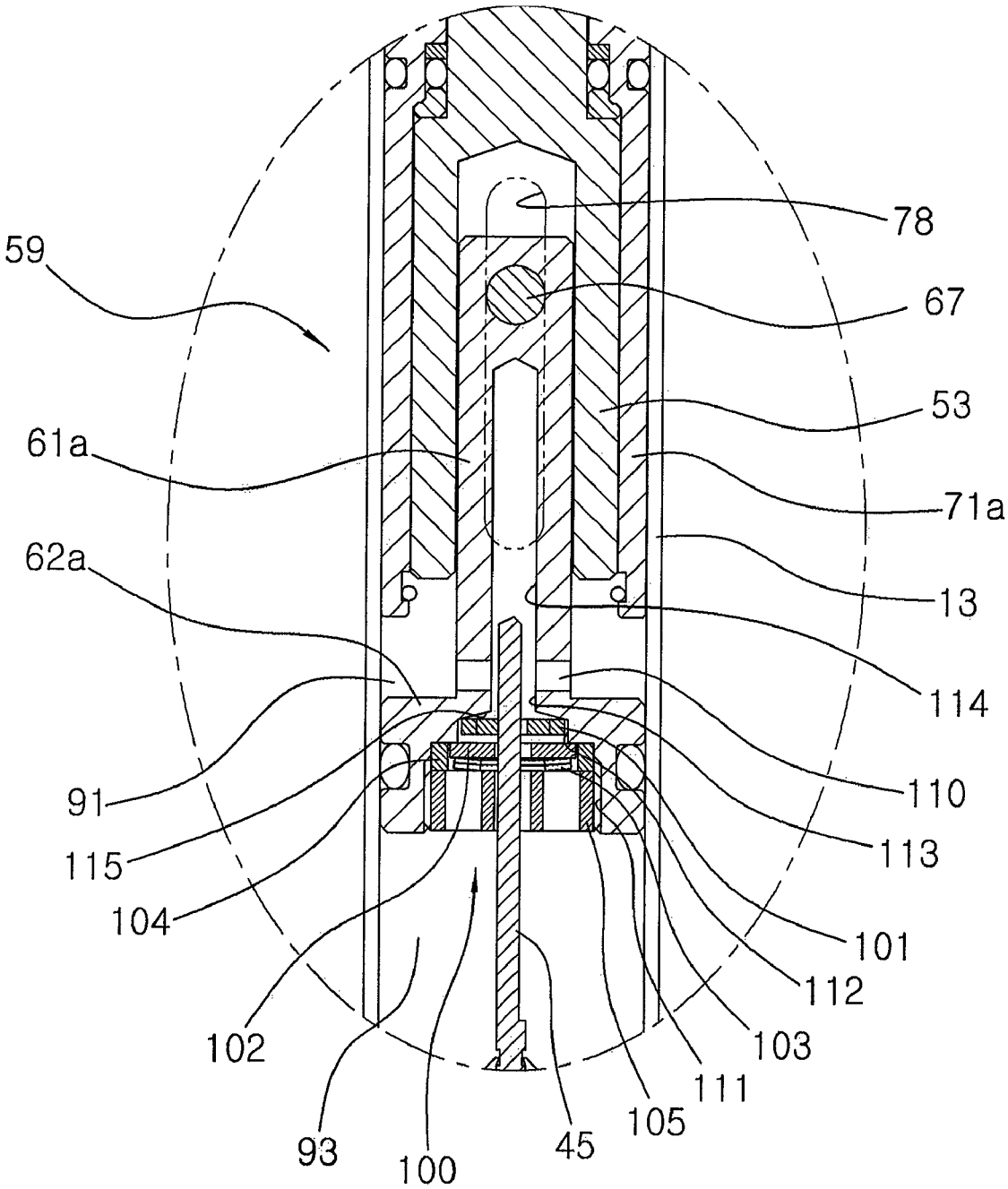

【Figure 15B】
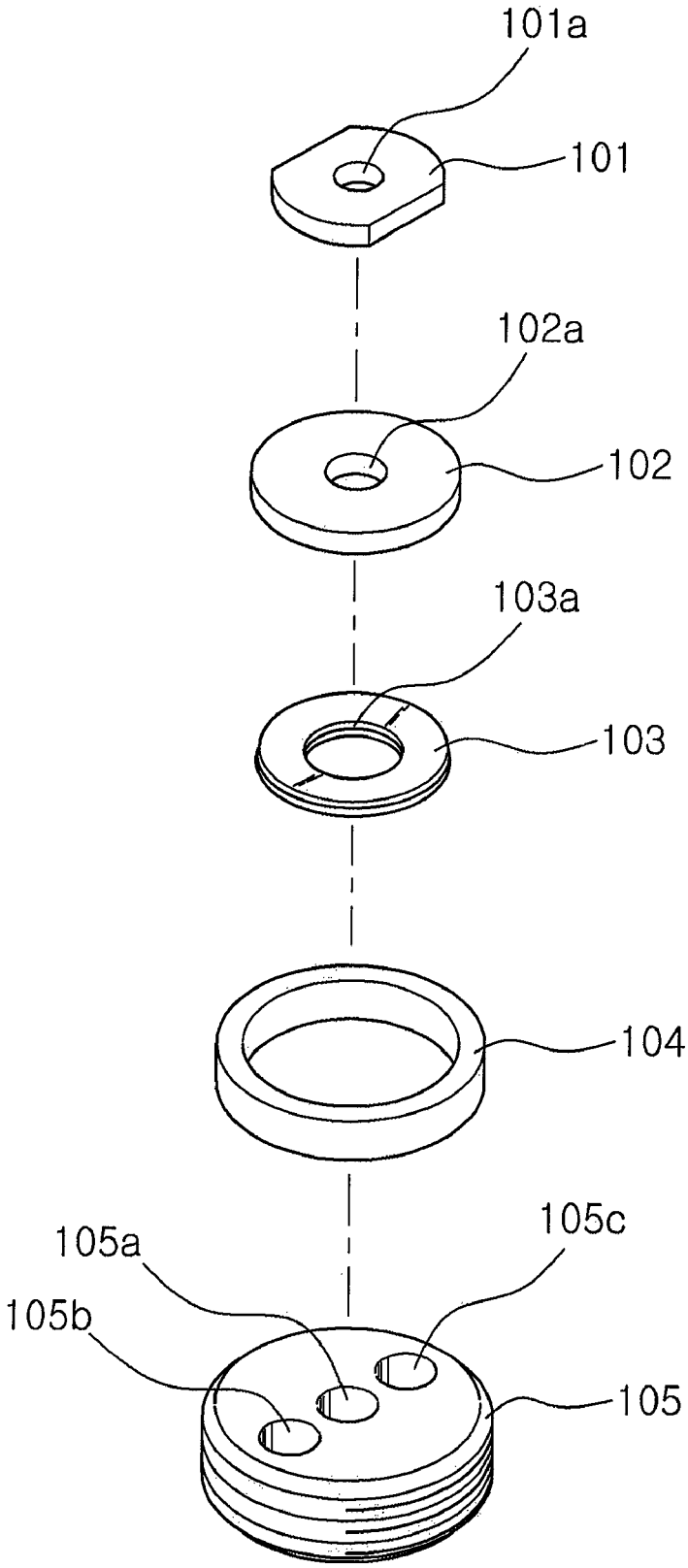

【Figure 15C】
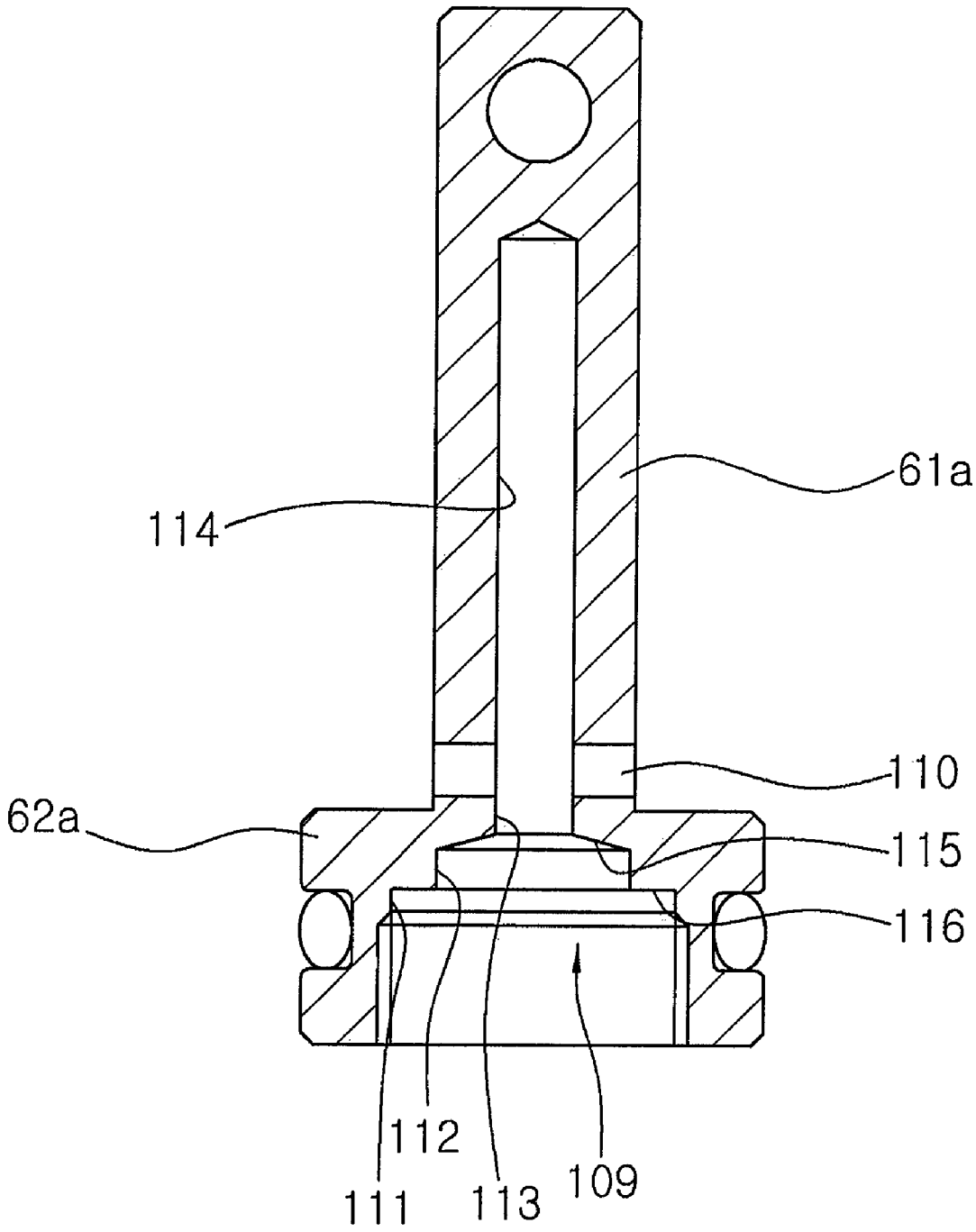

【Figure 16A】
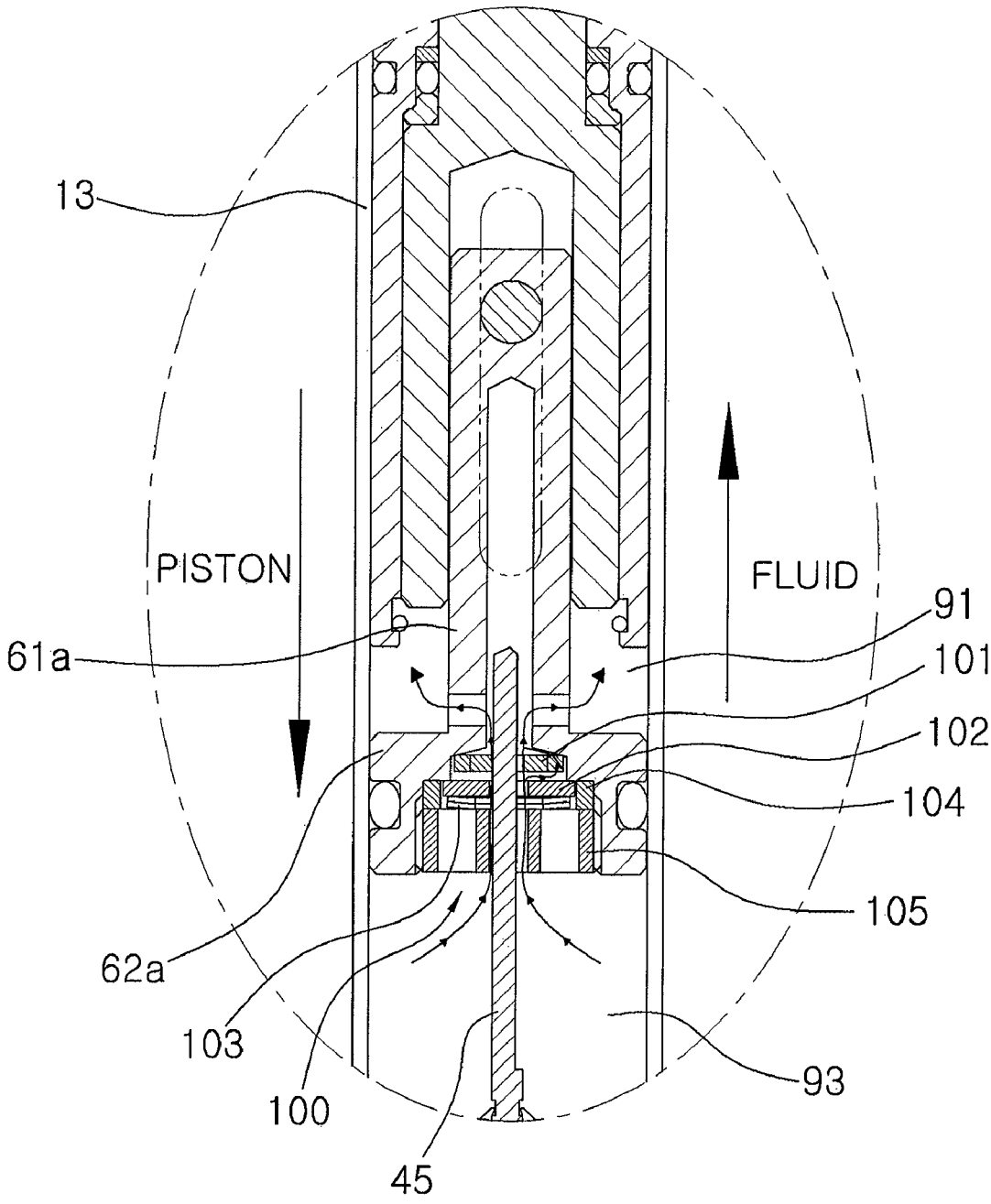

【Figure 16B】
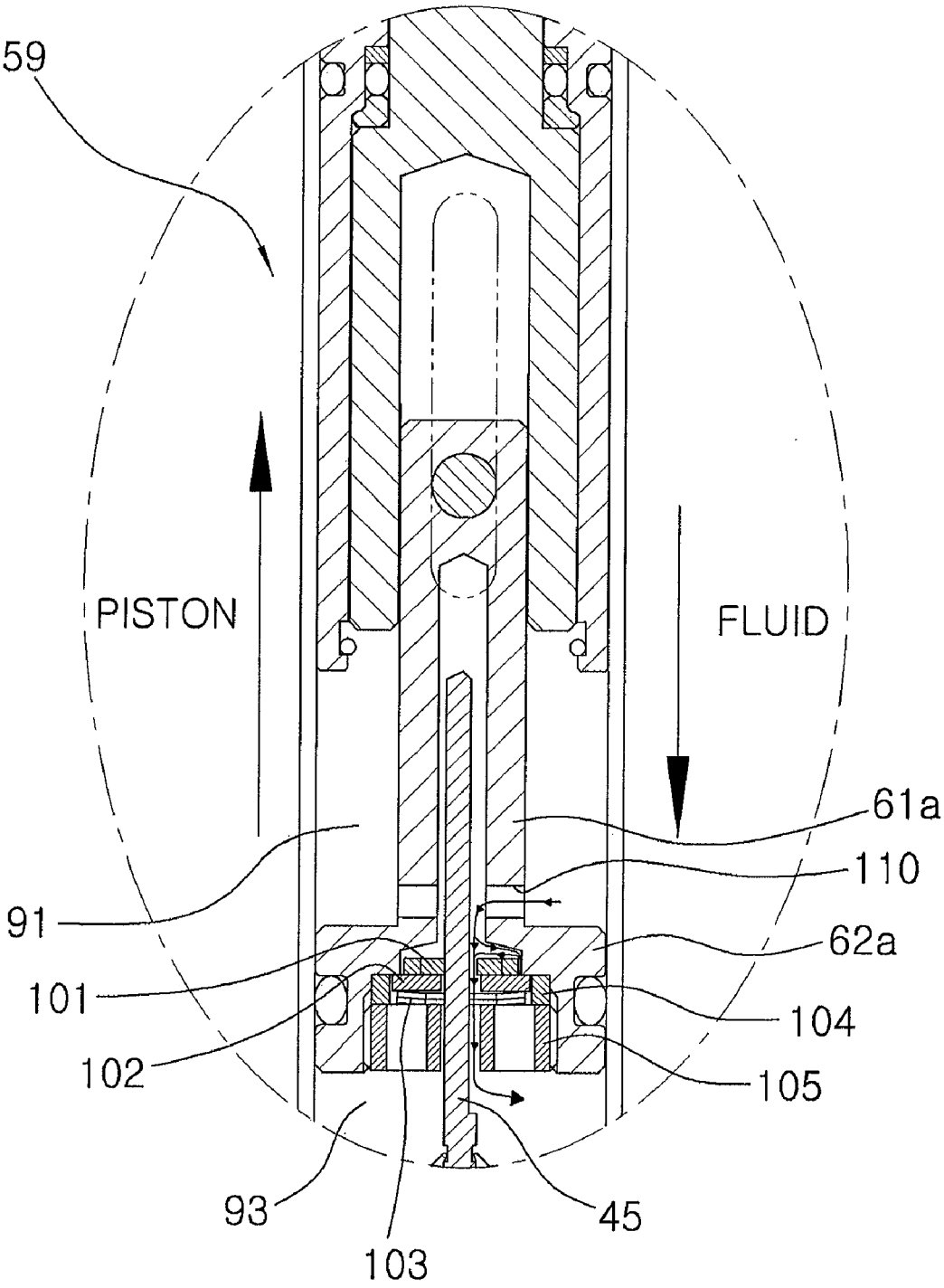

【Figure 16C】
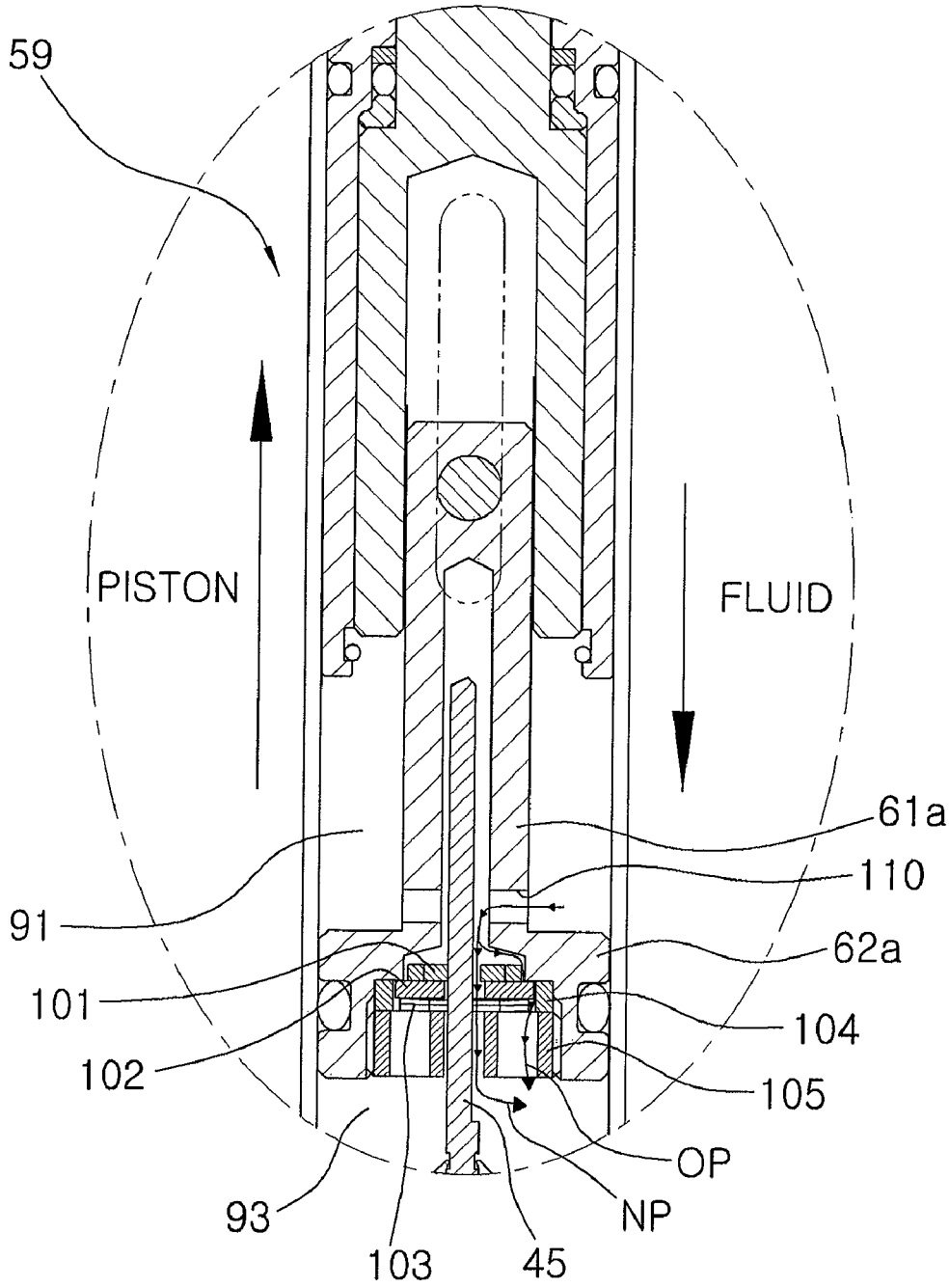

HINGE APPARATUS HAVING AUTOMATIC RETURN FUNCTION

TECHNICAL FIELD

The present invention relates to a hinge apparatus having an automatic return function for use in building materials, and more particularly to a hinge apparatus having an automatic return function for use in building materials in which a return spring is removed to thereby reduce overall length of the hinge apparatus, and to thereby offer a closing force of each door with only a torsion spring associated with a clutch unit and to thus improve efficiency of the torsion spring that contributes more effectively for an opening force and a closing force of each door, and in which length of the torsion spring is increased so as to compensate for the closing force of each door, and a tilt angle of a cam diagram is established so as to strengthen the closing force of each door, to thereby achieve a compact structure and reliably realize an automatic return function of each door.

BACKGROUND ART

A hinge apparatus makes two members spaced from each other or folded one member over another around a shaft, according to necessity. A representative example of the hinge apparatus is a left/right rotational hinge apparatus including a horizontal actuator which is used between a door and door frame, or an up/down rotational hinge apparatus including a vertical actuator which is used for a refrigerator, a mobile phone, or a notebook computer.

A conventional hinge apparatus having an automatic return function is disclosed in Korean Laid-open Patent Publication No. 2001-0027832.

In the case of the conventional hinge apparatus, a conversion head which ascends and descends according to rotation of a door is guided by a pair of guide pins, and the guide pins are fixed to four hinge knuckles. Also, a cylinder and the conversion head are incorporated in the four knuckles. Accordingly, when the movable hinge knuckles receive big load and rotate for a long time, durability of the hinge apparatus is lowered and the structure is complicated. As a result, an assembly productivity deteriorates.

Also, since a compression spring for performing an automatic return function of a door cannot provide a large restoring force at the time of automatic return of a door, it is difficult to apply the conventional hinge apparatus in a large-size door. Also, since a fixing unit for temporarily fixing the door is not installed in the conventional hinge apparatus, the door does not rotate at the state where the door has been opened at a predetermined angle. Accordingly, it is inconvenient for users to use the conventional hinge apparatus.

Meanwhile, Korean Utility Model Registration No. 0271646 discloses a hinge type door opening and closing apparatus in which a hydraulic type door closer and a spring type door closer are separately configured and the former and the latter are combined with each other.

Meanwhile, the conventional art has not proposed an optimized structure of a left/right rotational door hinge apparatus which is applied in a large-size door.

Also, Korean Utility Model Registration No. 435188 discloses a hinge apparatus using a single camshaft having a spiral cam diagram whose multi-stage automatic return speed establishment structure is stabilized. However, a restoring force required at the time of closing a door cannot be obtained from the hinge apparatus. As a result, the door closing force is reduced and accordingly an automatic return of the door is not smoothly accomplished.

Further, in the case of a hinge apparatus having an automatic return function for a large-size door employing a double camshaft which has been proposed by the same applicant as the present invention in Korean Laid-open Patent Publication No. 2006-18461 on Mar. 2, 2006 (corresponding to Korean Patent Application No. 2004-66832 on Aug. 24, 2004), an upper camshaft which is installed in order to compensate for reduction of a door closing force includes a pair of spiral ascending/descending holes, like a lower camshaft. The spiral ascending/descending holes may cause the rotational force to vary in the vertical direction when a piston rod and a valve are operated by the rotating camshaft, to accordingly cause a loss of 30% or so. As a result, the upper camshaft does not play a big role of improving the door closing force, and has a problem that the overall length of the upper camshaft is somewhat long.

DISCLOSURE

Technical Problem

To solve the above problems, it is an object of the present invention to provide a hinge apparatus having an automatic return function for use in building materials in which a return spring is removed to thereby reduce overall length of the hinge apparatus, and to thereby offer a closing force of each door with only a torsion spring associated with a clutch unit and to thus improve efficiency of the torsion spring that contributes more effectively for an opening force and a closing force of each door, and in which length of the torsion spring is increased so as to compensate for the closing force of each door, and a tilt angle of a cam diagram is established so as to strengthen the closing force of each door, to thereby achieve a compact structure and reliably realize an automatic return function of each door.

It is another object of the present invention to provide a hinge apparatus having an automatic return function for building materials in which various kinds of parts which are assembled in a lower chamber can be easily assembled since a return spring can be removed, and other relevant parts can be additionally removed, to thus achieve cost reduction.

It is still another object of the present invention to provide a hinge apparatus having an automatic return function for building materials, including a reinforcement plate integrated with the hinge apparatus, in order to prevent damage of all kinds of O-rings for air-tightness between a body and a piston from occurring due to overpressure generated in an upper chamber and prevent fixing screws for fixing the hinge apparatus from loosening, when the door is rapidly closed by an external force such as strong wind.

It is yet still another object of the present invention to provide a hinge apparatus having an automatic return function for building materials, in which since an upper body is easily assembled with and disassembled from the hinge apparatus, a user alone can installed the hinge apparatus at the time of installing the hinge apparatus and easily perform repair and maintenance of the hinge apparatus.

It is a further object of the present invention to provide a hinge apparatus having an automatic return function for building materials, which properly establish a cam diagram with respect to first and second ascending/descending guide holes of a camshaft to thus maintain an opening state of a door within a predetermined angular section.

It is a still further object of the present invention to provide a rotational/linear motion converter which converts a rotational motion of a shaft to an axial linear motion of as piston when a rotational force of a door is applied to the shaft according to rotation of the door.

It is a yet further object of the present invention to provide a piston which can be embodied into a simple structure that an overpressure prevention valve and a check valve are combined with each other.

Technical Solution

To accomplish the above object of the present invention, according to an aspect of the present invention, there is provided a hinge apparatus having an automatic return function, the automatic return hinge apparatus comprising:

an upper body on a circumferential surface of which a first hinge which is fixed to a door is integrally formed and whose upper end portion is blocked by an upper cap on the inner side surface of which a recess is formed;

a lower body on a circumferential surface of which a second hinge which is fixed to a door frame is integrally formed and whose lower end portion is blocked by a lower cap which is connected in a sealing manner;

a shaft whose lower end portion is rotatably installed in the upper portion of the lower body and whose upper end portion is inserted into the recess of the upper cap;

a piston whose outer circumference is slidably installed along the inner circumferential surface of the lower body and which divides the inner portion of the lower body into upper and lower chambers;

a rotational/linear motion converter which converts a rotational motion of the shaft into an axial linear motion of the piston when the rotational force of the door is applied to the shaft according to the rotation of the door;

a damping unit which provides a damping function selectively in the case that the piston descends/ascends according to opening/closing of the door; and a return unit which provides a restoring force to the rotational/linear motion converter in order to return the door to an initial position at the time when the door is closed.

According to another aspect of the present invention, there is provided a hinge apparatus having an automatic return function, the automatic return hinge apparatus comprising:

an upper body on a circumferential surface of which a first hinge which is fixed to a door is integrally formed and whose upper end portion is blocked by an upper cap;

a lower body on a circumferential surface of which a second hinge which is fixed to a door frame is integrally formed and whose lower end portion is blocked by a lower cap which is connected in a sealing manner;

a shaft whose upper end portion is coupled with the upper cap, and which is extended to the upper end portion of the lower body;

a piston whose outer circumference is slidably installed along the inner circumferential surface of the lower body and which divides the inner portion of the lower body into upper and lower chambers;

a rotational/linear motion converter which converts a rotational motion of the shaft into an axial linear motion of the piston when the rotational force of the door is applied to the shaft according to opening/closing of the door;

a damping unit which is installed in the piston, controls a descending/ascending speed of the piston according to the opening/closing of the door, and provides a damping function selectively in the case that the piston ascends;

a torsion spring which is built in the upper body so that one end of the torsion spring is fixed to the upper end portion of the shaft, thereby providing a restoring force rotating the shaft in the direction closing the door; and a clutch unit which is connected with the torsion spring, for stopping an increment of an elastic force of the torsion spring in the case that an opening angle exceeds a predetermined opening angle at the door opening and closing times, and for restoring the elastic force of the torsion spring in the case that the opening angle is within the range of the predetermined opening angle.

Preferably but not necessarily, according to a first embodiment of the present invention, the rotational/linear motion converter comprises:

a guide hole forming portion which has first and second vertical guide holes which are installed in the inner circumferential surface of the lower body and face each other in the vertical direction;

a camshaft which includes a cylindrical portion in which first and second elevating guide holes which are extended from the shaft and are made of a spiral shape of a movement symmetrical structure for each other along the outer circumferential surface thereof, are penetratively formed and which is pivoted by a relative external force which is applied to the upper body when the door is rotated; and a guide pin whose both end portions are combined with the first and second vertical guide holes via the first and second elevating guide holes, respectively, in which one end of the guide pin is connected to the upper portion of the piston rod.

Preferably but not necessarily, according to a second embodiment of the present invention, the rotational/linear motion converter comprises:

a first cylindrical portion in which first and second elevating guide holes which are installed in the inner circumferential surface of the lower body and are made of a spiral shape of a movement symmetrical structure for each other along the outer circumferential surface thereof, are penetratively formed;

a second cylindrical portion which are extended into the second cylindrical portion from the shaft and face each other in the vertical direction, in which first and second vertical guide holes are penetratively formed; and a guide pin whose both end portions are combined with the first and second vertical guide holes of the second cylindrical portion, via the first and second elevating guide holes of the first cylindrical portion, respectively, in which the central portion of the guide pin is connected to the upper portion of the piston rod which is connected with the piston, and in which the guide pin and the piston descend and ascend while rotating when the door is rotated.

Preferably but not necessarily, according to a third embodiment of the present invention, the rotational/linear motion converter comprises:

a cylindrical portion whose upper end portion is installed in the inner circumferential surface of the lower body and in the lower end portion of which first and second elevating guide holes which are made of a spiral shape of a movement symmetrical structure for each other are penetratively formed;

an extension shaft which is extended into the inside of the first cylindrical portion from the shaft and which has a vertical guide hole which is penetratively formed in the vertical direction;

a cylindrical piston rod which is extended from the piston, and on the upper end portion of which a pair of pin holes are formed and face each other and with the inner circumference of which the cylindrical portion is slidably combined; and a guide pin whose both end portions are combined with the pair of the pin holes which are formed in the cylindrical piston rod and face each other, the first and second elevating guide holes which are formed in the cylindrical portion, and the vertical guide hole which is penetratively formed in the vertical direction in the extension shaft, and in which the guide pin and the piston rod descend and ascend while rotating when the door is rotated.

Preferably but not necessarily, according to a fourth embodiment of the present invention, the rotational/linear motion converter comprises:

a cylindrical portion whose upper end portion is installed in the inner circumferential surface of the lower body and through which first and second elevating guide holes which are made of a spiral shape of a movement symmetrical structure for each other are penetratively formed;

an extension shaft which is extended into the inside of the first cylindrical portion from the shaft and which has a vertical guide hole which is penetratively formed in the vertical direction;

a cylindrical piston rod which is extended from the piston, and on the upper end portion of which a pair of pin holes are formed and face each other and into which the inner circumference of which the extension shaft is inserted and with the outer circumference of which the cylindrical portion is slidably combined; and a guide pin whose both end portions are combined with the pair of the pin holes which are formed in the cylindrical piston rod and face each other, the first and second elevating guide holes which are formed in the cylindrical portion, and the vertical guide hole which is penetratively formed in the vertical direction in the extension shaft, and in which the guide pin and the piston rod descend and ascend while rotating when the door is rotated.

Preferably but not necessarily, according to a fifth embodiment of the present invention, the rotational/linear motion converter comprises:

a cylindrical portion whose upper end portion is installed in the inner circumferential surface of the lower body and through which first and second elevating guide holes which are made of a spiral shape of a movement symmetrical structure for each other are penetratively formed;

an extension shaft which is extended into the inside of the cylindrical portion from the shaft and which has a number of vertical guide protrusions in the vertical direction;

a cylindrical piston rod which is extended from the piston, and on the upper end portion of which a pair of pin holes are formed and face each other and on the inner circumference of which grooves are formed in correspondence to the number of the vertical guide protrusions, and with the outer circumference of which the cylindrical portion is slidably combined; and first and second guide pins which are combined with the pair of the pin holes which are formed in the cylindrical piston rod and face each other and the first and second elevating guide holes which are formed in the cylindrical portion, respectively, in which the guide pins and the piston rod descend and ascend while rotating when the door is rotated.

Preferably but not necessarily, according to a sixth embodiment of the present invention, the rotational/linear motion converter comprises:

a cylindrical portion whose upper end portion is installed in the inner circumferential surface of the lower body and whose lower end portion is extended, in which a pair of pin holes are formed in opposition to the lower end portion thereof;

an extension shaft which is extended into the inside of the cylindrical portion from the shaft and on the outer circumference of which a number of lines of male thread portions formed of a spiral shape;

a cylindrical piston rod which is extended from the piston, and which has a pair of vertical guide holes which are face each other and penetratively formed in the vertical direction, and on the inner circumference of which a number of lines of female thread portions are formed in correspondence to the number of lines of male thread portions formed in the extension shaft, and with the outer circumference of which the cylindrical portion is slidably combined; and guide pins which are combined with the pair of the pin holes which are formed in the cylindrical portion and face each other and the pair of vertical guide holes which are formed in the cylindrical piston rod, respectively, in which the cylindrical piston rod descends and ascends while rotating when the door is rotated.

In this case, the first and second elevating guide holes comprise a first elevating section formed of a first cam diagram angle, a second elevating section formed of a second cam diagram angle which is relatively smaller than the first cam diagram angle, and a stop section whose cam diagram angle is zero, respectively.

Preferably but not necessarily, the damping unit which provides a damping function selectively in the case that the piston ascends, at the time of return of the door, according to an embodiment of the present invention, comprises:

a piston rod whose leading end is connected to the guide pin so as to be slidably combined with the inner portion of the cylindrical portion of the camshaft and whose lower end is connected to the center of the piston, and which includes a first oil path so that the oil can flow between the upper and lower chambers;

at least one check valve which is installed in the piston and opens the oil path of the oil moving from the lower chamber to the upper chamber at the opening time of the door, and closes the oil path of the oil moving from the upper chamber to the lower chamber at the door closing time; and an elevating speed control unit for controlling the elevating speed of the piston which ascends at the door closing time.

Further, the elevating speed control unit comprises a fluid pressure control rod whose leading end is inserted into the first oil path of the piston rod and which controls an amount of oil flowing from the upper chamber to the lower chamber through the first oil path.

Preferably but not necessarily, the damping unit according to another embodiment of the present invention, comprises:

a piston rod whose leading end is connected to the guide pin so as to be slidably combined with the inner portion of the cylindrical portion of the camshaft and whose lower end is integrally connected to the center of the piston, and which includes a first oil path so that the oil can flow between the upper and lower chambers;

a check valve which is formed at the central portion of the piston which communicates from the first oil path of the piston rod, and opens the oil path of the oil moving from the lower chamber to the upper chamber at the opening time of the door, and restricts the oil path of the oil moving from the upper chamber to the lower chamber at the door closing time, so that a small amount of oil may flow through the oil path; and a fluid pressure control rod whose leading end is inserted into the first oil path of the piston rod via the check valve and which controls the elevating speed of the piston which ascends at the door closing time.

Preferably but not necessarily, the check valve further comprises an overpressure prevention unit which releases overpressure in the case that the piston is needed to rise up at high speed by an external force and thus the upper chamber is increased not less than a predetermined set pressure.

Preferably but not necessarily, the damping unit according to still another embodiment of the present invention, comprises:

a piston rod whose leading end is connected to the guide pin so as to be slidably combined with the inner portion of the cylindrical portion of the camshaft and whose lower end is integrally connected to the center of the piston, and which includes a first oil path so that the oil can flow between the upper and lower chambers;

at least one check valve which is installed in at least one second oil path of the piston, and which opens the oil path of the oil moving from the lower chamber to the upper chamber at the opening time of the door, and closes the oil path of the oil moving from the upper chamber to the lower chamber at the door closing time; and an oil amount setting bushing which is inserted into the first oil path of the piston rod and which controls uniformly the elevating speed of the piston which ascends at the door closing time.

Preferably but not necessarily, the damping unit according to yet another embodiment of the present invention, comprises:

a piston rod whose leading end is connected to the guide pin so as to be slidably combined with the inner portion of the cylindrical portion of the camshaft and whose lower end is integrally connected to the center of the piston; and at least one check valve which is installed in at least one oil path of the piston, and which opens the oil path of the oil moving from the lower chamber to the upper chamber at the opening time of the door, and restricts the oil path of the oil moving from the upper chamber to the lower chamber at the door closing time, so that a uniform damping force may be provided for the hinge apparatus.

Preferably but not necessarily, the upper and lower bodies in the hinge apparatus further comprise first and second reinforcement plates which are extended perpendicularly with the first and second hinges so as to be contiguous to the door and the door frame in order to disperse the external forces applied to the first and second hinges, respectively.

Preferably but not necessarily, the return unit comprises:

a torsion spring which is built in the upper body so that one end of the torsion spring is fixed to the upper end portion of the shaft, thereby providing a restoring force to rotate the shaft in the direction returning the door; and a clutch unit which is connected with the other end of the torsion spring, for stopping an increment of an elastic restoring force due to inverse-twisting of the torsion spring in the case that an opening angle reaches a clutch stop start angle at the door opening time, and for restoring the elastic restoring force of the torsion spring in the case that the opening angle reaches the clutch stop start angle at the door closing time.

In this case, the clutch unit comprises:

an outer clutch whose outer circumference is fixed to the inner circumference of the lower body by a compulsive press-in structure;

an inner clutch whose lower end portion is rotatably inserted into the upper end portion of the outer clutch, in the inner space of which the shaft is supported at a rotatably contact state, and to the upper end portion of which the lower end portion of the torsion spring is fixed; and a pair of roller balls which are arranged between the outer and inner clutches, and play a role of combining the inner clutch with the shaft or separating the former from the latter according to an opening angle of the door.

In this case, the hinge apparatus comprises a clutch stop unit having a preset screw for stopping function of the clutch unit by penetrating the upper body to integrate the inner clutch and the shaft, to thereby enable the clutch unit to temporarily stop according to necessity.

In this case, cam diagrams formed the first and second elevating guide holes comprises a first elevating section between 0-90° of the door opening angle, a second elevating section between 90-135° of the door opening angle, and a stop section between 135-180° of the door opening angle, and the clutch stop start angle of the clutch unit is 70°.

Moreover, the upper body may be detachably combined with the main body of the hinge apparatus.

Advantageous Effects

As described above, a hinge apparatus having an automatic return function for use in doors of buildings according to the present invention removes a return spring to thereby reduce overall length of the hinge apparatus, and to thereby offer a closing force of each door with only a torsion spring associated with a clutch unit and to thus improve efficiency of the torsion spring that contributes more effectively for an opening force and a closing force of each door, and increases length of the torsion spring so as to compensate for the closing force of each door, and establishes a tilt angle of a cam diagram so as to strengthen the closing force of each door, to thereby achieve a compact structure and reliably realize an automatic return function of each door.

In addition, the hinge apparatus having an automatic return function for use in doors of buildings according to the present invention can be formed into a compact and slim type hinge apparatus so as not to be burdensome in view of an interior appearance although the hinge apparatus according to the present invention is used as an exterior type hinge apparatus for various kinds of inner doors, to thereby enable the hinge apparatus according to the present invention to be applied to various kinds of uses.

In addition, the hinge apparatus according to the present invention can easily assemble various kinds of parts which are assembled in a lower chamber since a return spring can be removed, and achieve cost reduction since other relevant parts can be additionally removed. In addition, since an upper body is easily assembled with and disassembled from the hinge apparatus, a user alone can installed the hinge apparatus at the time of installing the hinge apparatus and easily perform repair and maintenance of the hinge apparatus.

In the hinge apparatus according to the present invention, a reinforcement plate is integrated with the hinge apparatus, in order to prevent damage of all kinds of O-rings for air-tightness between a body and a piston from occurring due to overpressure generated in an upper chamber and prevent fixing screws for fixing the hinge apparatus from loosening, when the door is rapidly closed by an external force such as strong wind.

DESCRIPTION OF DRAWINGS

The above and/or other objects and/or advantages of the present invention will become more apparent by describing the preferred embodiments thereof in detail with reference to the accompanying drawings in which:

FIGS. 1A to 1C are a perspective view, a plan view, and a bottom view showing a hinge apparatus having an automatic return function for a door of a building according to a basic embodiment of the present invention, respectively;

FIG. 2A is a cross-sectional view cut along a line 2-2' of FIG. 1B;

FIG. 2B is a plan view showing an installation state of the hinge apparatus;

FIGS. 3A and 3B are an assembled perspective view and a disassembled perspective view showing a rotational/linear motion converter for converting the rotational motion of a shaft to the axial linear motion of a piston according to a first embodiment of the present invention, respectively;

FIGS. 3C and 3D are cross-sectional views cut along a line A-A' of FIG. 3B and a line B-B' of FIG. 3B, respectively;

FIG. 4 is a diagram which is unfolded on a plane to explain a cam diagram of an elevating guide hole of a camshaft illustrated in FIG. 3A;

FIGS. 5A and 5B are a perspective view showing an outer clutch of the automatic return hinge apparatus shown in FIG. 2A, and a cross-sectional view cut along a line C-C' of FIG. 5A, respectively;

FIG. 5C is a front view showing an inner clutch of the automatic return hinge apparatus illustrated in FIG. 2A;

FIGS. 6A to 6D are horizontal cross-sectional views sequentially showing an operation state of a clutch unit according to opening of a door, respectively;

FIG. 7 is an exploded cross-sectional view for explaining a structure of easily disassembling the hinge apparatus according to the present invention into an upper body combined with an upper cap and the remaining parts and assembling the former with the latter;

FIGS. 8A to 8E are a schematic perspective view illustrating an installation process of a hinge apparatus having an automatic return function for a door according to a preferred embodiment of the present invention, respectively;

FIGS. 9A and 9B are a cross-sectional view illustrating a hinge apparatus having an automatic return function for a door according to a modified embodiment of the present invention, respectively, in which a fluid control rod has been removed from the hinge apparatus according to a basic embodiment of the present invention;

FIGS. 10A to 10C are an assembled perspective view, a disassembled perspective view and a lengthy cross-sectional view showing a rotational/linear motion converter for converting the rotational motion of a shaft to the axial linear motion of a piston according to a second embodiment of the present, respectively;

FIGS. 11A to 11D are an assembled perspective view, a disassembled perspective view and lengthy cross-sectional views showing a rotational/linear motion converter for converting the rotational motion of a shaft to the axial linear motion of a piston according to a third embodiment of the present, respectively;

FIGS. 12A to 12D are an assembled perspective view, a disassembled perspective view and lengthy cross-sectional views showing a rotational/linear motion converter for converting the rotational motion of a shaft to the axial linear motion of a piston according to a fourth embodiment of the present, respectively;

FIGS. 13A to 13D are an assembled perspective view, a disassembled perspective view and lengthy cross-sectional views showing a rotational/linear motion converter for converting the rotational motion of a shaft to the axial linear motion of a piston according to a fifth embodiment of the present, respectively;

FIGS. 14A to 14D are an assembled perspective view, a disassembled perspective view and lengthy cross-sectional views showing a rotational/linear motion converter for converting the rotational motion of a shaft to the axial linear motion of a piston according to a sixth embodiment of the present, respectively;

FIG. 15A is a cross-sectional view showing a piston including an overpressure prevention valve and a check valve according to the present invention;

FIG. 15B is an exploded perspective view showing the compositional elements of the overpressure prevention valve and the check valve of FIG. 15A;

FIG. 15C is an exploded perspective view showing the piston where the compositional elements of the overpressure prevention valve and the check valve have been removed from the piston of FIG. 15A; and FIGS. 16A and 16B are diagrams for explaining operations of the check valve at the time of opening and closing a door, respectively, and FIG. 16C is a diagram for explaining an operation of the overpressure prevention valve.

BEST MODE

Hereinbelow, a hinge apparatus having an automatic return function according to preferred embodiments of the present invention will be described with reference to the accompanying drawings. Like reference numerals denote like elements through the following embodiments.

1. The Whole Structure of Hinge Apparatus

First, a hinge apparatus having an automatic return function illustrated in FIGS. 1A to 4 is completed by using a rotational/linear motion converter for converting the rotational motion of a shaft to the axial linear motion of a piston according to a first embodiment of the present illustrated in FIG. 3A.

The hinge apparatus having an automatic return function according to the present invention includes an upper body 11 and a lower body 13 which are disposed along the lengthy direction in the substantially same axial direction. The upper body 11 is integrally formed and extended in one side of a first hinge 21 that is fixed to a door 1, and the lower body 13 is integrally formed and extended in the other side of a second hinge 23 that is fixed in a door frame 3. A number of through-holes 22 into which clamping screws 22*a* are inserted are formed in the first and second hinges 21 and 23, respectively. The hinge apparatus according to the above-described embodiment of the present invention illustrates a hinge apparatus of the type where the door 1 is arranged on the right side of the hinge apparatus, as shown in FIG. 2B. However, in contrast, it is of course possible to modify the hinge apparatus into the type where the door is arranged on the left side of the hinge apparatus.

In the upper body 11 and lower body 13 are integrally formed first and second reinforcement plates 21*a* and 23*a* having an inscription surface in perpendicular with the first and second hinges 21 and 23 and bearing a big force that is applied to the inscription surface with a structure of narrowing the widths of the first and second reinforcement plates 21*a* and 23*a* as it goes to the leading ends of the first and second reinforcement plates 21*a* and 23*a*, respectively. Thus, the hinge apparatus is installed so that one side end of the door 1 is combined between the first hinge 21 and the first reinforcement plate 21*a* and one side end of the door frame 3 is combined between the second hinge 23 and the second reinforcement plate 23*a*.

When the door is rapidly closed by an external force such as strong wind in the conventional case, all kinds of O-rings for air-tightness between a body and a piston may occur due to overpressure generated in an upper chamber or fixing screws for fixing the hinge apparatus may loosen from the hinge apparatus. As a result, the hinge apparatus may be out of order. Therefore, to prevent these problems, the conventional cases solved these problems by employing the overpressure prevention valve. However, many parts are added and thus they should be assembled with a spring. As a result, there is a problem that an assembly degree is worse.

However, in the case that a big external force is applied to the door 1 as shown in FIG. 2B in the present invention, the external force is scattered and applied to the clamp screw 22*a* and the reinforcement plate 21*a*. Accordingly, the above-described problem can be solved.

Also, an upper cap 31 and a lower cap 33 are combined in the upper side of the upper body 11 and the lower side of the lower body 13 in a press-in combinational structure in order to close the inside of the hinge apparatus. Accordingly, the upper body 11 and the upper cap 31 accomplish an assembly. In this case, in the inner side surface of the upper cap 31 is formed a groove 32 corresponding to the upper end portion of the camshaft 50 as shown in FIGS. 3B and 3C. If the camshaft 50 is inserted into and combined with the groove 32 of the upper cap 31, the rotational force of the door 1 is transferred to the camshaft 50 via the first hinge 21, the upper body 11 and the upper cap 31, when the door 1 rotates. Accordingly, the camshaft 50 also rotates.

That is, the upper side of the shaft 51 is fixed by the groove 32 of the upper cap 31 so that the camshaft 50 can receive the rotational force of the door 1, at the time of opening and closing the door 1, and can rotate in the same direction as the rotational direction of the door 1. Both the upper and lower surfaces of the groove 32 run parallel and both side surfaces thereof are of a rounded shape.

Moreover, a cylindrical portion 53 which is extended and formed on the lower end of the shaft 51 has an inner space into which the upper end portion of the piston rod 61 of an actuator 60 to be described later is slidably inserted, and first and second elevating guide holes 54*a* and 54*b* which are made of a spiral shape of a motion symmetric structure for each other along the outer circumferential surface thereof. The first and second elevating guide holes 54*a* and 54*b* have a cam diagram angle as shown in FIG. 4. The cam diagram angle will be described below in detail together with the operation of the hinge apparatus.

On the other hand, in the case of an actuator 60 illustrated in FIG. 2A, the upper end portion of a piston rod 61 is penetrated by a guide pin 67, and both the ends of the guide pin 67 are penetrated so as to be guided by the first and second elevating guide holes 54*a* and 54*b* of the cylindrical portion 53.

Moreover, the piston rod 61 is screw-combined with the piston 62 whose lower-central side has a diameter inscribing the outer circumference of the lower body 13 and simultaneously an oil chamber in the lower body 13 is divided into the upper/lower chambers 91 and 93, to thus form the actuator 60 which moves up and down according to rotation of the door.

In this case, a first oil path 68*a* is formed from the lower end of the piston rod 61 to the upper end thereof. The first oil path 68*a* is linked with a throughhole 68*b* that is formed to communicate with the outer circumference of the piston rod 61.

Also, the piston 62 includes a throughhole which is penetrated in the vertical direction at the central portion of the piston 62 and at least one second oil path 68*c* that is penetratively formed at the outer side of the central portion of the piston 62. The lower end portion of the piston rod 61 is screw-combined on the central throughhole of the piston 62, and thus the upper/lower chambers 91 and 93 communicate with each other via the first oil path 68*a* formed in the piston rod 61. An opening and closing ball 63*a* is inserted into the second oil path 68*c*, to accordingly form a check valve 63 which determines opening and closing of the oil path according to operation of the opening and closing ball 63*a*. An oil seal 64 of a disk form is inserted for sealing on a screw connection portion between the piston rod 61 and the piston 62.

The check valve 63 does not operate, when the door 1 is opened, that is, the actuator 60 (which is formed of the piston rod 61 and the piston 62) descends, and thus oil easily moves to the upper chamber 91 from the lower chamber 93 via the second oil path 68*c* and the check valve 63. In contrast, when the door 1 is closed, that is, the actuator 60 ascends, the opening and closing ball 63*a* of the check valve 63 intercepts the second oil path 68*c*. Accordingly, the oil in the upper chamber 91 does not pass through the second oil path 68*c* but moves little by little to the lower chamber 93 from the upper chamber 91 via the first oil path 68*a* formed in the piston rod 61.

Meanwhile, the conventional hinge apparatus includes upper/lower bodies and a central body, in which a sealing cap is separately in the lower end of the center body, and a ball bearing is installed between the sealing cap and the lower cap, to thus achieve a smooth rotation between the central body and the lower body.

However, in the present invention, a housing is implemented by two bodies including the upper body 11 and the lower body 13, and a pair of ring-shaped bearings 12*a* and 12*b* made of a plastic material are inserted between these bodies 11 and 13, for smooth rotation. A sealing O-ring 14 is inserted into the screw connection portion between the lower body 13 and the lower cap 33.

Therefore, in this invention, the return spring that is inserted in the lower chamber 93 is removed and simultaneously both the sealing cap and the ball bearing can be removed, to thus achieve simplification of parts and improvement of an assembly degree.

Moreover, a fluid pressure control rod 45 whose leading end is inserted is installed in the first oil path 68*a* of the piston rod 61, in order to control the inflow of the oil. The lower end of the fluid pressure control rod 45 is fixed by a support 43 installed in the lower cap 33. The specific structure of the fluid pressure control rod 45 will be described later.

In addition, an adjusting bolt 41 perpendicularly combined in the center of the lower cap 33 is combined in the inner side of the support 43. Accordingly, the level of the fluid pressure control rod 45 can be set according to the forward rotation/reverse rotation of the adjusting bolt 41, to thus freely set the oil amount which passes through the first oil path 68*a*. Consequently, the automatic return speed of the door is determined.

2. Clutch Unit

In the meantime, as shown in FIGS. 2A, 5A to 5C, and 6A to 6D, a torsion spring 76 is arranged at the state of surrounding the shaft 51, in the inner portion of the upper body 11 for improvement of the closing force at the closing time of a door, and a clutch unit 70 is arranged so as to be connected with the torsion spring 76 in the lower end of the torsion spring 76 in order to control the twisting elastic force generated in the torsion spring 76 according to the rotation of the door. In this case, a cross section of the torsion spring 76 is round or preferably rectangular to obtain larger twisting restoring force of the torsion spring.

The clutch unit 70 includes: an outer clutch 71 which is fixed to the inner circumference of the lower body 13 at the outer circumference of the outer clutch 71, by a compulsive press-in structure; an inner clutch 73 whose lower end is rotatably inserted into the upper end of the outer clutch 71, and in the internal space of which the shaft 51 in the camshaft 50 is supported at a rotatable contact state; and a pair of roller balls 75 which are disposed between the outer and inner clutches 71 and 73 and play the role of combining the inner clutch 73 with the shaft 51 or separating the former from the latter according to the opening angle of the shaft 51, that is, the door.

As shown in FIG. 7, a number of unevenness portions 71*d* are formed in the top and bottom direction, in the outer circumference of the outer clutch 71, and are fixed to the inner circumference of the lower body 13 by a compulsive press-in operation. Moreover, the lower end portion of the outer clutch 71 is fixed by a structure of a step 71*b*, and the upper end portion of the outer clutch 71 is prevented from moving up and down by a stop ring 71*c*.

Moreover, the upper end portion 76*a* of the torsion spring 76 is axially bent and inserted into a throughhole formed in a spring guide bush 25 which is positioned at the lower end of the upper cap 31, and is combined with the shaft 51. The lower end portion of the torsion spring 76 is fixed by a fixing hole 73*b* which is formed in the upper end portion of the inner clutch 73, respectively. The spring guide bush 25 plays a role of preventing the torsion spring 76 from being deflected and positioning the torsion spring 76.

Therefore, if the camshaft 50 rotates at the door opening time, the inner clutch 73 operates and rotates, for example, within the range of 0-70°, and accordingly the torsion spring 76 gets twisted to thus cause deformation. Thereafter, in the case that the clutch unit 70 reaches 70° which is a clutch stop start angle of the clutch unit 70, a clutching operation is performed and thus the twist deformation of the torsion spring 76 is stopped to then make only the camshaft 50 rotate.

The clutch unit 70 shown in the FIGS. 6A through 6D shows an example of the case where the clutch stop start angle is 90°, which is applied to a slim type automatic return hinge apparatus which is suitable for a door which does not use a return spring but uses only a torsion spring.

Therefore, in the case of an automatic return hinge apparatus for a heavy door of a large size, which requires for both the return spring and the torsion spring, it is possible to establish the clutch stop start angle of the clutch unit 70 into a desired angle. For example, the clutch stop start angle of the clutch unit 70 can be established to 30°.

In the case of setting the clutch stop start angle as 30° as described above, a second insertion hole 74*c* formed in the upper end of the outer clutch 71 based on the time when the camshaft 50 is at the initial state, is arranged in a location which is obtained by making a first insertion hole 74*a* formed in the outer circumference of the shaft 51 and a throughhole 74*b* formed in the inner clutch 73 rotate by 30°.

In the meantime, the pair of the roller balls 75 are of a sphere shape or a pin-shaped configuration whose cross-section is circular. The pair of the roller balls 75 are inserted so as to move between a pair of first insertion holes 74 which are correspondingly formed on the outer circumference of the shaft 51 and whose cross-section is hemispherical, a throughhole 74*b* formed in the inner clutch 73, and a second insertion hole 74*c* formed in the upper end of the outer clutch 71 as shown in FIG. 5A and whose cross-section is hemispherical. The process of being clutched through the pair of the roller balls 75 will be described in detail with the operation of the hinge apparatus which will be described later.

In the meantime, the outer clutch 71 is cylindrically extended to the lower portion thereof, and includes an integrally formed guide hole forming portion 71*a* which includes a pair of vertical guide holes 78 formed at both sides of the guide hole forming portion, into which both ends of the guide pin 67 are vertically slidably mounted, as shown in FIG. 5A. In this case, the guide pin 67 passes through the piston rod 61, the first and second elevating guide holes 54*a* and 54*b*, and the vertical guide holes 78, simultaneously, and if the first hinge 21 rotates together with opening of the door, and thus the camshaft 50 rotates, the guide pin 67 moves downwards along the pair of vertical guide holes 78. Simultaneously, the actuator 60 rotates at the state of being elastically supported by the return spring 67 along the first and second elevating guide holes 54*a* and 54*b* and descends by a prescribed distance downwards.

Therefore, the camshaft 50 having the first and second elevating guide holes 54*a* and 54*b*, the guide hole forming portion 71*a* having the pair of vertical guide holes 78, and the guide pin 67 constitutes a rotational/linear motion converter 59 playing a role of converting a rotational motion of the door 21, that is, the shaft 51 into an up-and-down linear motion of the piston 62 connected to the piston rod 61.

In FIG. 1, reference numerals 81-84 and 87-89 denote an O-ring, respectively, a reference numeral 85 denotes a bushing, and a reference numeral 86 denotes a bush bearing.

The bush bearing 86 plays a role of reducing the rolling friction and the noise generated between the lower surface of the introvert projection of the outer clutch 71 fixed to the lower body 13 and the upper side of a cylindrical body 53 of the camshaft 50 when the camshaft 50 rotates.

3. Fluid Pressure Control Rod Structure

The fluid pressure control rod 45 of the above-described preferred embodiment is appropriate for controlling a single oil-hydraulic circuit, and is established so that an amount of the flow of oil changes little and increases linearly, and a piston ascending speed is low. That is, the fluid pressure control rod 45 compares a current amount of the flow of oil with the oil amount flow when the check valve 63 is turned off, that is, the check valve 63 is at an OFF state, and changes diameter of the oil path so that the amount of the flow of oil varies according to descending of the piston 62.

However, the fluid pressure control rod 45 includes a high-speed setting section having a large amount of the flow of oil and a low-speed setting section having a small amount of the flow of oil, both which are disposed up and down. In this case, the high-speed setting section compares a current amount of the flow of oil with the oil amount flow when the check valve 63 does not operate at an OFF state, that is, at the time of opening of the door (that is, at the time of descending the piston), and establishes a relatively large amount of the flow of oil to flow.

Moreover, in the section where even a part of the low-speed setting section enters the inside of a first oil path 68*a* when the piston 62 ascends, an amount of the flow of oil moving from the upper chamber 91 to the lower chamber 93 gradually increases to thus increase a restoring force of the return spring. The high-speed setting section and the low-speed setting section set the length of each section variably according to an object to which the automatic return hinge apparatus is applied. Further, an amount of taper in the low-speed setting section is determined.

For example, since doors such as constructional materials (fire preventive steel iron gates etc.) should be firmly shut at fire, initiation of the high-speed setting section is initiated from for example, the door opening angle of 30°. However, the door opening angle starts from for example 5° in the case of the miniature doors for electric home appliances or the doors for the indoor rooms. In addition, since the high-speed setting section is unnecessary in the case of up-and-down rotating type doors like Kimchi refrigerators in which Kimchi is a Korean fermentation food, the high-speed setting section is not employed in the up-and-down rotating type doors and only a low-speed setting section is employed therein, respectively.

4. Elevating Guide Structure of Actuator

Hereinbelow, the elevating guide structure of the actuator 60 and the operation of the hinge apparatus will be described in detail. In addition, a clutching process of the clutch unit for controlling the elastic force of the torsion spring 76 for providing the closing force of a door will be described together.

Firstly, the first and second elevating guide holes 54*a* and 54*b* formed in the cylindrical body 53 of the camshaft 50 operate with the door opening angle as shown in FIG. 4, and are divided into three sections "a" through "c," which guide the elevating of the piston, that is, a first section "a" of the door opening angle of 0-90°, a second section "b" of the door opening angle of 90-135°, and a third section "c" of the door opening angle of 135-180°.

Among the three sections "a"-"c," the first section "a" is a section that the opening angle in which the piston 62 of the actuator 60 ascends and descends is determined in the range of 0-90° and a cam diagram angle α of the first and second elevating guide holes 54*a* and 54*b* is set to be relatively bigger than an angle β of the second section "b" to thus enhance an efficiency of ascending the piston 62 and supplementing the closing force loss due to the resistance of the oil-hydraulic circuit and the proportional degradation of the restoring force of the torsion spring 76.

In the first section "a," that is, when the opening angle is in the range of 0-90°, the return speed of a door is limited to a certain speed and delayed by the check valve 63 for the safety of a user. However, in order to complete the automatic return of the door, a latch installed in the door must have a final closing force so as to be combined with a lock installed at a door frame.

Since a return spring is omitted in the above-described embodiment of the present invention, the clutch unit 70 is clutched at the door opening angle of 70°. When the door opening angle exceeds 70°, the reverse twisting of the torsion spring 76 is stopped. When the opening angle is less than 70°, the clutching operation released to thus transfer the restoring force of the torsion spring 76 which has been reversely twisted to the camshaft 50. Accordingly, the clutch unit is set to make a direct influence upon a return of a door.

Therefore, in the first section "a," the check valve 631 does not operate and the torsion spring 76 is reversely twisted proportionally to the opening angle, until the opening angle exceeds 70° since the inner clutch 73 and the camshaft 50 rotate in the left-hand screw direction and the actuator 60, that is, the piston 62 descends, at the door opening time.

However, at the automatic return time of a door, the clutching operation of the clutch unit 70 is released from the opening angle less than 70° and the restoring force supplied from the torsion spring 76 which is in the reverse twisted state makes the inner clutch 73 and the camshaft 50 rotate in the right-hand screw direction. Consequently, the elastic force of the torsion spring 76 is added to the piston 62 to accordingly make the door completely returned to the initial position, that is, locked.

Until the opening angle exceeds 70° and reaches 90°, the clutch unit 70 is at a clutched state, that is, the reverse twisting of the torsion spring 76 is stopped. The piston 62 continuously descends. Accordingly, the check valve 631 does not operate. As a result, the inner clutch 73 and the camshaft 50 easily rotate in the left-hand screw direction, to thus enable a user to open a door without using a big force.

Meanwhile, in the present invention, it is possible to design a lower chamber to include a return spring so as to have a closing force which makes a latch combined with a locking unit installed in a doorframe at the time of an automatic return of a door, in particular, a large-sized door. In this case, the start angle of the clutch unit 70 is set as the opening angle of 30° for example, and the clutch unit 70 is clutched at the opening angle of 30°. The reverse twisting of the torsion spring 76 is stopped, when the opening angle of 30° exceeds the opening angle of 30°. When the opening angle of 30° is less than the opening angle of 30°, the clutching operation is released, and thus the restoring force of the torsion spring 76 which has been reversely twisted is added to that of the return spring. Accordingly, the camshaft 50 can operate.

Moreover, in the second section "b," that is, when the opening angle is in the range of 90-135°, the clutch unit 70 is at a clutched state, that is, the reverse twisting of the torsion spring 76 is stopped. The piston 62 continuously descends down to a bottom dead center. Accordingly, the check valve 631 does not operate. As a result, the inner clutch 73 and the camshaft 50 easily rotate in the left-hand screw direction, according to opening of the door, to thus enable a user to open a door without using a big force.

In the meantime, in the second section "b," the cam diagram angle β of the first and second elevating guide holes 54*a* and 54*b* is set to be relatively smaller than the angle CL of the first section "a." This is nothing but to dispose the cam diagram of the piston 62 in the range of 0-180° within the limited area of the cylindrical portion 53 of the camshaft 50.

In the present invention, the return spring which is a compression spring is removed. Accordingly, an automatic return is accomplished only with the torsion spring 76. As described above, the clutch unit 70 is at the clutched state from the opening angle of 70°. Accordingly, the cam diagram angle does not make an influence upon operation of the hinge apparatus.

Moreover, in the third section "c" where the piston 62 has reached a bottom dead center, that is, in the range of the opening angle of 135-180°, the cam diagram angle is set to be zero to thus make an amount of the flow of oil zero and to thus convenience opening and closing of a door. In addition, in the third section "c," the automatic return is blocked by addition of the return spring 67 to the lower chamber. Here, the angle of the state where the door 1 has been opened is maintained.

In the conventional hinge apparatus, as the opening angle of the door is changed from 0°, that is, the completely closed state, to 180°, that is, the completely opened state, at the time of opening the door, the opening force required for opening the door increases directly proportionally to the opening angle. Accordingly, it needs much force to open the door. However, the present invention needs the opening force similar to that of the conventional case, in order to preserve the closing force of the door until the door opening angle of 70° in the first section "a," but it needs the opening force which is greatly reduced in comparison with the section of the opening angle of less than 70° since the reverse twisting of the torsion spring 76 can be stopped from the opening angle of 70° of the first section "a" according to the operation of the clutch unit 70, to thereby easily open a heavy large-size door.

5. Operation of Hinge Apparatus

The entire operation of the hinge apparatus according to the invention will be illustrated below. In this case, the clutch unit 70 shown in FIGS. 6A-6D is set as a clutch stop start angle of 90°. However, since the hinge apparatus of the relatively small-size door employing only the torsion spring will be described, the operation of the hinge apparatus will be described for the case where the clutch stop start angle is set as 70° as an example.

5-1. At the Door Opening Time

Firstly, when a door 1 is opened from the state where the door has been closed, that is, from the initial state where the door has been stopped, as shown in FIG. 6A, the external rotational force is delivered to the shaft 51 of the camshaft 50 via the first hinge 21 and the upper cap 31. Accordingly, the internal components operate as follows.

When a user opens the door at the initial state of FIG. 6 which shows the state where the door has been closed, the torsion spring 76 is reversely twisted to thus generate the elastic force, while the shaft 51 of the camshaft 50 and the inner clutch 73 rotate in the left-handed screw direction, at the state including a pair of the roller balls 75 as shown in FIG. 6B.

Simultaneously, the rotational force of the left-handed screw direction is transferred to the camshaft 50. Therefore, the guide pin 67 whose both end portions are inserted into a pair of the first ad second guide holes 78 which are integrally formed in the first and second elevating guide holes 54*a* and 54*b* and the outer clutch 71, moves downwards along the first and second elevating guide holes 54*a* and 54*b*, according to the rotation of the camshaft 50. In this case, the force to urge the piston 62 to move to the down direction is applied to the piston 62 operating with the guide pin 70 and the piston rod 61 which move to the down direction.

Accordingly, the oil positioned in the lower side of the piston 62, that is, the lower chamber 93 moves to the upper chamber 91 through the second oil path 68*c*, while the opening and closing ball 63*a* of the second oil path 68*c* moves upwards. That is, at the door opening time, the check valve 631 is closed, that is, in the OFF state. As a result, a large amount of oil rapidly moves from the lower chamber 93 to the upper chamber 91.

As such, the guide pin 70 moves in the first section "a" like the operating state at the first and second elevating guide holes 54*a* and 54*b*. In this case, the actuator 60 descends while reversely twisting the torsion spring 76.

Moreover, the piston rod 61 moves downwards, the fluid pressure control rod 45 which is taper formed enters into the first oil path 68*a*. As a result, an amount of the oil passing through the first oil path 68*a* is gradually decreased. However, the piston 62 rapidly descends since most of a large amount of oil rapidly moves from the lower chamber 93 to the upper chamber 91 through the check valve 63 which is in the OFF state.

Furthermore, when the opening angle of the door becomes 70°, a pair of the roller balls 75 are seceded from the first insertion hole 74*a* of the inner clutch 73 and is inserted to the second insertion hole 74*c* of the outer clutch 71, as shown in FIG. 6C. When the opening angle of the door becomes 70° or greater, the rotation of the inner clutch 73 is suspended and only the shaft 51 of the camshaft 50 rotates as shown in FIG. 6D. Accordingly, an increase in the elastic force of the torsion spring 76 is stopped based on the opening angle of the door of 70°.

In this case, the roller ball 75 hanging on the first insertion hole 74*a* is inserted up to the center or less. Therefore, if the roller ball 75 gets twisted by the torsion spring 76, in FIG. 6C, the force spreading out to the outside works and goes out through the second insertion hole 74*c*, when reaching the second insertion hole 74*c*.

Moreover, in the case that a user continuously rotates a door to thus make the camshaft 50 continuously rotate at the state where an increase in the elastic force of the torsion spring 76 is stopped, the check valve 62 is also at an OFF state. Accordingly, the guide pin 70 gets to reach the second section "b" in which the door opening angle is 90°. Until the guide pin 70 reaches the opening angle of 135° which is the bottom dead center, the piston 62 continuously descends along the second section "b" of the first ad second elevating guide holes 54*a* and 54*b*, to thereby enable a user to open the door without suffering from a big resistance.

Thereafter, if the door continuously rotates the door, the hinge apparatus proceeds to the third section "c" where the door opening angle is in the range of 135-180°. Accordingly, the movement of the door is limited, and the piston 62 does not descend any more and is maintained as the stationary state at the state of being positioned at the bottom dead centre. That is, a state where only the camshaft 50 rotates, that is, a temporary stop state of the door, is maintained.

5-2. At the Door Closing Time

In the meantime, in the second section "b" of the opening angle of 135-90° where the door departs from the temporary stationary state, if a user rotates the door so that the external force is delivered to the camshaft 50 in the right-hand screw direction, the guide pin 70 whose both ends are inserted into a pair of vertical guide holes 78 moves upwards along the first and second elevating guide holes 54*a* and 54*b* according to rotation of the camshaft 50.

As described above, if the guide pin 70 moves vertically upwards along the first and second elevating guide holes 54*a* and 54*b* and the vertical guide holes 78 according to rotation of the camshaft 50, at the time of closing the door, the piston rod 61 and the piston 62 which are connected with the guide pin 67 start to move upwards.

Here, if the oil in the upper chamber 91 receives a pressure by ascending of the piston 62, the oil is pressurized to move to the lower chamber 93 through the second oil path 68*c*. In this case, a check valve 63 is at the ON state as an opening and closing control ball 63*a* closes the second oil path 68*c*. Accordingly, the oil is unable to flow through the second oil path 68*c*. As a result, the piston 62 ascends at a first speed of a relatively low speed in the section of the range of 135-90°.

In this case, according to the ascending of the piston 62, the oil pressure control rod 45 which has been inserted into the first oil path 68*a* gradually moves to a portion whose diameter is small. Thus, an amount of the flow of the oil passing through the first oil path 68*a* gradually increases. As a result, the first speed can be consistently increased to thereby reduce burden of the user.

Thereafter, if the piston 62 ascends and enters the range of the opening angle of 90-70° in the first section "a," a cam diagram angle $\alpha$ of the first section "a" is set to be relatively bigger than an angle $\beta$ of the second section "b." Accordingly, a frictional resistance is reduced. As a result, an amount of the flow of oil passing through the first oil path 68*a* is increased more and more. In this point of view, the ascending speed of the piston 62 is a second speed faster than the first speed. Since the change in speed is relied upon the rotational force applied by the user, the user can control the ascending speed of the piston 62. In this case, the user does not feel burdensome for the closing of the door.

Thereafter, if the piston 62 ascends and thus the opening angle enters the section of 70-0°, the shaft 51 rotates in the right-hand screw direction according to the ascending of the piston 62 and the opening angle of a door becomes 70° or less. In this case, the roller ball 75 is seceded from the second insertion hole 74*c* of the outer clutch 71 and is inserted into the first insertion hole 74*a* of the shaft 51. Here, the roller ball 75 hanging on the second insertion hole 74*c* is inserted up to the center or less thereof. Therefore, the inner clutch 73 which receives the rotational force of the initial setting direction, that is, the right-hand screw direction by the elastic restoring force of the torsion spring 76, applies the rotational force to the roller ball 75. Then, the roller ball 75 secedes from the second insertion hole 74*c* and rotates in the right-hand screw direction together with the inner clutch 73.

Accordingly, the stopped inner clutch 73 receives the rotational force of the initial setting direction, that is, the right-hand screw direction by the elastic restoring force of the torsion spring 76, and applies the rotational force of the right-hand screw direction to the shaft 51 via the roller ball 75. As a result, the door closing force is provided for the door.

Thus, the piston 62 receives a strong elastic restoring force of the torsion spring 76 with respect to the shaft 51. As a result, a larger amount of the flow of oil flows from the upper chamber 91 to the lower chamber 93 via the first oil path 68*a* than that in the range of 135-70°. Thus, the piston 62 ascends at a faster speed.

In this case, since the opening and closing control ball 63*a* completely closes the second oil path 68*c*, the check valve 63 is at an ON state. Accordingly, oil does not flow through the second oil path 68*c* but flows from the upper chamber 91 to the lower chamber 93 via the first oil path 68*a*.

However, since an amount of oil passing through the first oil path 68 continuously increases, the elevating speed of the piston 62 is accelerated. Thus, the door returns to the initial position, and is at a locked state by a latch of the door. The piston 62 returns to the position of the initial state.

An oil-hydraulic circuit that is formed by the first and second oil paths 68*a* and 68*c* of the piston 62 according to employing only the torsion spring 76 at the time of closing the door in the hinge apparatus according to the present invention as described above, plays a role of functioning as only a damper which lowers the door closing speed but attaining a multistage speed control.

However, in the case of employing the single torsion spring 76, a more efficient door closing force of the single torsion spring can be used than the conventional technology that employs a torsion spring and a return spring at the same time.

That is, a compression spring which is used as a return spring makes the piston vertical move. The vertical movement is converted into a rotational movement of the camshaft and provided for the restoring force of the door. During conversion of the linear movement to the rotational movement, an energy loss may occur. Only 30% of the opening force that is required at the door opening time exhibits as the door closing force.

In contrast, the restoring force of the torsion spring which has been reversely twisted according to opening of the door is a rotational moment. Accordingly, in the case that clutching of the clutch unit 70 is released, the restoring force of the torsion spring functions to just make the camshaft perform a rotational motion. Accordingly, an energy loss which may occur during conversion of the linear motion into the rotational motion is less. As a result, 50-70% of the opening force exhibits as the door closing force, to thereby provide an effect of enhancing a conversion efficiency of 20-40%.

Therefore, even if the single torsion spring 76 is employed in this invention, an efficiency of contributing for the closing force of the spring is high. In addition, a part of the length which is reduced due to removal of the return spring is utilized for an increase in the length of the torsion spring. Accordingly, the closing force of the door can be compensated for. As a result, in this invention, the return spring that is inserted in the lower chamber is removed, and a sealing cap, a ball bearing, etc., can be removed, to thereby achieve simplification of parts and enhancement of an assembly.

6. Method of Installing Hinge Apparatus

FIG. 7 is an exploded cross-sectional view for explaining a structure of easily disassembling the hinge apparatus according to the present invention into an upper body combined with an upper cap and the remaining parts and assembling the former with the latter, and FIGS. 8A to 8E are a schematic perspective view illustrating an installation process of a hinge apparatus having an automatic return function for a door according to a preferred embodiment of the present invention, respectively.

A first hinge 21 is integrally formed in a hinge apparatus according to the present invention as shown in FIG. 7. In addition, the hinge apparatus is easily disassembled into and assembled with an upper body 11 on the upper end portion of which an upper cap 31 is combined and the remaining portion.

Therefore, in this invention, the first hinge 21 of the upper body 11 and a second hinge 23 of a lower body 13 are fixed using a clamp screw 22*a* at predetermined positions of a door 1 and a door frame 3, respectively, and then the upper body 11 is simply linked with a shaft 51 that is projected from the lower body 13, while lifting the door 1. In this way, the hinge apparatus is simply assembled.

As a result, since the conventional hinge apparatus does not have a structure that the upper and lower bodies are easily separated from each other, another person need to help installation of a door, but the present invention enables one person can install a door having an automatic return function alone.

Also, the hinge apparatus according to this invention includes a preset screw 72 to make the function of the clutch unit 70 stop, in which the leading end of the preset screw 72 is fixed to a groove 51*a* which is formed in the shaft 51 while penetrating a throughhole 73*a* of the inner clutch 73 from the upper body 11 as shown in FIG. 2A.

Therefore, when the hinge apparatus is installed in this invention, the preset screw 72 is tightened in advance to thereby integrate the inner clutch 73 and the shaft 51 and to thus stop the function of the clutch unit 70. In the case that an installation test is completed, the preset screw 72 is loosened, to thereby enable the clutch unit 70 to function normally.

In general, a door may not be exactly installed in a door frame due to a manufacture problem. Therefore, in order to confirm the installation state of only a door, the clutch unit of the hinge apparatus having the automatic return function is stopped as in the case of the general hinge apparatus. Accordingly, only a damper function remains to thereby easily perform a confirmation operation of the installation state of the door.

In the case that such an installation state confirmation function does not exist in the hinge apparatus having the automatic return function, the hinge apparatus is at a closed state, but the door is at an opened state, during installation of the door. As a result, a big force should be used to compulsively change the closed hinge apparatus to the opened hinge apparatus.

As shown in FIG. 8A, the hinge apparatus 10 is installed between the door 1 and the door frame 3. Thereafter, as shown in FIG. 8B, the door 1 is opened and then shut, to confirm load of the door. Then, as shown in FIG. 8C, the door 1 is opened by 90° or more, to thus reveal the preset screw 72 that is located at the side of the hinge apparatus. Thereafter, as shown in FIG. 8D, the preset screw is loosened using a wrench 5, to thereby restore function of the clutch unit 70. Then, as shown in FIG. 8E, the door 1 is opened and then shut, to confirm the operational state of the hinge apparatus 10.

7. Hinge Apparatus of First Modification (Damping Device)

In the above-described basic embodiment of the present invention, since the fluid pressure control rod 45 which is inserted into the first oil path 68*a* formed in the piston rod has a taper form when the piston ascends according to the door closing, an amount of the flow of oil is consistently increased according to ascending and descending of the piston, to thereby reinforce the door closing force.

In the hinge apparatus (damping device) according to the first modification shown in FIG. 9A, an amount of the flow of oil is greatly reduced and simultaneously maintained constant when the piston ascends and descends according to the door closing, to thereby have no need to a minute speed control. As illustrated, the hinge apparatus according to the first modification shown in FIG. 9A, includes a check valve 63 having a notch portion 69 in the oil path 68*c* incorporated with the check valve.

That is, when the hinge apparatus (damping device) according to the first modification is compared with the above-described basic embodiment, the check valve 63 includes the notch portion 69 providing a uniform damping force at the door closing time. Further, the hinge apparatus (damping device) according to the first modification provides a more simplified structure that an oil path which passes through the inside of the piston rod and an oil pressure control rod whose leading portion is inserted into the oil path have been removed.

The operation at the door opening time in the hinge apparatus (damping device) according to the first modification is substantially same as that of the basic embodiment. However, there is a difference therebetween at the door closing time. That is, if the piston 62 ascends according to the closing of the door, the oil in the upper chamber 91 is pressurized by the ascending piston 62, and thus moves to the lower chamber 93 through the oil path 68*c* formed in the check valve 63. In this case, the opening and closing ball 63*a* of the check valve 63 closes the oil path. Accordingly, oil flows out little by little to the lower chamber 93 through a narrow single notch portion consistently, to then make the piston 62 ascend.

The hinge apparatus (damping device) according to the first modification reduces an amount of the flow of oil greatly, and thus ascends slowly at a constant speed. As a result, the hinge apparatus (damping device) according to the first modification is a hydraulic circuit (damping device) appropriate in the case that there is no need to perform a minute speed control and a door closing is required within a predetermined time. Further, since fluid pressure control rod, the adjustment bolt, the supporter, etc., have been removed from the hinge apparatus (damping device) according to the first modification, the overall length of the hinge apparatus is further reduced to thus obtain simplification of parts.

8. Hinge Apparatus of Second Modification (Damping Device)

In addition, a hinge apparatus of a second modification (Damping device) is similar to that of the first modification. That is, the hinge apparatus of second modification is applied to the case that an amount of the flow of oil is reduced greatly and simultaneously consistently maintained when the piston ascends and descends according to closing of the door and thus there is no need to perform a minute speed control.

In the hinge apparatus of the second modification (Damping device), a check valve 63 is identical with that of the basic embodiment of the present invention. A function of providing a uniform damping force at the door closing time is substantially same as that of the first modification. For this purpose, an oil amount setting bushing 65 at the central portion of which a throughhole 65*a* is formed is combined at the entrance of the oil path 68*a* which penetrates the inside of the piston rod 61. Further, the oil pressure control rod whose leading portion is inserted into the oil path 68*a* has been removed, to thus provide a more simplified structure.

The operation at the door opening time in the hinge apparatus (damping device) according to the second modification is substantially same as that of the basic embodiment. However, there is a difference therebetween at the door closing time. That is, if the piston 62 ascends according to the closing of the door, the oil in the upper chamber 91 is pressurized by the ascending piston 62, and the check valve 63 operates. Thus, the oil does not move to the lower chamber 93 through the oil path 68*c*. Accordingly, oil flows out little by little to the oil path 68*a* via the throughhole 68*b* of the piston rod 61, and the lower chamber 93 through the small-sized throughhole 65*a* of the oil amount setting bushing 65, to then make the piston 62 ascend.

The fluid pressure control rod, the adjustment bolt, the supporter, etc., have been removed from the hinge apparatus (damping device) according to the second modification in the same manner as that of the hinge apparatus (damping device) according to the first modification. Accordingly, the overall length of the hinge apparatus is further reduced to thus obtain simplification of parts.

9. Rotational/Linear Motion Converter According to Second Embodiment

In the case of the hinge apparatuses according to the basic embodiment, and the first and second modifications, the rotational/linear motion converter 59 has been applied and employed in the same as that of the hinge apparatus according to the first embodiment shown in FIGS. 3A and 3B, in order to convert a rotational motion of a shaft to an axial linear motion of a piston. However, other types of rotational/linear motion converters may be applied and employed in the hinge apparatus according to the present invention.

FIGS. 10A to 10C are an assembled perspective view, a disassembled perspective view and a lengthy cross-sectional view showing a rotational/linear motion converter for converting the rotational motion of a shaft to the axial linear motion of a piston according to a second embodiment of the present invention, respectively.

Hereinbelow, like reference numerals are assigned with respect to like elements when compared with the basic embodiment of the present invention.

The rotational/linear motion converter may include a pair of motion symmetrical elevating guide holes in which cam diagrams are formed, a guide pin which makes the piston 62 and the connection portion thereof move along the elevating holes, and a guide hole forming portion having a pair of vertical guide holes 78 for guiding the piston 62 and the actuator 60 including the connection portion extended from the piston 62 to move up and down.

The rotational/linear motion converter 59*a* according to the second embodiment may be modified without making an influence upon the clutch unit 70 formed in the upper end portion of the shaft 51.

In the second embodiment, the pair of the elevating guide holes 54 in which cam diagrams are formed, are formed in the cylindrical portion 171 which is extended and formed in the lower side of the outer clutch 71 whose outer circumference is fixed to the lower body 13. The pair of the vertical guide holes 78 are formed in opposition to each other in the top and bottom direction in the cylindrical portion 153 that is extended with a diameter of a medium size in the lower end portion of the shaft 51. The guide pin 67 is combined while penetrating the upper end portion of the piston rod 61 which has been inserted into the inside of the cylindrical portion 153, the vertical guide holes 78 of the cylindrical portion 153, and the elevating guide holes 54 of the cylindrical portion 171.

In this case, the pair of the elevating guide holes 54 in which cam diagrams are formed, are formed in the same as that of the first embodiment.

Therefore, in the case of the rotational/linear motion converter 59*a* according to the second embodiment, if the shaft 51 rotates according to opening of the door, the guide pin 67 rotates along the pair of the elevating guide holes 54 together with the shaft 51, and thus moves downwards in the pair of the vertical guide holes 78. As a result, the piston 62 connected with the piston rod 61 rotates and thus descends downwards by a predetermined distance.

In the case of the rotational/linear motion converter 59*a* according to the second embodiment, the pair of the elevating guide holes 54 in which cam diagrams are formed, are formed in the cylindrical portion 171 formed of a large diameter. Accordingly, the length of the cam diagram is relatively increased. If the length of the cam diagram is increased, the up/down motion distance is also increased, to thereby make an amount of the flow of oil increased.

In the meantime, in the case that an amount of the flow of oil is small in the hydraulic circuit of the conventional hinge apparatus, it is difficult to perform an ascending and descending speed control of the piston when the temperature change occurs greatly. However, since an amount of the flow of oil increases in the present invention, as described above, it is not difficult to perform an ascending and descending speed control of the piston.

10. Rotational/Linear Motion Converter According to Third Embodiment

FIGS. 11A to 11D are an assembled perspective view, a disassembled perspective view and lengthy cross-sectional views showing a rotational/linear motion converter for converting the rotational motion of a shaft to the axial linear motion of a piston according to a third embodiment of the present, respectively.

In the rotational/linear motion converter 59*b* according to the third embodiment, a pair of elevating guide holes 54 in which cam diagrams are formed, are formed in a cylindrical portion 172 which is extended and formed with a diameter of a medium size in the lower side of an outer clutch 71. A pair of vertical guide holes 78 are penetratively formed in the top and bottom direction in an extension shaft 151 that is extended with the same diameter of a small size as that of a shaft 51 in the lower end portion of the shaft 51. A piston rod 161 is integrally cylindrically extended and formed from a piston 62.

In addition, a guide pin 67 is combined with a pair of facing pin holes 162 formed in the cylindrical piston rod 161, a pair of elevating guide holes 54 in which cam diagrams are formed in the cylindrical portion 172, and a pair of vertical guide holes 78 which are penetratively formed in the top and bottom direction in the extension shaft 151.

In this case, the pair of the elevating guide holes 54 in which cam diagrams are formed, are formed in the same as those of the first embodiment.

Therefore, in the case of the rotational/linear motion converter 59*b* according to the third embodiment, if the shaft 51 rotates according to opening of the door, the guide pin 67 rotates along the pair of the elevating guide holes 54 together with the shaft 51, and thus moves downwards in the pair of the vertical guide holes 78. As a result, the cylindrical piston rod 161 connected with the guide pin 67 and the piston 62 also rotate and thus the piston 62 descends downwards by a predetermined distance.

In the case of the rotational/linear motion converter 59*b* according to the third embodiment, the shaft 51 and the extension shaft 151 are formed with an identical diameter, to accordingly enhance a working efficiency.

11. Rotational/Linear Motion Converter According to Fourth Embodiment

FIGS. 12A to 12D are an assembled perspective view, a disassembled perspective view and lengthy cross-sectional views showing a rotational/linear motion converter for converting the rotational motion of a shaft to the axial linear motion of a piston according to a fourth embodiment of the present, respectively.

In the rotational/linear motion converter 59*c* according to the fourth embodiment, a pair of elevating guide holes 54 in which cam diagrams are formed, are formed in a cylindrical portion 171 which is extended and formed in the lower side of an outer clutch 71 whose outer circumference is fixed to a lower body 13. A pair of vertical guide holes 78 are penetratively formed in the top and bottom direction in an extension shaft 152 that is extended with the same diameter of a small size as that of a shaft 51 in the lower end portion of the shaft 51. A piston rod 163 is integrally cylindrically extended and formed from a piston 62 with a medium size.

In addition, a guide pin 67 is combined with a pair of elevating guide holes 54 in which cam diagrams are formed in the cylindrical portion 171, a pair of facing pin holes 162 formed in the cylindrical piston rod 161 which is inserted into the cylindrical portion 171, and a pair of vertical guide holes 78 which are penetratively formed in the top and bottom direction in the extension shaft 151.

In this case, the pair of the elevating guide holes 54 in which cam diagrams are formed, are formed in the same as those of the first embodiment.

Therefore, in the case of the rotational/linear motion converter 59*c* according to the fourth embodiment, if the shaft 51 rotates according to opening of the door, the guide pin 67 rotates along the pair of the elevating guide holes 54 together with the shaft 51, and thus moves downwards in the pair of the vertical guide holes 78. As a result, the cylindrical piston rod 163 connected with the guide pin 67 and the piston 62 also rotate and thus the piston 62 descends downwards by a predetermined distance.

In the case of the rotational/linear motion converter 59*c* according to the fourth embodiment, the pair of the elevating guide holes 54 in which cam diagrams are formed are formed in the cylindrical portion 171 made of a large diameter similarly to the second embodiment. Accordingly, length of the cam diagram is increased to thereby be advantageous of an oil amount control. Further, the shaft 51 and the extension shaft 151 are formed with an identical diameter, to accordingly enhance a working efficiency.

12. Rotational/Linear Motion Converter According to Fifth Embodiment

FIGS. 13A to 13D are an assembled perspective view, a disassembled perspective view and lengthy cross-sectional views showing a rotational/linear motion converter for converting the rotational motion of a shaft to the axial linear motion of a piston according to a fifth embodiment of the present, respectively.

The rotational/linear motion converter 59*d* according to a fifth embodiment of the present invention, includes: a cylindrical portion 171 whose upper end portion is installed in the inner circumferential surface of the lower body 13 and through which first and second elevating guide holes 54 which are made of a spiral shape of a movement symmetrical structure for each other are penetratively formed; an extension shaft 152 which is extended into the inside of the cylindrical portion 171 from the shaft 51 and which has a number of vertical guide protrusions 152*a* in the vertical direction; a cylindrical piston rod 163 which is extended from the piston 62, and on the upper end portion of which a pair of pin holes 162 are formed and face each other and on the inner circumference of which grooves 163*b* are formed in correspondence to the number of the vertical guide protrusions 152*a* of the extension shaft 152, and with the outer circumference of which the cylindrical portion 171 is slidably combined; and first and second guide pins 67*a* and 67*b* which are combined with the pair of the pin holes 162 which are formed in the cylindrical piston rod 163 and face each other and the first and second elevating guide holes 54 which are formed in the cylindrical portion 171, respectively.

In this case, the pair of the elevating guide holes 54 in which cam diagrams are formed, are formed in the same as those of the first embodiment.

Therefore, in the case of the rotational/linear motion converter 59*d* according to the fifth embodiment, if the shaft 51 rotates according to opening of the door, the guide pins 67*a* and 67*b* rotate along the pair of the elevating guide holes 54. As a result, the piston rod 163 also rotates together with the guide pins 67*a* and 67*b* and thus the piston rod 163 descends downwards by a predetermined distance.

In the rotational/linear motion converter 59*d* according to the fifth embodiment, the shaft 51 and the extension shaft 152 do not include any throughhole, respectively. Thus, the rotational/linear motion converter 59*d* according to the fifth embodiment can be fabricated by a form rolling process which is a kind of a plastic working process. Therefore, the shafts for use in the first to fourth embodiments include a throughhole, respectively, and thus are fabricated by a cutting process using a cutting tool, but the shaft for use in the fifth embodiment can be fabricated by a form rolling process, to thereby lower a processing cost and avoid waste of material costs due to a cutting process.

13. Rotational/Linear Motion Converter According to Sixth Embodiment

FIGS. 14A to 14D are an assembled perspective view, a disassembled perspective view and lengthy cross-sectional views showing a rotational/linear motion converter for converting the rotational motion of a shaft to the axial linear motion of a piston according to a sixth embodiment of the present, respectively.

In the rotational/linear motion converter 59*e* according to a sixth embodiment of the present invention, two lines of female thread portions 163*a* formed of a spiral shape are formed on the inner circumference of a cylindrical piston rod 163 of a medium size which is extended from the piston 62, instead of a pair of elevating guide holes in which cam diagrams are formed. A pair of vertical guide holes 78 are formed facing each other in the vertical direction in the cylindrical piston rod 163, respectively. Two lines of male thread portions 153*a* corresponding to the two lines of female thread portions 163*a* are formed in an extension shaft 151 of a spiral form which is extended in the lower end of a shaft 51 in the same diameter as that of the shaft 51.

In the rotational/linear motion converter 59*e* according to a sixth embodiment of the present invention, a pair of opposing pin holes 162 are formed in a cylindrical portion 171 which is extended and formed in the lower end portion of an outer clutch 71 whose outer circumference is fixed to a lower body 13. A pair of guide pins 67*a* and 67*b* are combined between a pair of vertical guide holes 78 which are formed in the cylindrical piston rod 163 and a pair of the pin holes 162 which are formed in the cylindrical portion 171, via the pair of the pin holes 162.

Therefore, in the rotational/linear motion converter 59*e* according to the sixth embodiment of the present invention, as the shaft 51 rotates in the right-hand screw direction according to opening of a door, the rotational force of the right-hand screw direction is applied to the piston rod 163 having the two lines of female thread portions 163*a* screw-engaged with the two lines of male thread portions 153*a* of the extension shaft 151, through the two lines of male thread portions 153*a* of the extension shaft 151. Here, one end of the guide pins 67*a* and 67*b* is combined with the pin holes 162 of the cylindrical portion 171, respectively, and the other end of the guide pins 67*a* and 67*b* is inserted into the vertical guide holes 78 of the piston rod 163, respectively. Accordingly, the piston rod 163 does not rotate. As a result, the cylindrical piston rod 163 and the piston 62 descend downwards in the vertical direction by a predetermined distance.

In the rotational/linear motion converter 59*e* according to the sixth embodiment, the shaft 51 and the extension shaft 153 do not include any throughhole, respectively, similarly to that of the fifth embodiment, but include only the threads. Thus, the rotational/linear motion converter 59*e* according to the sixth embodiment can be fabricated by a form rolling process which is a kind of a plastic working process. Therefore, the shafts for use in the first to fourth embodiments include a throughhole, respectively, and thus are fabricated by a cutting process using a cutting tool, but the shaft for use in the sixth embodiment can be fabricated by a form rolling process, to thereby lower a processing cost and avoid waste of material costs due to a cutting process.

In the case of the rotational/linear motion converters 59*b*-59*e* according to the second to sixth embodiments, the operations of converting the rotational motion of the shaft 51 to the axial linear motion of the piston 62, that is, a descending operation according to opening of the door have been described, but the operations of making the shaft 51 rotate according to the axial linear motion of the piston 62, that is, an ascending operation at the time of closing the door proceeds in an order reverse to that of the door opening time.

In this case, the axial linear motion of the piston 62, that is, an ascending operation, is achieved by an ascending force according to a restoring force of the return spring which is inserted into the lower chamber and/or the torsion spring which is linked with the clutch unit 70.

14. Overpressure Prevention Valve and Check Valve

FIG. 15A is a cross-sectional view showing a piston including an overpressure prevention valve and a check valve according to the present invention. FIG. 15B is an exploded perspective view showing the compositional elements of the overpressure prevention valve and the check valve of FIG. 15A. FIG. 15C is an exploded perspective view showing the piston where the compositional elements of the overpressure prevention valve and the check valve have been removed from the piston of FIG. 15A.

FIGS. 16A and 16B are diagrams for explaining operations of the check valve at the time of opening and closing a door, respectively, and FIG. 16C is a diagram for explaining an operation of the overpressure prevention valve.

As illustrated in FIGS. 15A to 15C, a piston rod 61*a* is integrally formed in a piston 62*a* including an overpressure prevention valve and a check valve, to thereby form an actuator. A groove 109 which communicates with the inside of the piston rod 61*a* from the lower end portion of the piston 62*a* is formed at the central portion of the actuator. The groove 109 formed in the piston 62*a* is formed to have first to third diameter portions 111-113 whose diameters are gradually reduced in three steps.

The third diameter portion 113 whose diameter is the smallest is formed with the same diameter as that of a groove 114 that is extended and formed in the piston rod 61, and a throughhole 110 is extended and formed in the groove 114 to communicate with the upper chamber 91.

As shown in FIG. 15B, a check valve 101 at the central portion of which a throughhole 101*a* is formed and which is formed of a sheet form plate whose both two side surfaces facing each other are cut open and run in parallel with each other and both other two side surfaces facing each other are curved, is inserted into the second diameter portion 112 of the groove 109. An overpressure prevention valve 102 whose outer diameter is greater than the second diameter portion 112 and is smaller than the third diameter portion 113, and at the central portion of which a throughhole 102*a* is formed, is inserted into the lower portion of the check valve 101. A dish shaped spring 103 which has an outer diameter not more than the overpressure prevention valve 102 and at the central portion of which a throughhole 103*a* is formed, is inserted into the lower side of the overpressure prevention valve 102. An overpressure prevention ring 104 is inserted between the overpressure prevention valve 102 and the dish shaped spring 103, and the inner circumference of the third diameter portion 113. The outer circumference of an overpressure prevention clamping bolt 105 is screw-connected with the inner circumference of the third diameter portion 113 in the lowest end portion of the groove 109, in order that the overpressure prevention ring 104 and the dish shaped spring 103 do not secede from the groove and the dish shaped spring 103 is maintained at a closely contact state with respect to the overpressure prevention valve 102.

Also, the overpressure prevention valve 103 is set to have a little smaller outer diameter than the inner diameter of the overpressure prevention ring 104. When overpressure occurs, an overpressure release oil path (OP) is formed to remove overpressure. A throughhole 105*a* is formed at the central portion of the overpressure prevention clamping bolt 105, and at least one pair of throughholes 105*b* and 105*c* are formed at the outer side of the overpressure prevention clamping bolt 105, in order to form the overpressure release oil path (OP) to remove overpressure when overpressure occurs.

A fluid pressure control rod 45 is inserted into the throughholes 101*a*-103*a* and 105*a* which are formed at the central portion of the check valve 101, the overpressure prevention valve 102, the dish shaped spring 103 and the overpressure prevention clamping bolt 105. The throughhole 102*a*, 103*a*, and 105*a* formed at the central portion of the overpressure prevention valve 102, the dish shaped spring 103 and the overpressure prevention clamping bolt 105 are formed to be greater than the throughhole 101*a* of the overpressure prevention valve 102.

The check valve 101 is disposed so as to move up and down in the second diameter portion 112 according to the oil pressure. The second diameter portion 112 and the third diameter portion 113 are connected with each other through an up-direction slope 115, and the second diameter portion 112 and the first diameter portion 111 are connected with each other through a vertical step portion 116. The overpressure prevention valve 102, the dish shaped spring 103, the overpressure prevention ring 104, and the overpressure prevention clamping bolt 105 form an overpressure prevention unit 100 together with the piston 62*a* on which a groove 109 is formed.

The piston 62*a* descends by the rotational/linear motion converters 59-59*e* when the door opens. As a result, oil in the lower chamber 93 flows to the upper chamber 91 along the arrow of FIG. 16A. In this case, the oil in the lower chamber 93 flows in the throughholes 105*a*, 103*a*, and 102*a* formed at the central portion of the overpressure prevention clamping bolt 105, the dish shaped spring 103 and the overpressure prevention valve 102 and then makes the check valve 101 move so that the outer circumference of the upper surface of the check valve 101 contacts the slope 115 between the second diameter portion 112 and the third diameter portion 113. Then, the oil easily moves through a big space between both the cut open side surfaces of the check valve 101 and the slope 115 together with a small throughhole 101*a* formed at the central portion of the check valve 101. As a result, when the piston 62*a* descends, it is not greatly influenced by a damping pressure due to the oil in the lower chamber 93.

When the door is closed in contrary with the above-described case, the piston 62*a* ascends. Accordingly, the oil in the upper chamber 91 flows to the lower chamber 93 along the arrow of FIG. 16B. In this case, the check valve 101 receives a pressure on the upper side thereof, and moves so that the lower surface of the check valve 101 may contact the upper surface of the overpressure prevention valve 102. As a result, because the upper surface of the overpressure prevention valve 102 closely contacts the vertical step portion 116, the oil in the upper chamber 91 does not form an oil path according to a gap of the outer circumferential portion of the check valve 101 but moves by small quantity through a normal oil path (NP) that passes through the throughholes 101*a*-103*a*, and 105*a* that are formed at the central portions of the check valve 101, the overpressure prevention valve 102, the dish shaped spring 103 and the overpressure prevention clamping bolt 105. As a result, when the piston 62*a* ascends, the piston 62*a* is greatly influenced by a damping pressure due to the oil in the upper chamber 91, and thus ascends at low speed.

In the meantime, as described above, the overpressure prevention valve unit 100 does not operate in the case that a user closes a door at a normal speed, but operates only when an external force having a big force such as a strong wind is applied to the door to accordingly make the door rapidly closed. That is, in the case that the door is opened and closed at a normal speed as described above, the oil path is selectively blocked according to the position set in the check valve 101.

In the case that a strong closing force is applied to the door artificially by a strong wind or a person, at the state where the door is opened, the piston 62*a* is required to ascend at high speed through the rotational/linear motion converters 59-59*e*.

If the piston 62*a* ascends instantaneously with a strong force at high speed by the external force, an overpressure is applied on the upper side surface of the check valve 101 due to the oil in the upper chamber 91. When the pressure that is applied to the check valve 101 and the overpressure prevention valve 102 is greater than the elastic force of the dish shaped spring 103, the dish shaped spring 103 is outspread flat due to the pressure of the oil, and the upper surface of the overpressure prevention valve 102 which has closely contacted the vertical step portion 116 moves downwards. If the overpressure prevention valve 102 moves downwards, an overpressure release oil path is formed between the outer circumference of the check valve 101 and the inner circumference of the piston 62*a*, between the overpressure prevention valve 102 and the overpressure prevention ring 104, and along the throughholes 105*b* and 105*c* of the overpressure prevention clamping bolt 105, and thus the oil flows to the lower chamber 93, according to the arrow of FIG. 16C.

Therefore, the oil in the upper chamber 91 flows in the lower chamber 93 in a large quantity through the overpressure release oil path (OP) and the normal oil path (NP) which passes through the throughholes 105*a*, 103*a*, and 102*a* formed at the central portion thereof, to thereby release an overpressure state.

As a result, one of various kinds of O-rings arranged for air tight around the lower body 13 and the piston 62*a* is broken or the main bodies are damaged, by the overpressure in the upper chamber 91, to thus prevent oil from leaking beforehand.

However, when the pressure that is produced within the upper chamber 91 according to the normal closing operation of the door is smaller than the elastic force of the dish shaped spring 103, the overpressure prevention valve 63 does not move downwards by pressure of oil. As described above, if the overpressure prevention valve 103 does not move downwards but is maintained at a state of elastically contacting the vertical step portion 116 of the piston 62*a*, the overpressure release oil path (OP) is not formed between the vertical step portion 116 and the overpressure prevention valve 103.

In this case, the dish shaped spring 103 is preferably designed to have an elastic coefficient so as to deform in the case that overpressure occurs.

In the meantime, this invention cannot only prevent a loss of the closing force of the door, but also cancel a compression repelling force of the torsion spring 76, from the door opening angle of 70° from which clutching of the clutch unit is achieved at the door opening time. As a result, this invention can easily open the door with a relatively small force in comparison with the case having no clutching.

As described above, in the case that a door is closed in the present invention, if a user closes or opens the door at the door opening angle of 70° or less and then releases the door at the door opening angle of 70° or less, the door automatically returns to the initial position.

As described above, when the clutch start angle is set as 70°, the opening angle of an ordinary door by a user is accomplished within the door opening angle of 70° or less. Accordingly, if the automatic return speed of the door is properly set, a safety accident due to a rapid return of the door can be prevented. Further, a burden of controlling the door to automatically return can be reduced.

The hinge apparatuses according to the above-described embodiments of the present invention can be used as slim type hinge apparatuses having bodies of small diameters so as to be applied to interior indoor-type doors for example. However, if the length of the torsion spring is increased in a manner that the diameter of the torsion spring is maintained as it is and only the length thereof is increased, the hinge apparatus according to the present invention can be used for a large-size heavy door.

The hinge apparatus according to the embodiment of the present invention provides a sufficient damping force to control the ascending speed of the piston, by adding at least one oil-hydraulic circuit to compensate for the damping force which has been reduced by reducing the diameter of the bodies playing a role of a housing into a slim-type form.

In addition, the embodiments have been described with respect to the case of employing only a single torsion spring. However, it is possible to adopt a torsion having a small restoring force and a compression spring which is used in combination with the torsion spring.

Moreover, a ball type check valve has been described in the basic embodiment, but a sheet type check valve may be employed as described in the case of the overpressure prevention valve.

In addition, the case that oil has been filled in the upper and lower chambers has been described as an example, but it is possible to fill air or gas such as gaseous nitrogen may be filled therein.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

As described above, a hinge apparatus according to the present invention can be used in an exterior material for various kinds of indoor type doors. Here, the hinge apparatus according to the present invention can be formed into a compact and slim type structure to prevent persons from feeling burdensome in view of an interior circumstance. As a result, the hinge apparatus according to the present invention can be applied to various kinds of applications such as doors for buildings.

The hinge apparatus according to the present invention can be used as slim type hinge apparatus having bodies of small diameters so as to be applied to interior indoor-type doors for example. However, if the length of the torsion spring is increased in a manner that the diameter of the torsion spring is maintained as it is and only the length thereof is increased, the hinge apparatus according to the present invention can be used for a large-size heavy door.

The invention claimed is:

1. A hinge apparatus having an automatic return function, the automatic return hinge apparatus comprising:

an upper body on a circumferential surface of which a first hinge which is fixed to a door is integrally formed and whose upper end portion is blocked by an upper cap on the inner side surface of which a recess is formed;

a lower body on a circumferential surface of which a second hinge which is fixed to a door frame is integrally formed and whose lower end portion is blocked by a lower cap which is connected in a sealing manner;

a shaft whose lower end portion is rotatably installed in the upper portion of the lower body and whose upper end portion is inserted into the recess of the upper cap;

a piston whose outer circumference is slidably installed along the inner circumferential surface of the lower body and which divides the inner portion of the lower body into upper and lower chambers;

a rotational/linear motion converter which converts a rotational motion of the shaft into an axial linear motion of the piston when the rotational force of the door is applied to the shaft according to the rotation of the door;

a damping unit which provides a damping function selectively in the case that the piston descends/ascends according to opening/closing of the door; and a return unit which provides a restoring force to the rotational/linear motion converter in order to return the door to an initial position at the time when the door is closed.

2. The hinge apparatus having an automatic return function according to claim 1, wherein the rotational/linear motion converter comprises:

a guide hole forming portion which has first and second vertical guide holes which are installed in the inner circumferential surface of the lower body and face each other in the vertical direction;

a camshaft which includes a cylindrical portion in which first and second elevating guide holes which are extended from the shaft and are made of a spiral shape of a movement symmetrical structure for each other along the outer circumferential surface thereof, are penetratively formed and which is pivoted by a relative external force which is applied to the upper body when the door is rotated; and a guide pin whose both end portions are combined with the first and second vertical guide holes via the first and second elevating guide holes, respectively, in which one end of the guide pin is connected to the upper portion of the piston rod.

3. The hinge apparatus having an automatic return function according to claim 1, wherein the rotational/linear motion converter comprises:

a first cylindrical portion in which first and second elevating guide holes which are installed in the inner circumferential surface of the lower body and are made of a spiral shape of a movement symmetrical structure for each other along the outer circumferential surface thereof, are penetratively formed;

a second cylindrical portion which are extended into the second cylindrical portion from the shaft and face each other in the vertical direction, in which first and second vertical guide holes are penetratively formed; and a guide pin whose both end portions are combined with the first and second vertical guide holes of the second cylindrical portion, via the first and second elevating guide holes of the first cylindrical portion, respectively, in which the central portion of the guide pin is connected to the upper portion of the piston rod which is connected with the piston, and wherein the guide pin and the piston descend and ascend while rotating when the door is rotated.

4. The hinge apparatus having an automatic return function according to claim 1, wherein the rotational/linear motion converter comprises:

a cylindrical portion whose upper end portion is installed in the inner circumferential surface of the lower body and in the lower end portion of which first and second elevating guide holes which are made of a spiral shape of a movement symmetrical structure for each other are penetratively formed;

an extension shaft which is extended into the inside of the first cylindrical portion from the shaft and which has a vertical guide hole which is penetratively formed in the vertical direction;

a cylindrical piston rod which is extended from the piston, and on the upper end portion of which a pair of pin holes are formed and face each other and with the inner circumference of which the cylindrical portion is slidably combined; and a guide pin whose both end portions are combined with the pair of the pin holes which are formed in the cylindrical piston rod and face each other, the first and second elevating guide holes which are formed in the cylindrical portion, and the vertical guide hole which is penetratively formed in the vertical direction in the extension shaft, and wherein the guide pin and the piston rod descend and ascend while rotating when the door is rotated.

5. The hinge apparatus having an automatic return function according to claim 1, wherein the rotational/linear motion converter comprises:

a cylindrical portion whose upper end portion is installed in the inner circumferential surface of the lower body and through which first and second elevating guide holes which are made of a spiral shape of a movement symmetrical structure for each other are penetratively formed;

an extension shaft which is extended into the inside of the first cylindrical portion from the shaft and which has a vertical guide hole which is penetratively formed in the vertical direction;

a cylindrical piston rod which is extended from the piston, and on the upper end portion of which a pair of pin holes are formed and face each other and into which the inner circumference of which the extension shaft is inserted and with the outer circumference of which the cylindrical portion is slidably combined; and a guide pin whose both end portions are combined with the pair of the pin holes which are formed in the cylindrical piston rod and face each other, the first and second elevating guide holes which are formed in the cylindrical portion, and the vertical guide hole which is penetratively formed in the vertical direction in the extension shaft, and wherein the guide pin and the piston rod descend and ascend while rotating when the door is rotated.

6. The hinge apparatus having an automatic return function according to claim 1, wherein the rotational/linear motion converter comprises:

a cylindrical portion whose upper end portion is installed in the inner circumferential surface of the lower body and through which first and second elevating guide holes which are made of a spiral shape of a movement symmetrical structure for each other are penetratively formed;

an extension shaft which is extended into the inside of the cylindrical portion from the shaft and which has a number of vertical guide protrusions in the vertical direction;

a cylindrical piston rod which is extended from the piston, and on the upper end portion of which a pair of pin holes are formed and face each other and on the inner circumference of which grooves are formed in correspondence to the number of the vertical guide protrusions, and with the outer circumference of which the cylindrical portion is slidably combined; and first and second guide pins which are combined with the pair of the pin holes which are formed in the cylindrical piston rod and face each other and the first and second elevating guide holes which are formed in the cylindrical portion, respectively, and wherein the guide pins and the piston rod descend and ascend while rotating when the door is rotated.

7. The hinge apparatus having an automatic return function according to claim 1, wherein the rotational/linear motion converter comprises:

a cylindrical portion whose upper end portion is installed in the inner circumferential surface of the lower body and whose lower end portion is extended, in which a pair of pin holes are formed in opposition to the lower end portion thereof;

an extension shaft which is extended into the inside of the cylindrical portion from the shaft and on the outer circumference of which a number of lines of male thread portions formed of a spiral shape;

a cylindrical piston rod which is extended from the piston, and which has a pair of vertical guide holes which are face each other and penetratively formed in the vertical direction, and on the inner circumference of which a number of lines of female thread portions are formed in correspondence to the number of lines of male thread portions formed in the extension shaft, and with the outer circumference of which the cylindrical portion is slidably combined; and guide pins which are combined with the pair of the pin holes which are formed in the cylindrical portion and face each other and the pair of vertical guide holes which are formed in the cylindrical piston rod, respectively, and wherein the cylindrical piston rod descends and ascends while rotating when the door is rotated.

8. The hinge apparatus having an automatic return function according to claim 2, wherein the first and second elevating guide holes comprise a first elevating section formed of a first cam diagram angle, a second elevating section formed of a second cam diagram angle which is relatively smaller than the first cam diagram angle, and a stop section whose cam diagram angle is zero, respectively.

9. The hinge apparatus having an automatic return function according to claim 1, wherein the damping unit comprises:

a piston rod whose leading end is connected to the guide pin so as to be slidably combined with the inner portion of the cylindrical portion of the camshaft and whose lower end is connected to the center of the piston, and which includes a first oil path so that the oil can flow between the upper and lower chambers;

at least one check valve which is installed in the piston and opens the oil path of the oil moving from the lower chamber to the upper chamber at the opening time of the door, and closes the oil path of the oil moving from the upper chamber to the lower chamber at the door closing time; and an elevating speed control unit for controlling the elevating speed of the piston which ascends at the door closing time.

10. The hinge apparatus having an automatic return function according to claim 9, wherein the elevating speed control unit comprises a fluid pressure control rod whose leading end is inserted into the first oil path of the piston rod and which controls an amount of oil flowing from the upper chamber to the lower chamber through the first oil path.

11. The hinge apparatus having an automatic return function according to claim 1, wherein the damping unit comprises:

a piston rod whose leading end is connected to the guide pin so as to be slidably combined with the inner portion of the cylindrical portion of the camshaft and whose lower end is integrally connected to the center of the piston, and which includes a first oil path so that the oil can flow between the upper and lower chambers;

a check valve which is formed at the central portion of the piston which communicates from the first oil path of the piston rod, and opens the oil path of the oil moving from the lower chamber to the upper chamber at the opening time of the door, and restricts the oil path of the oil moving from the upper chamber to the lower chamber at the door closing time, so that a small amount of oil may flow through the oil path; and a fluid pressure control rod whose leading end is inserted into the first oil path of the piston rod via the check valve and which controls the elevating speed of the piston which ascends at the door closing time.

12. The hinge apparatus having an automatic return function according to claim 11, wherein the fluid pressure control rod is gradually reduced in the diameter thereof toward the leading end thereof.

13. The hinge apparatus having an automatic return function according to claim 11, wherein the fluid pressure control rod comprises a high-speed setting section and a low-speed setting section to vary an amount of the flow of oil which moves through the first oil path according to the opening angle of the door.

14. The hinge apparatus having an automatic return function according to claim 11, wherein the check valve further comprises an overpressure prevention unit which releases overpressure in the case that the piston is needed to rise up at high speed by an external force and thus the upper chamber is increased not less than a predetermined set pressure.

15. The hinge apparatus having an automatic return function according to claim 1, wherein the damping unit comprises:

a piston rod whose leading end is connected to the guide pin so as to be slidably combined with the inner portion of the cylindrical portion of the camshaft and whose lower end is integrally connected to the center of the piston, and which includes a first oil path so that the oil can flow between the upper and lower chambers;

at least one check valve which is installed in at least one second oil path of the piston, and which opens the oil path of the oil moving from the lower chamber to the upper chamber at the opening time of the door, and closes the oil path of the oil moving from the upper chamber to the lower chamber at the door closing time; and an oil amount setting bushing which is inserted into the first oil path of the piston rod and which controls uniformly the elevating speed of the piston which ascends at the door closing time.

16. The hinge apparatus having an automatic return function according to claim 1, wherein the damping unit comprises:

a piston rod whose leading end is connected to the guide pin so as to be slidably combined with the inner portion of the cylindrical portion of the camshaft and whose lower end is integrally connected to the center of the piston, and at least one check valve which is installed in at least one oil path of the piston, and which opens the oil path of the oil moving from the lower chamber to the upper chamber at the opening time of the door, and restricts the oil path of the oil moving from the upper chamber to the lower chamber at the door closing time, so that a uniform damping force may be provided for the hinge apparatus.

17. The hinge apparatus having an automatic return function according to claim 1, wherein the upper body is detachably combined with the main body of the hinge apparatus.

18. The hinge apparatus having an automatic return function according to claim 1, wherein the upper and lower bodies further comprise first and second reinforcement plates which are extended perpendicularly with the first and second hinges so as to be contiguous to the door and the door frame in order to disperse the external forces applied to the first and second hinges, respectively.

19. The hinge apparatus having an automatic return function according to claim 1, wherein the return unit comprises:

a torsion spring which is built in the upper body so that one end of the torsion spring is fixed to the upper end portion of the shaft, thereby providing a restoring force to rotate the shaft in the direction returning the door; and a clutch unit which is connected with the other end of the torsion spring, for stopping an increment of an elastic restoring force due to inverse-twisting of the torsion spring in the case that an opening angle reaches a clutch stop start angle at the door opening time, and for restoring the elastic restoring force of the torsion spring in the case that the opening angle reaches the clutch stop start angle at the door closing time.

20. The hinge apparatus having an automatic return function according to claim 1, wherein the clutch unit comprises:

an outer clutch whose outer circumference is fixed to the inner circumference of the lower body by a compulsive press-in structure;

an inner clutch whose lower end portion is rotatably inserted into the upper end portion of the outer clutch, in the inner space of which the shaft is supported at a rotatably contact state, and to the upper end portion of which the lower end portion of the torsion spring is fixed; and a pair of roller balls which are arranged between the outer and inner clutches, and play a role of combining the inner clutch with the shaft or separating the former from the latter according to an opening angle of the door.

21. The hinge apparatus having an automatic return function according to claim 1, further comprising a clutch stop unit for temporarily stopping the clutch unit.

22. The hinge apparatus having an automatic return function according to claim 21, wherein the clutch stop unit comprises a preset screw for stopping function of the clutch unit by penetrating the upper body to integrate the inner clutch and the shaft.

23. A hinge apparatus having an automatic return function, the automatic return hinge apparatus comprising:

an upper body on a circumferential surface of which a first hinge which is fixed to a door is integrally formed and whose upper end portion is blocked by an upper cap;

a lower body on a circumferential surface of which a second hinge which is fixed to a door frame is integrally formed and whose lower end portion is blocked by a lower cap which is connected in a sealing manner;

a shaft whose upper end portion is coupled with the upper cap, and which is extended to the upper end portion of the lower body;

a piston whose outer circumference is slidably installed along the inner circumferential surface of the lower body and which divides the inner portion of the lower body into upper and lower chambers;

a rotational/linear motion converter which converts a rotational motion of the shaft into an axial linear motion of the piston when the rotational force of the door is applied to the shaft according to opening/closing of the door;

a damping unit which is installed in the piston, controls a descending/ascending speed of the piston according to the opening/closing of the door, and provides a damping function selectively in the case that the piston ascends;

a torsion spring which is built in the upper body so that one end of the torsion spring is fixed to the upper end portion of the shaft, thereby providing a restoring force rotating the shaft in the direction closing the door; and a clutch unit which is connected with the torsion spring, for stopping an increment of an elastic force of the torsion spring in the case that an opening angle exceeds a predetermined opening angle at the door opening and closing times, and for restoring the elastic force of the torsion spring in the case that the opening angle is within the range of the predetermined opening angle.

24. A hinge apparatus having an automatic return function, the automatic return hinge apparatus comprising:

an upper body on a circumferential surface of which a first hinge which is fixed to a door is integrally formed and whose upper end portion is blocked by an upper cap;

a lower body on a circumferential surface of which a second hinge which is fixed to a door frame is integrally formed and whose lower end portion is blocked by a lower cap which is connected in a sealing manner;

first and second reinforcement plates which are extended perpendicularly with the first and second hinges from the upper and lower bodies so as to be contiguous to the door and the door frame in order to disperse the external forces applied to the first and second hinges, respectively;

a shaft whose upper end portion is coupled with the upper cap, and which is extended to the upper end portion of the lower body;

a piston whose outer circumference is slidably installed along the inner circumferential surface of the lower body and which divides the inner portion of the lower body into upper and lower chambers;

a rotational/linear motion converter which converts a rotational motion of the shaft into an axial linear motion of the piston when the rotational force of the door is applied to the shaft according to opening/closing of the door;

a damping unit which is installed in the piston, controls a descending/ascending speed of the piston according to the opening/closing of the door, and provides a damping function selectively in the case that the piston ascends;

a torsion spring which is built in the upper body so that one end of the torsion spring is fixed to the upper end portion of the shaft, thereby providing a restoring force rotating the shaft in the direction closing the door;

a clutch unit which is connected with the torsion spring, for stopping an increment of an elastic force of the torsion spring in the case that an opening angle exceeds a predetermined opening angle at the door opening and closing times, and for restoring the elastic force of the torsion spring in the case that the opening angle is within the range of the predetermined opening angle; and a clutch stop unit for temporarily stopping the clutch unit.

* * * * *